US005144702A

United States Patent [19]

Haraga et al.

[11] Patent Number: 5,144,702

[45] Date of Patent: Sep. 8, 1992

[54] BLOW-OFF NOZZLE STRUCTURE CAPABLE OF AUTOMATICALLY VARYING THE BLOW-OFF VOLUME OF WATER

[75] Inventors: Hisato Haraga; Yasutoshi Inatomi; Takashi Obata; Mituaki Hashida; Koichi Uchiyama; Kenji Moriyama, all of Chigasaki, Japan

[73] Assignee: Toto Ltd., Fukuoka, Japan

[21] Appl. No.: 457,437

[22] Filed: Dec. 27, 1989

[30] Foreign Application Priority Data

| | | | |
|---|---|---|---|
| Dec. 29, 1988 | [JP] | Japan | 63-331772 |
| Feb. 10, 1989 | [JP] | Japan | 1-031617 |
| Mar. 24, 1989 | [JP] | Japan | 1-073367 |

[51] Int. Cl.[5] ..... A61H 33/02; A61H 9/00

[52] U.S. Cl. ..... 4/541.6; 4/541.4; 4/541.2; 128/66; 239/412; 239/428.5

[58] Field of Search ..... 4/541-544, 4/492, 192; 128/66; 239/412, 428.5; 137/393, 399, 386

[56] References Cited

U.S. PATENT DOCUMENTS

| | | | |
|---|---|---|---|
| 2,186,214 | 1/1940 | Simon | 239/412 X |
| 2,971,327 | 2/1961 | Moy et al. | 239/412 X |
| 4,770,212 | 9/1988 | Wianck | 138/45 |
| 4,779,803 | 10/1988 | Corsette | 239/428.5 |
| 4,797,958 | 1/1989 | Guzzini | 4/544 X |
| 4,892,289 | 1/1990 | Bunckard et al. | 138/45 X |

*Primary Examiner*—Henry K. Artis
*Assistant Examiner*—Robert M. Fetsuga
*Attorney, Agent, or Firm*—Jordan and Hamburg

[57] ABSTRACT

A blow-off nozzle structure capable of automatically varying the blow-off volume of water comprises a tubular nozzle casing defining a blow-off flow forming passage therein, the passage forming a blow-off opening at a front end thereof and a hot water inlet opening at a rear end thereof, a valve seat formed in the midst of the blow-off flow forming passage, a valve element capable of being extended to or retracted from said valve seat so as to adjust the degree of opening of said valve seat, an air mixing portion defined in the blow-off flow forming passage and disposed at a position in front of the valve seat, the air mixing portion communicated with an air intake portion which has one end opened to atmosphere, and an automatic valve-element reciprocating means capable of moving said valve element toward or away from said valve seat. Due to such construction, air-mixed water containing a sufficient amount of air can be blown off from the blow-off opening of the tubular nozzle casing and the volume of the blow-off air-mixed water can be finely and continuously regulated by the control unit corresponding to the degree of opening of said valve seat. The blow-off nozzle structure is especially applicable to a whirlpool bath which gives a remarkable massaging effect to a bather.

29 Claims, 54 Drawing Sheets

FIG. 15h (MILD BLOW-OFF)
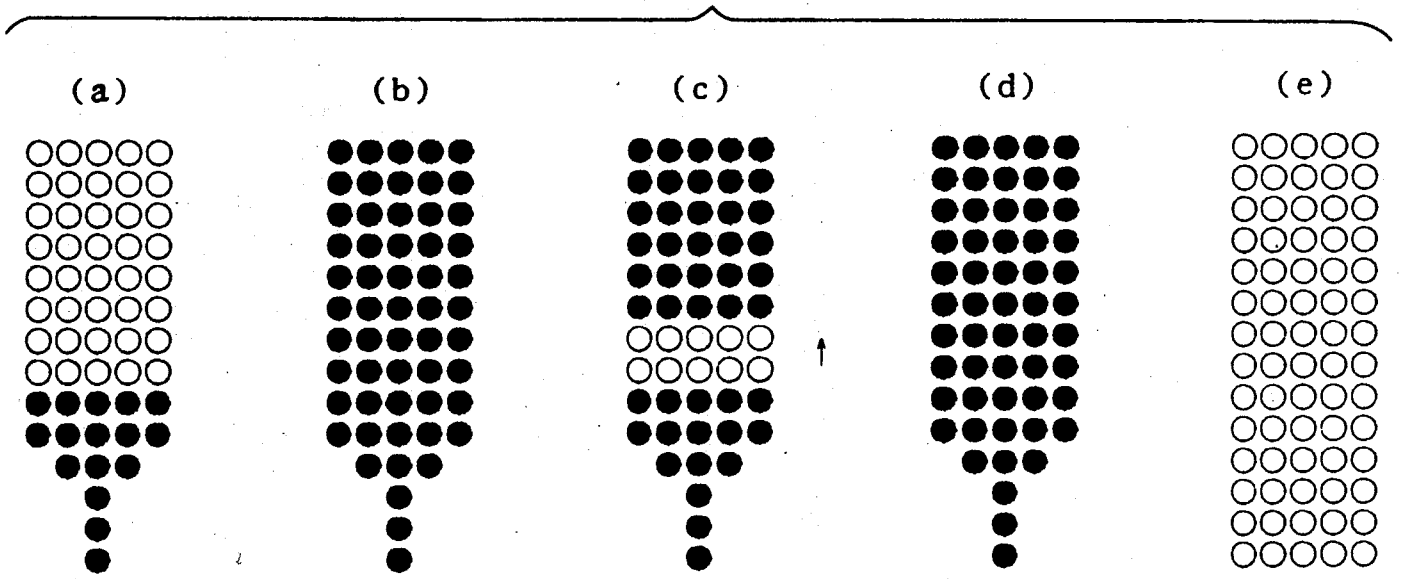

FIG. 15i (SPOT BLOW-OFF)
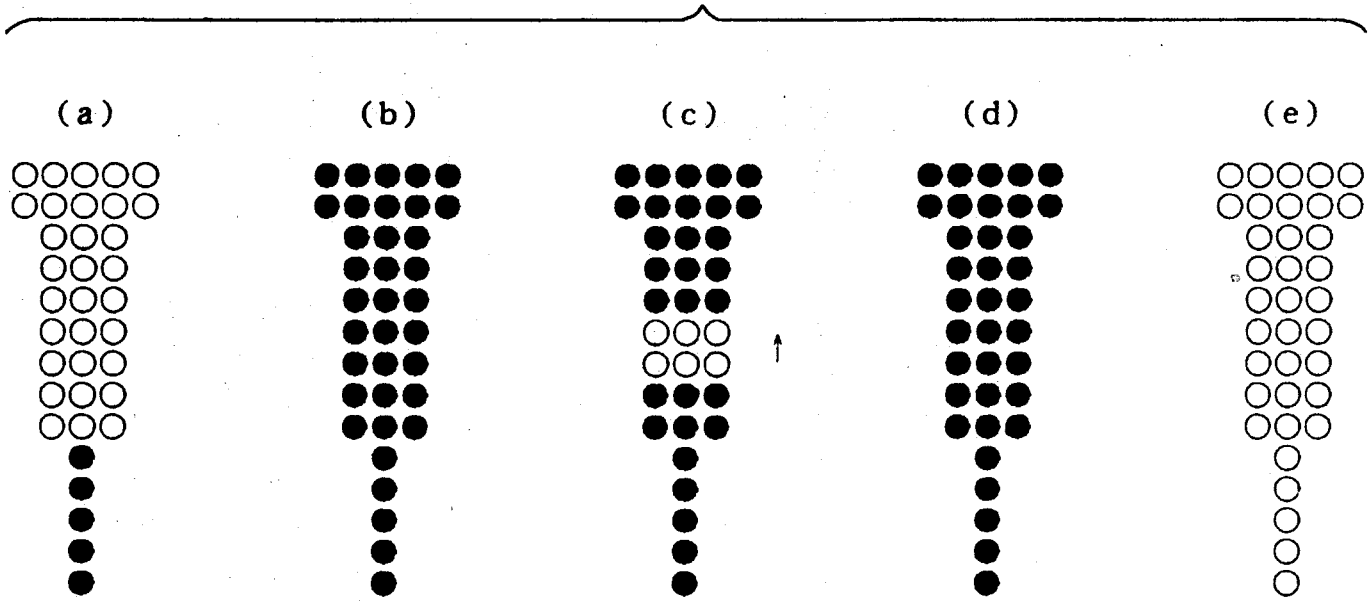

FIG. 15j (PULSE BLOW-OFF)
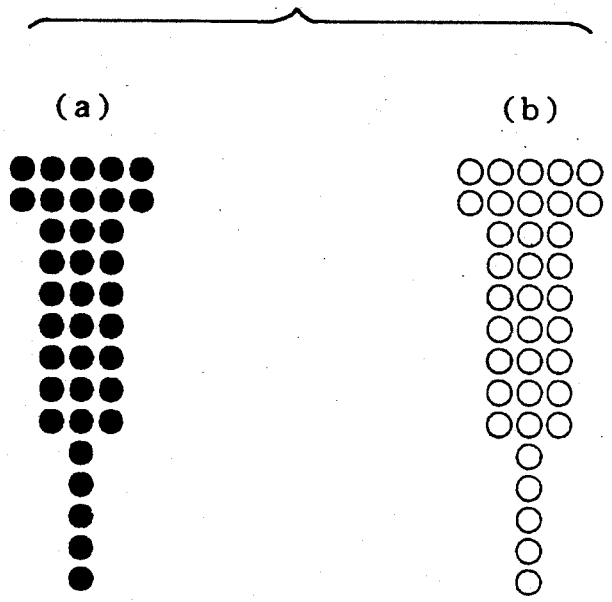

FIG. 15k (CYCLIC BLOW-OFF)
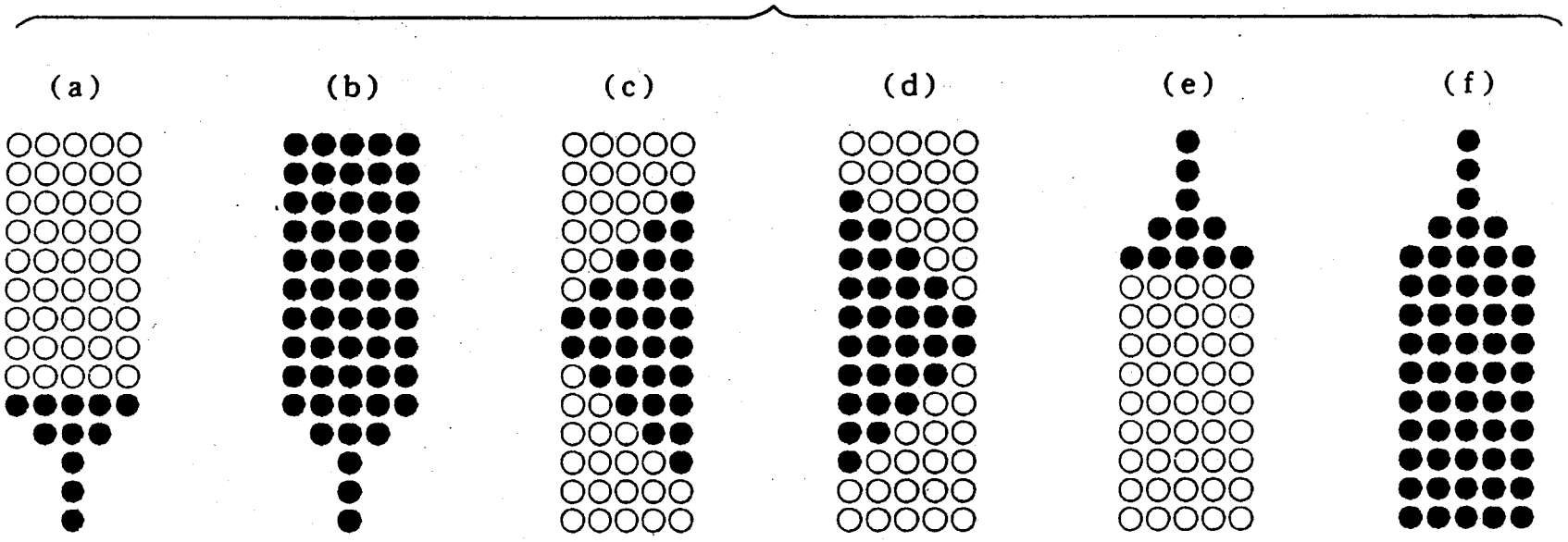

FIG. 15ℓ (WAVE BLOW-OFF)
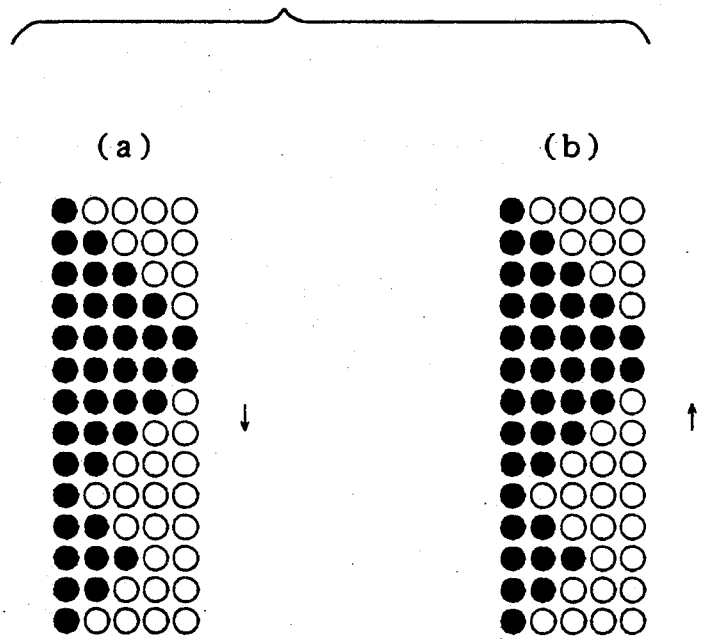

FIG. 15m (RANDOM BLOW-OFF)
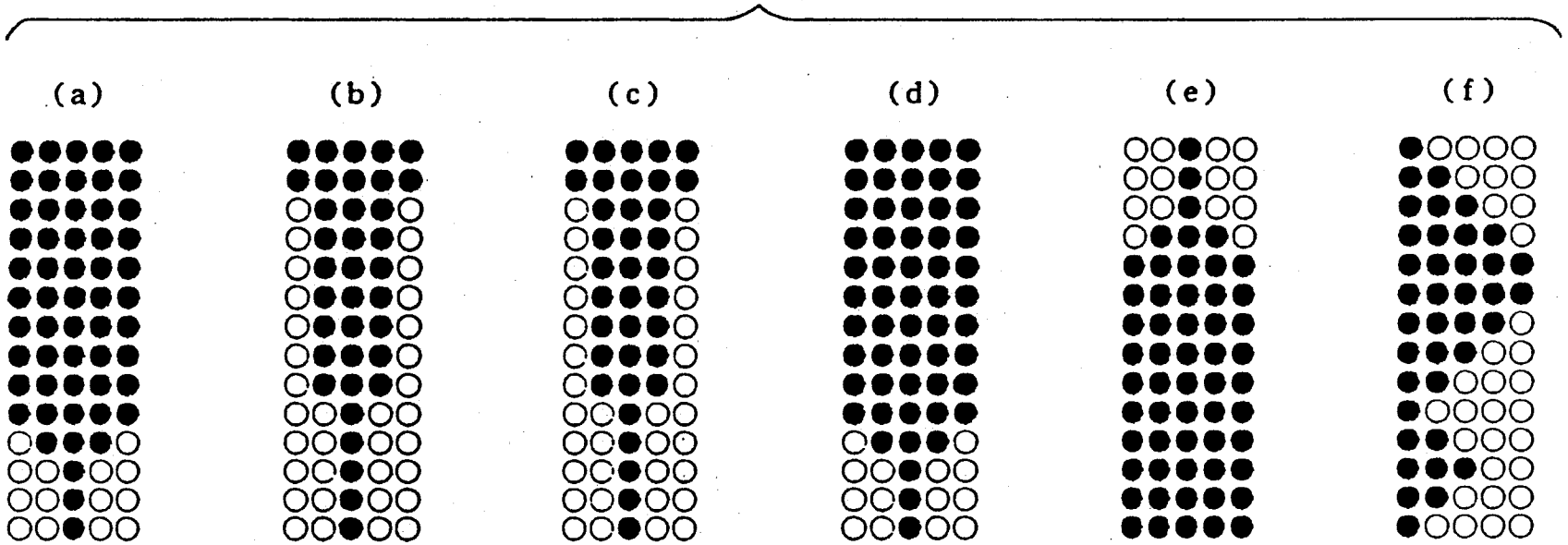

(TIMING CHART FOR MILD BLOW-OFF)

(TIMING CHART FOR CHILD SAFETY BLOW-OFF)

(TIMING CHART FOR SPOT BLOW-OFF)

(TIMING CHART FOR PULSE BLOW-OFF)

(TIMING CHART FOR WAVE BLOW-OFF A)

(TIMING CHART FOR WAVE BLOW-OFF B)

(TIMING CHART FOR WAVE BLOW-OFF C)

(TIMING CHART FOR CYCLIC BLOW-OFF A,B)

(TIMING CHART FOR CYCLIC BLOW-OFF C)

| FIG.28A | FIG.28B |
|---|---|

(BLOW OPERATION)

(AUTOMATIC FILTER WASHING OPERATION)

(FILTER WASHING OPERATION)

( HOT WATER BLOW-OFF POSITION CHANGING OPERATION )

BLOW-OFF NOZZLE STRUCTURE CAPABLE OF AUTOMATICALLY VARYING THE BLOW-OFF VOLUME OF WATER

BACKGROUND OF THE INVENTION

The present invention relates to a blow-off nozzle structure applicable to various kinds of vessels containing water including a whirlpool bath, and more particularly to such blow-off nozzles which can automatically vary the blow-off volume of water continuously.

Conventionally various improvements have been made on the bathtub and one of such improvement is found in a whirlpool bathtub disclosed in U.S. Pat. No. 4,797,958. In this patent specification, a bathtub equipped with an improved hydromassage system is disclosed.

The bathtub is substantially characterized by a plurality of nozzles attached on the walls of the bathtub, wherein each nozzle comprises a plug which is normally closed so as to separate in a sealed manner the delivery and the supply lines from the container part of the bathtub. With the plug, there is also associated a manually actuated conduit for regulating the flow volume. Provision is also made for sensors sensitive to the level of the water in the bathtub and to the pressure of the water in the delivery line, for controlling the automatic discharge of the hydromassage system, the operation of the tap and the circulating pump.

The above blow-off nozzle, however, suffers from the following drawbacks. Namely, although it can automatically shut or open the nozzle with the actuation of a solenoid valve, it is impossible for the nozzle to automatically regulate the blow-off volume of water finely and continuously. Although in U.S. Pat. No. 4,797,958, as means for regulating the flow volume of the water, a conduit is adjustably mounted on the front portion of the nozzle, such adjustment must be effected manually resulting in an extremely cumbersome operation.

Furthermore, although within the nozzle, the flow of water is throttled to produce a Venturi effect and air is incorporated into the flow of water, no vortex is formed in the water prior to the air mixing operation, the air mixing efficiency is less than optimal, thereby the massaging effect is also less than optimal.

Accordingly, it is an object of the present invention to provide a blow-off nozzles structure capable of automatically varying the blow-off volume of water which can overcome the above drawbacks of the conventional nozzle structure.

It is also an object of the present invention to provide a blow-off nozzle structure which can increase the amount of air mixed into the blown-off water so that the massaging effect is highly improved.

SUMMARY OF THE INVENTION

In summary, the present invention provides a blow-off nozzle structure capable of automatically varying the blow-off volume of water comprising a) a tubular nozzle casing defining a blow-off flow forming passage therein, the passage forming a blow-off opening at a front end thereof and a hot water inlet opening at a rear end thereof, b) a valve seat formed in the blow-off flow forming passage, c) a valve element capable of being extended or retracted from said valve seat so as to adjust the degree of opening of said valve seat, d) an air mixing portion defined in the blow-off flow forming passage and disposed at a position in front of said valve seat, the air mixing portion communicating with an air intake portion which has one end opened to the atmosphere, and e) an automatic valve element reciprocating means capable of moving said valve element toward or away from the valve seat, whereby air-mixed water is blown off from the blow-off opening of the tubular nozzle casing and the volume of the blow-off air-mixed is regulated by the degree of opening of the valve seat.

BRIEF DESCRIPTION OF THE DRAWINGS

FIG. 15*h* is a blow-off mode pattern showing the mild blow-off operation;

FIG. 15*i* is a blow-off mode pattern showing the spot blow-off operation;

FIG. 15*j* is a blow-off mode pattern showing the pulse blow-off operation;

FIG. 15*k* is a blow-off mode pattern showing the cyclic blow-off operation;

FIG. 15*l* is a blow-off mode pattern showing the wave blow-off operation;

FIG. 15*m* is a blow-off mode pattern showing the random blow-off operation;

DETAILED DESCRIPTION OF THE PREFERRED EMBODIMENTS

A whirlpool bath in which a plurality of blow-off nozzles of the present invention are incorporated will be described in detail below according to the following items with reference to the accompanying drawings.

(I) Description of the Whole of the Whirlpool Bath
(II) Description of the Construction of Various Portions
- (II-1) Description of the Construction of Blow-off Nozzles
- (II-2) Description of the Construction of Hot Water Suction Port
- (II-3) Description of the Construction of Air Intake Portion
- (II-4) Description of Functional Unit
- (II-5) Description of Circulating Pump
- (II-6) Description of Filter
- (II-7) Description of Controller
- (II-8) Description of Operating Panel
- (II-9) Description of Remote Controller (III) Description of Blow-off Modes
- (III-1) Mild Blow-off
- (III-2) Spot Blow-off
- (III-3) Pulse Blow-off
- (III-4) Wave Blow-off
- (III-5) Cyclic Blow-off
- (III-6) Programmed Blow-off (IV) Description of the Operation of the Whirlpool Bath
- (IV-1) Description of Operation Procedure based on Flow charts
- (IV-2) Description of Conditions for Starting Blow-off Operation
- (IV-3) Description of State Transition of Blow-off Modes
- (IV-4) Description of State Transition of Hot Water Blow-off Positions
- (IV-5) Description of State Transition of Strength Level in Blow-off Operation
- (IV-6) Description of Priority Main Operations
- (IV-7) Control Timing between Opening/Closing of Blow-off Volume Adjusting Valves and Change of the Rate of Revolution of Circulating Pump

(I) DESCRIPTION OF THE WHOLE OF THE WHIRLPOOL BATH

First, the construction of the whole of the whirlpool bath according to the invention will be described below.

Figure 1:
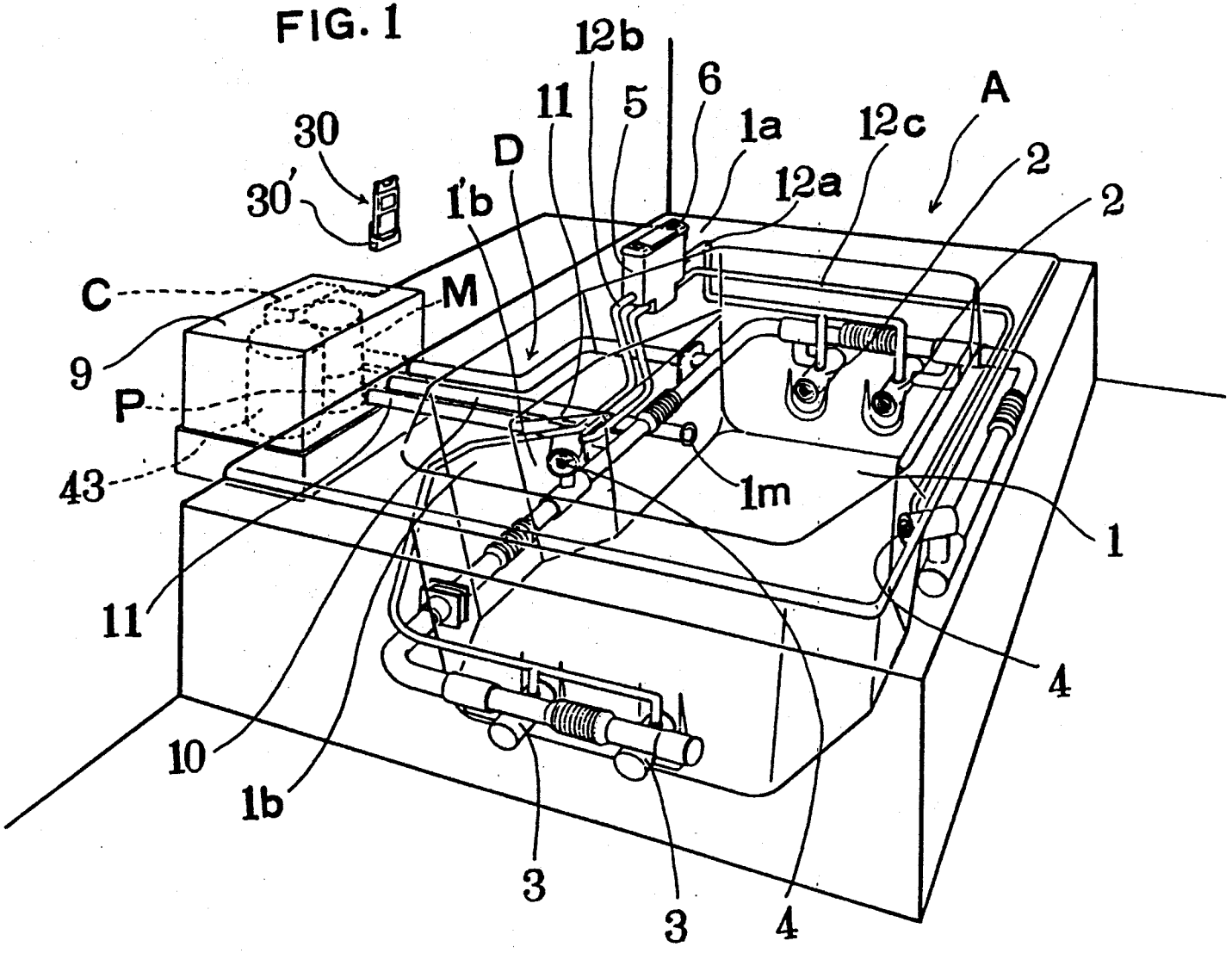
FIG. 1 is a perspective view of a whirlpool bath provided with a blow-off nozzle structure to the present invention.
Figure 2:
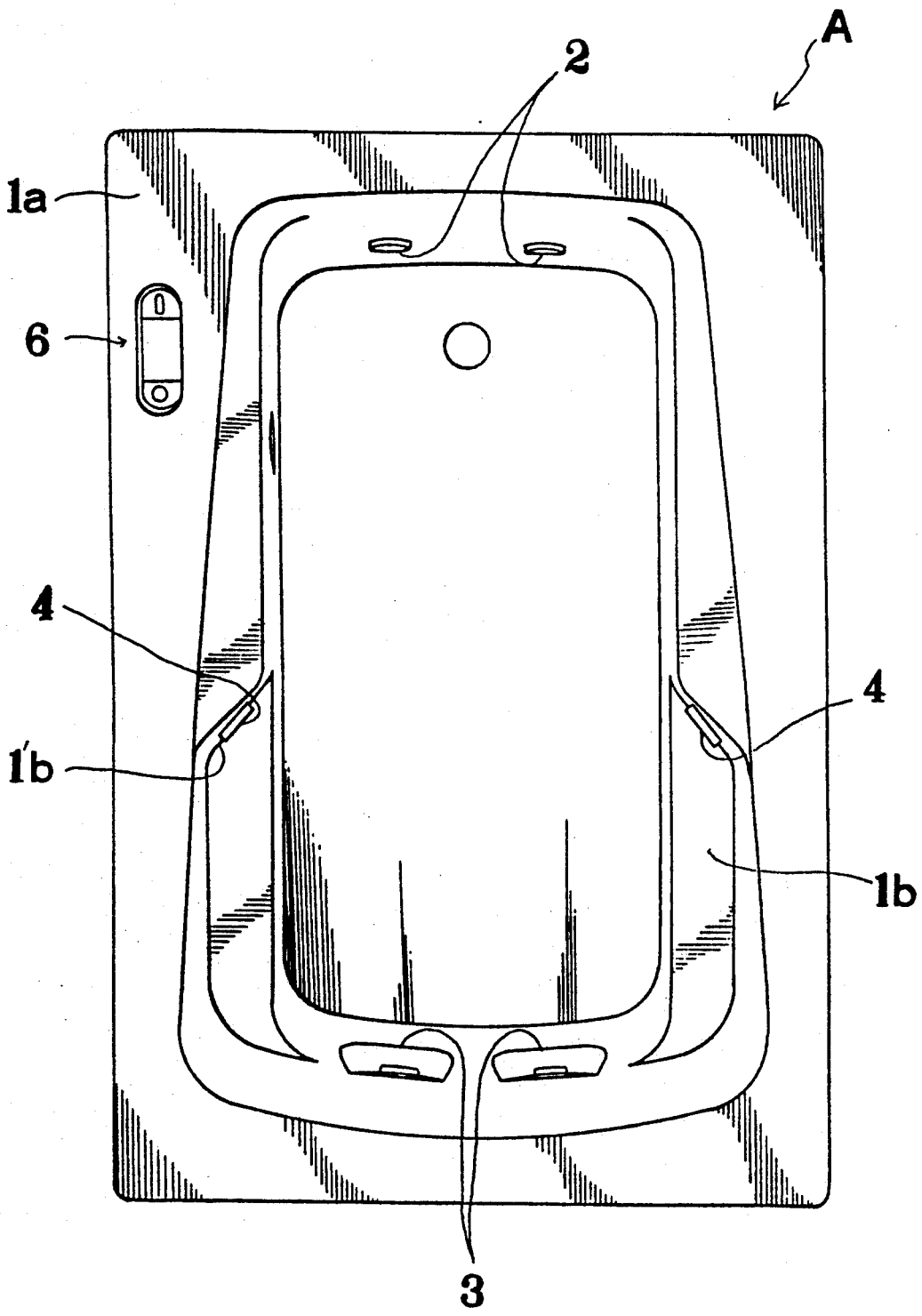
FIG. 2 is a plan view of the whirlpool bath.

In FIGS. 1 and 2, the reference mark A denotes the whirlpool bath according to the present invention. The whirlpool bath A has a total of six leg-, back- and belly-side blow-off nozzles 2,2; 3,3; 4,4 formed in the front wall, rear wall, and right and left side walls, respectively, of a bathtub body 1 formed in the shape of a box whose upper surface is open.

The bathtub body 1 has a marginal flange-like portion 1*a*, and an air intake portion 5 is formed in the marginal flange-like portion 1*a*.

Further, a pair of vertically long recesses 1*b*, 1*b* which are generally V-shaped in cross-section are formed in approximately central portions of the right and left side walls, and the belly-side blow-off nozzles 4, 4 are mounted in inclined surfaces 1'*b*, 1'*b* of the recesses 1*b*, 1*b* which surfaces face the rear wall (back side), the nozzles 4, 4 being oriented toward the central part of the rear wall.

The belly-side blow-off nozzles 4, 4 are provided in positions higher than the leg- and back-side blow-off nozzles 2,2, 3,3 so that hot water can surely be applied to the belly, the chest and other portions of the human body.

Outside the whirlpool bath A is disposed a functional unit 9.

Figure 10:
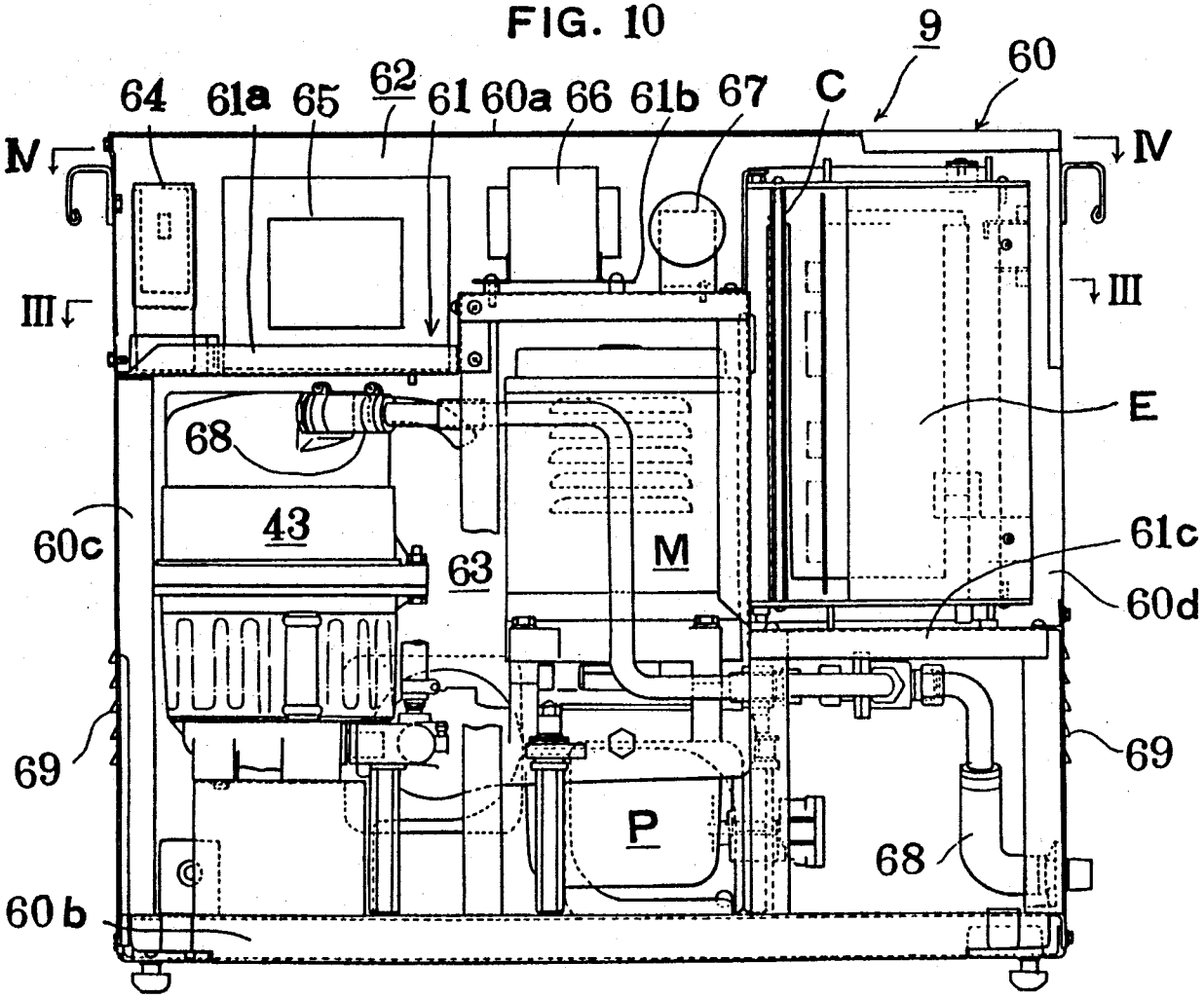
FIG. 10 is a front cross-sectional elevational view of a functional unit in which a circulating pump is installed.
Figure 11:
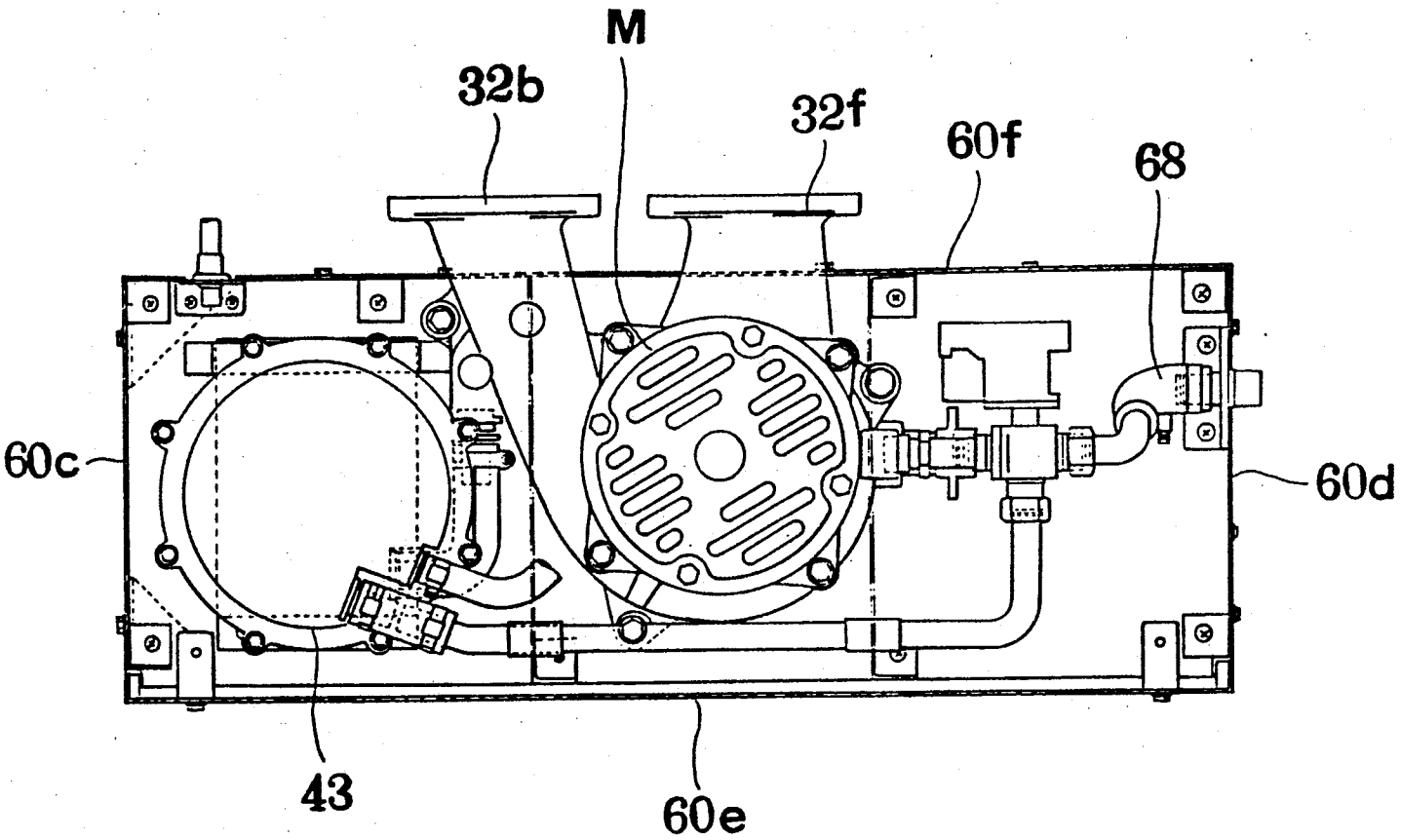
FIG. 11 is a cross-sectional plan view of a functional unit taken along the line III—III of FIG. 10.
Figure 12:
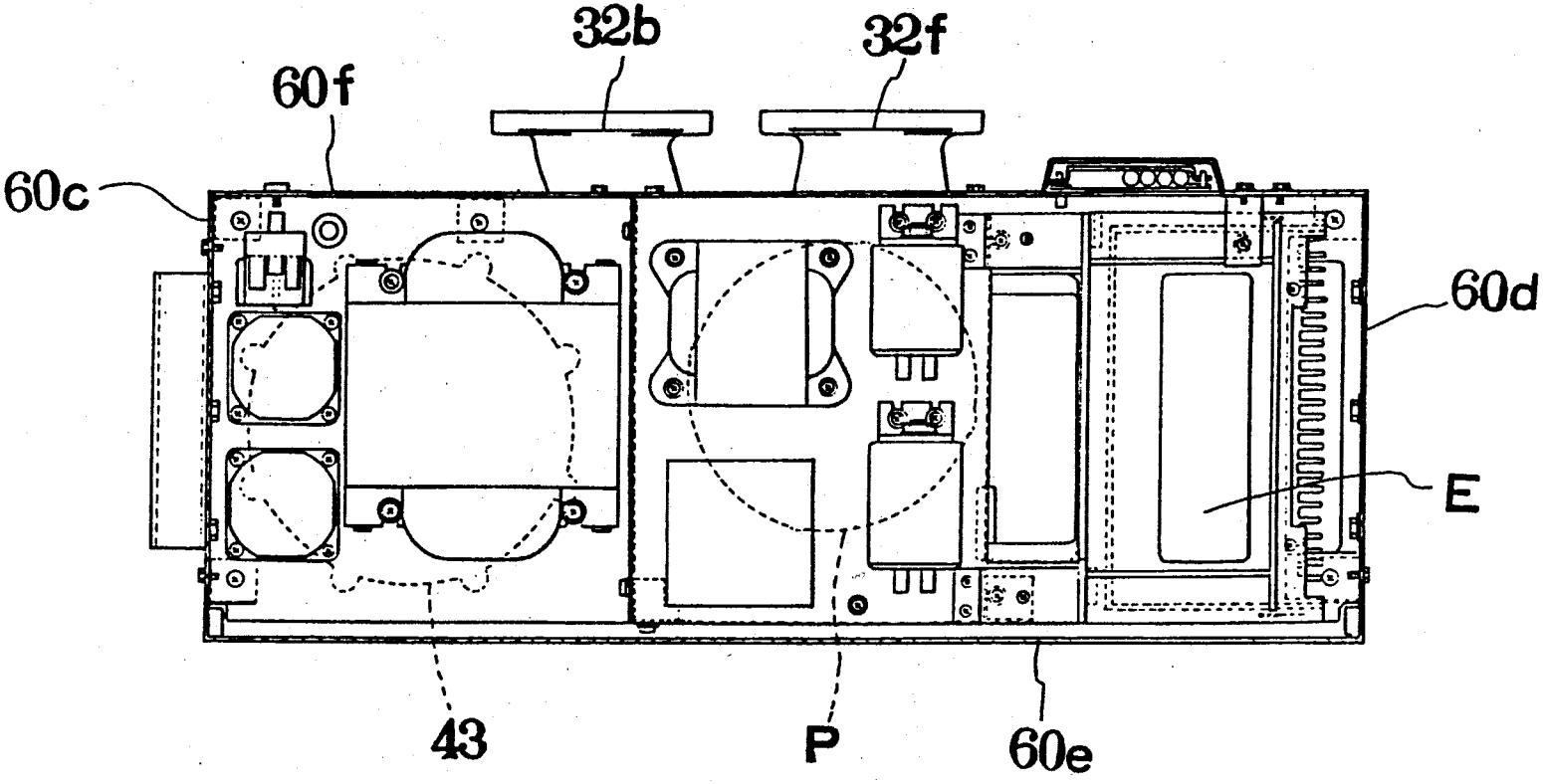
FIG. 12 is a cross-sectional plan view of a functional unit taken along the line IV—IV of FIG. 10.

Within the functional unit 9, as shown in FIG. 10 to FIG. 12, there are provided a hot water circulating pump P, a filter 43 for filtering the hot water which is circulated by the pump P, a pump driving motor M for driving the pump P, and a controller C for controlling the operation of the pump driving motor M as well as the operations of later-described nozzle valve actuating motors M1, bubble volume adjusting valve actuating motors M2 and a motor-driven three-way valve 45.

The functional unit 9 and the inside construction thereof are described in detail later in conjunction with FIG. 10 to FIG. 12.

Figure 3:
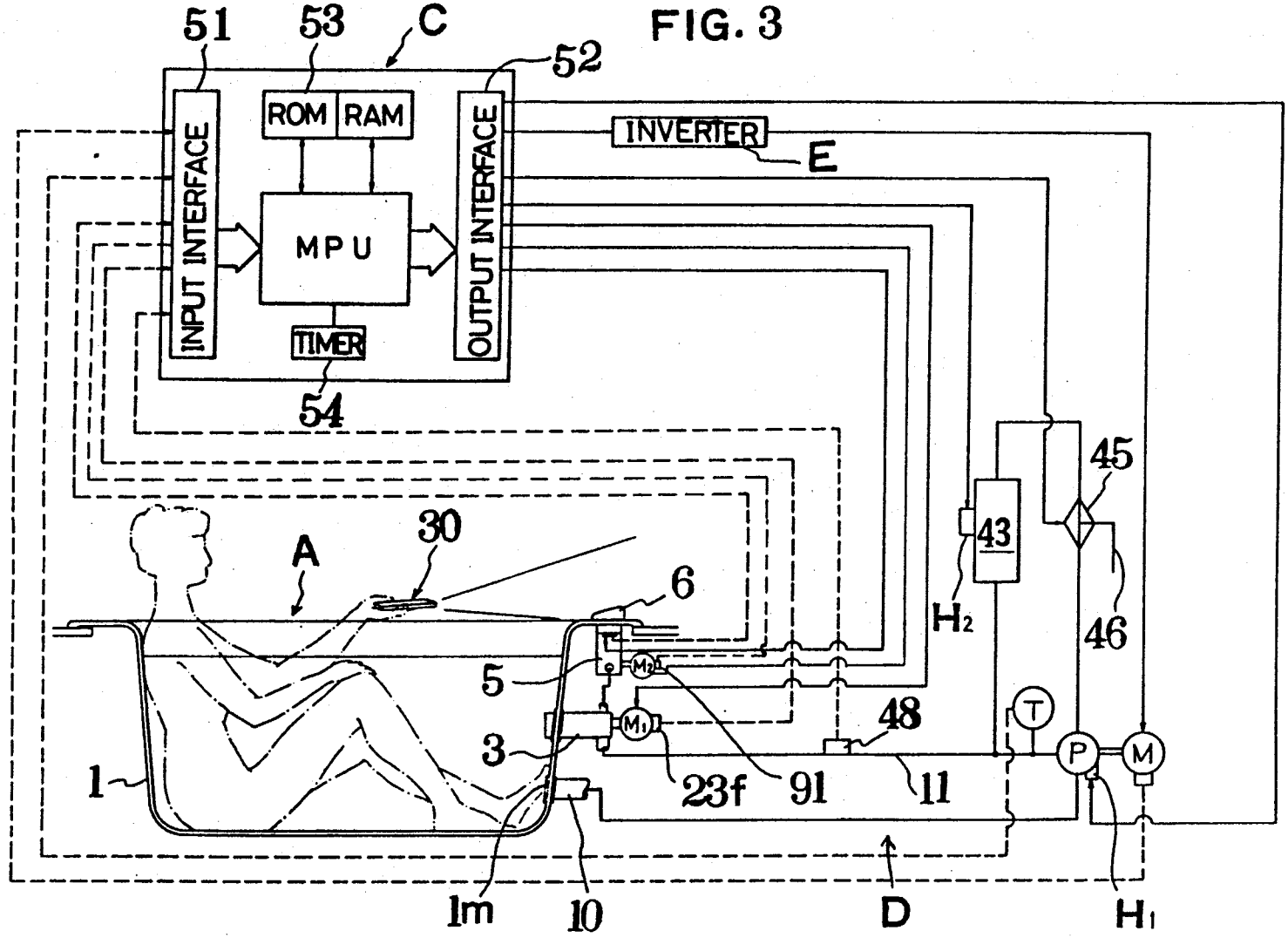
FIG. 3 is a conceptual explanatory view of the construction of the whirlpool bath.

Between the circulating pump P and the whirlpool bath A, there is disposed a hot water circulation path D as shown in FIG. 1 and FIG. 3.

The hot water circulation path D is composed of a hot water suction pipe 10 for sucking hot water from the whirlpool bath A into the circulating pump P and a hot water forced-feed pipe 11 for feeding hot water from the circulating pump P to the inside of the bathtub body 1.

As shown in FIG. 3, one end of the hot water suction pipe 10 is connected to a suction port 1*m* which opens into a lower part of the bathtub body 1, and the other end thereof is connected to a suction port of the circulating pump P for the suction of hot water into the circulating pump P. On the other hand, the hot water forced-feed pipe 11 is connected at one end thereof to a discharge port of the circulating pump P and it has opposite end portions connected to the blow-off nozzles 2,3,4.

The suction port 1*m* is provided in a position lower than the leg- and back-side blow-off nozzles 2,3.

The suction port 1*m* is explained in detail later in view of FIG. 8*c* and FIG. 8*d*.

Between the circulating pump driving motor M and the controller C, there is disposed an inverter E, as shown in FIG. 3. The rate of revolution of the circulating pump P is controlled by varying the output frequency of the inverter E, whereby the change of the rate of revolution of the pump P which corresponds to the change of blow-off volume and pressure of hot water can be done smoothly and with certainty.

As shown in FIG. 3, moreover, a pressure sensor 48 for detecting the flow pressure of hot water being fed under pressure through the hot water forced-feed pipe 11 is mounted at an intermediate point in the pipe 11. The result of detection from the pressure sensor 48 is fed to the controller C, which in turn controls the volume and pressure of hot water to be blown off from the nozzles 2, 3, 4 by changing the rate of revolution of the pump driving motor M and the degree of opening or closing of each of those nozzles 2, 3, 4.

The pressure sensor 48 also serves as a level sensor for detecting the level of hot water in the bathtub body 1 when the circulating pump P is not operated. Namely, the whirlpool bath A being considered above is constructed such that, when the hot water level is found to be below a predetermined certain level by the use of the pressure sensor 48 which works as a level sensor, blowing operating, freeze proofing operation, filter washing operating and automatic filter washing operation which are started by the controller C as described later are not yet started.

A hot water temperature sensor T for detecting the temperature of hot water being fed under pressure through the hot water forced-feed pipe 11 is mounted at an intermediate point in the pipe 11, as shown in FIG. 3. The result of detection from the temperature sensor T is fed to the controller C, which in turn controls the pump driving motor M and the blow-off nozzles 2, 3, 4.

When the hot water temperature is found to be lower than a predetermined certain temperature by the use of the hot water temperature sensor T, the later-described blowing operation, freeze proofing operation, filter washing operation and automatic filter washing operation which are started by the controller C are not started.

In other words, so long as the water level and temperature of hot water are lower than the respective predetermined certain levels, the later-described blowing operation, freeze proofing operation, filter washing operation and automatic filter washing operation by the controller C are not started.

Figure 4:
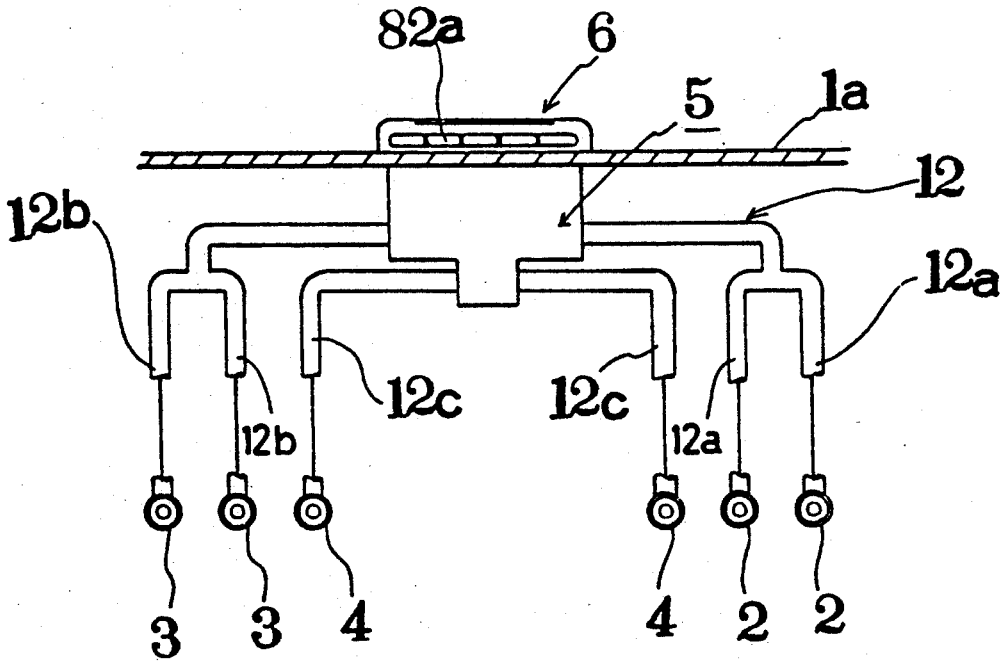
FIG. 4 is an explanatory view of an air intake piping arrangement.
Figure 9:
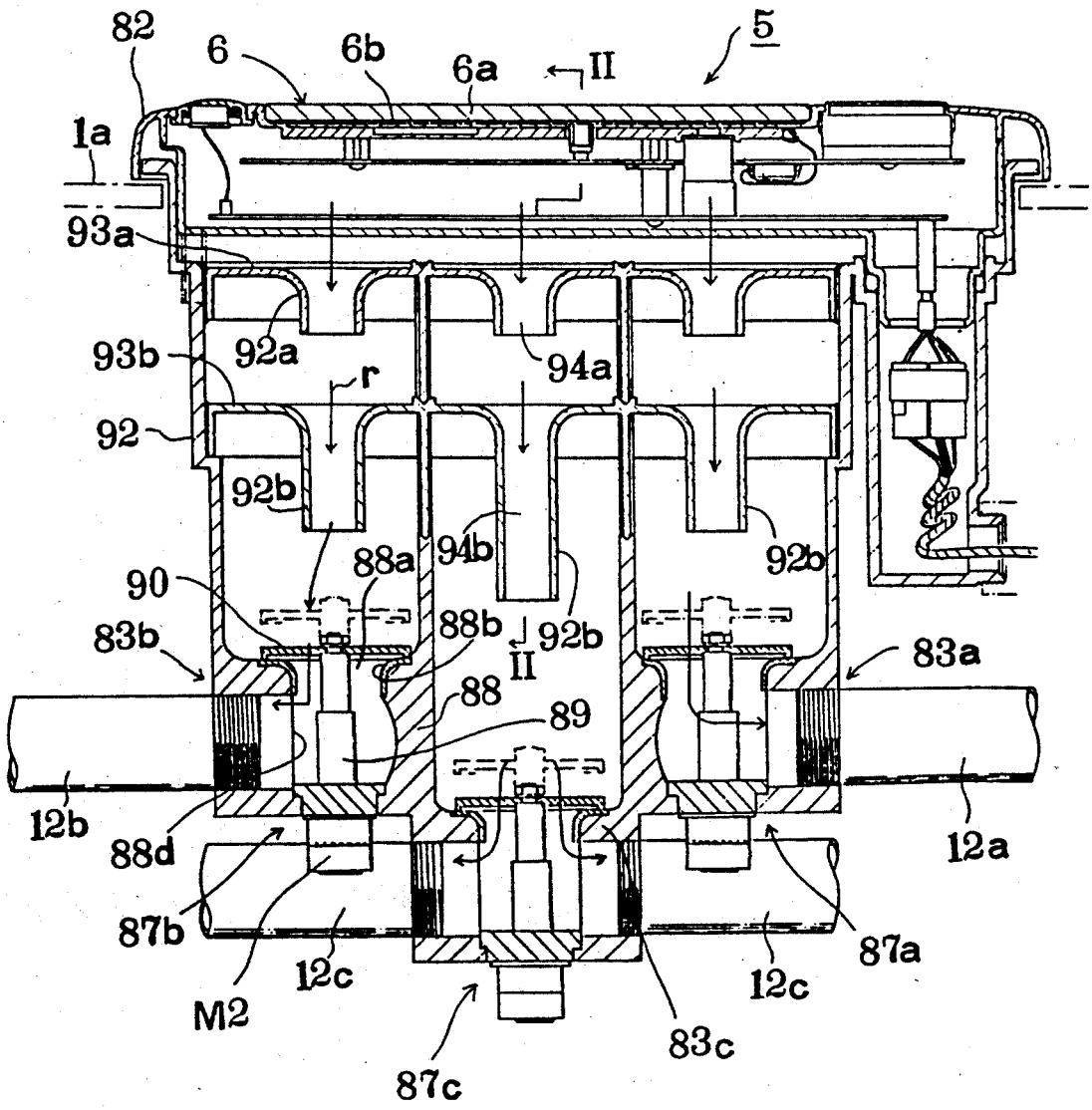
FIG. 9 is an enlarged vertical cross-sectional view of an air intake portion provided with an operating panel on the top thereof.

As shown in FIGS. 1, 4 and 9, a plurality of air intake pipes 12 are disposed between the air intake portion 5 and the blow-off nozzles 2, 3, 4. The air intake pipes 12 comprise respective air suction pipes 12*a*, 12*b*, 12*c* which are connected to the nozzles 2, 3, 4 respectively.

The air which has been taken in from the air intake portion 5 is introduced into the blow-off nozzles 2, 3, 4 through the air suction pipes 12*a*, 12*b*, 12*c* by utilizing a negative pressure generated at the time of blow-off of hot water from the nozzles 2, 3, 4 whereby air-mixed bubbling hot water is blown off into the bathtub body 1 from those nozzles 2, 3, 4.

In the vicinity of the bathtub body 1, there is disposed an operating panel 6, as shown in FIGS. 1 to 3, so that the operation of the whirlpool bath A can be done by the operating panel 6. This operating panel 6 will be described later.

Figure 9A:
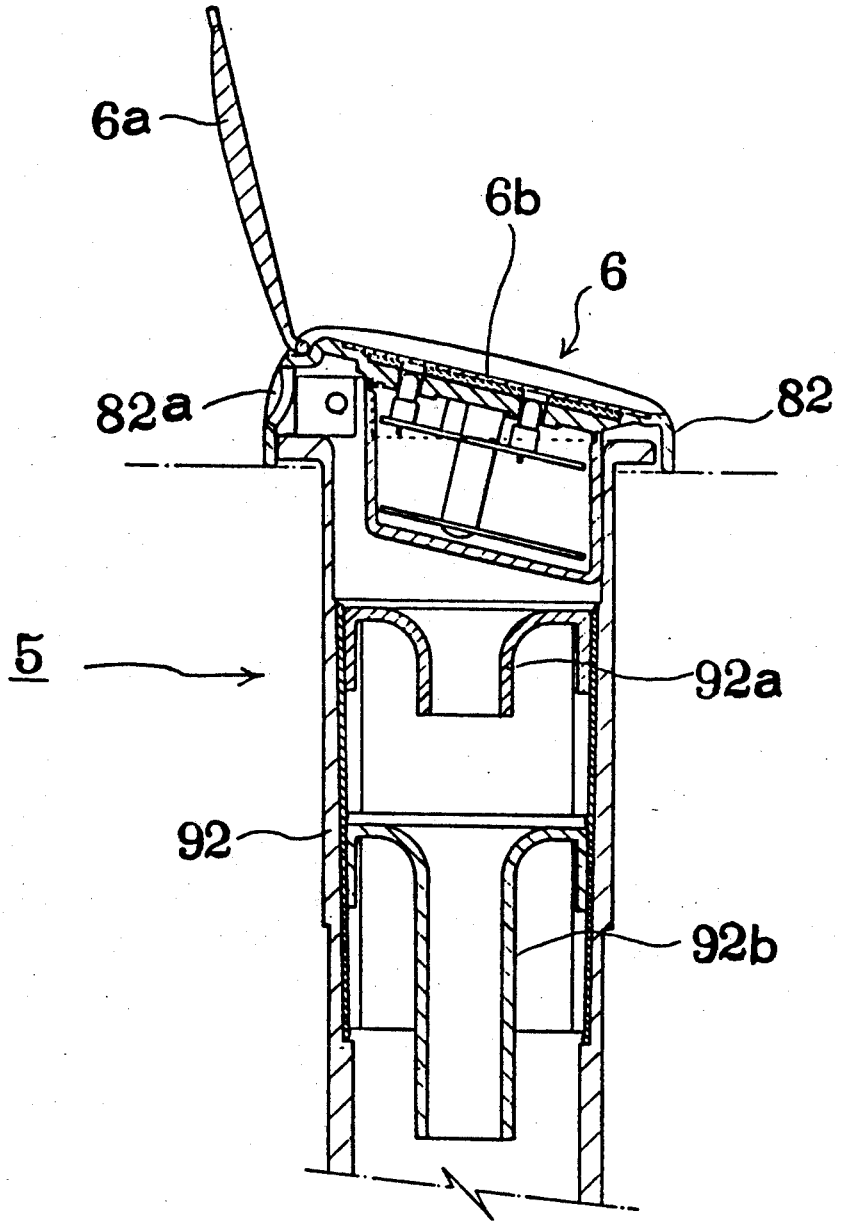
FIG. 9*a* is an enlarged cross-vertical sectional view of an air intake port provided with an operating panel on the top thereof taken along the line II—II of FIG. 9.
Figure 9B:
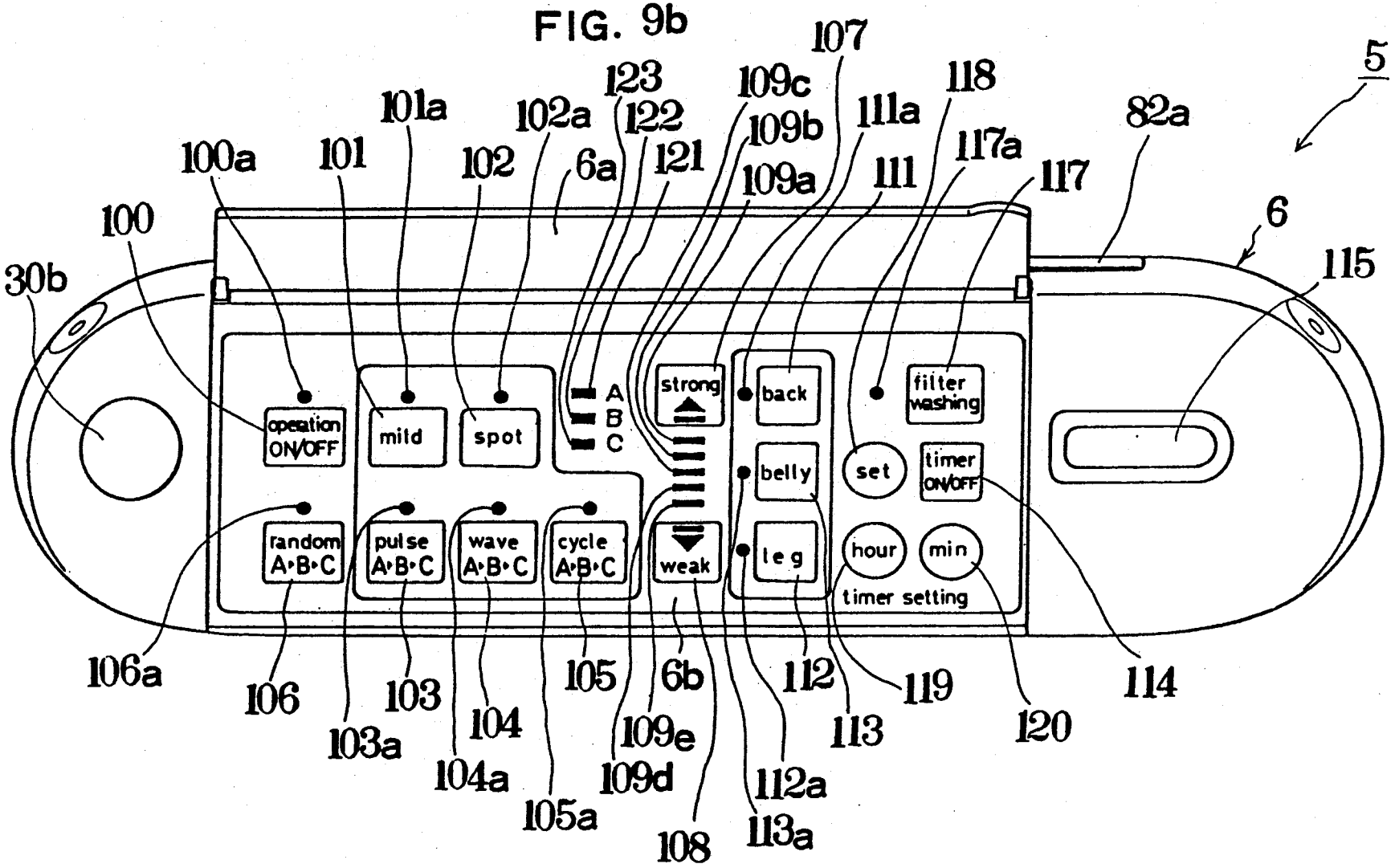
FIG. 9*b* is a plan view of the air intake port where the operating panel is mounted.

As shown in FIG. 9*b*, numeral 30*b* denotes an infrared ray sensor provided on the operating panel 6. The infrared ray sensor 30*b* is for sensing infrared rays emitted from a later-described remote controller 30.

In the above construction, the gist of the present invention resides in that the degree of opening and that of closing of each of the leg-, back- and belly-side blow-off nozzles 2, 3, 4, can be controlled through the controller C to obtain various blow-off modes (mild blow-off, spot blow-off, pulse blow-off, wave blow-off, cycle blow-off, and program blow-off) as will be described in detail later in order to fully satisfy various likings of bathing persons.

In this embodiment, however, for obtaining various blow-off modes, not only the degree of opening and that of closing of blow-off nozzles 2, 3, 4 but also the rate of revolution of the circulating pump P are varied.

Furthermore, in this embodiment, the blow-off strength can be varied by controlling the rate of revolution of the circulating pump P, and further, various blow-off positions can be selected so that hot water jets of a desired strength can be applied to desired portions of the bathing person's body to obtain a sufficient massaging effect induced by the hot water jets.

Particularly, in this embodiment, the rate of revolution of the circulating pump P is controlled by the inverter E so that the change of blow-off volume and pressure as well as that of the blow-off strength in various blow-off modes can be done smoothly.

(II) DESCRIPTION OF THE CONSTRUCTION OF VARIOUS PORTIONS

(II-1) Description of the Construction of Blow-off Nozzles

The leg-, back- and belly-side blow-off nozzles 2,3,4 are automatic blow-off volume changeable nozzles of the same construction in which the blow-off volume and pressure of hot water can be changed automatically.

The structure of a leg-side blow-off nozzle 2 will be described below with reference to FIGS. 5 to 8.

The leg-side blow-off nozzle 2 is constructed as follows.

Figure 5:
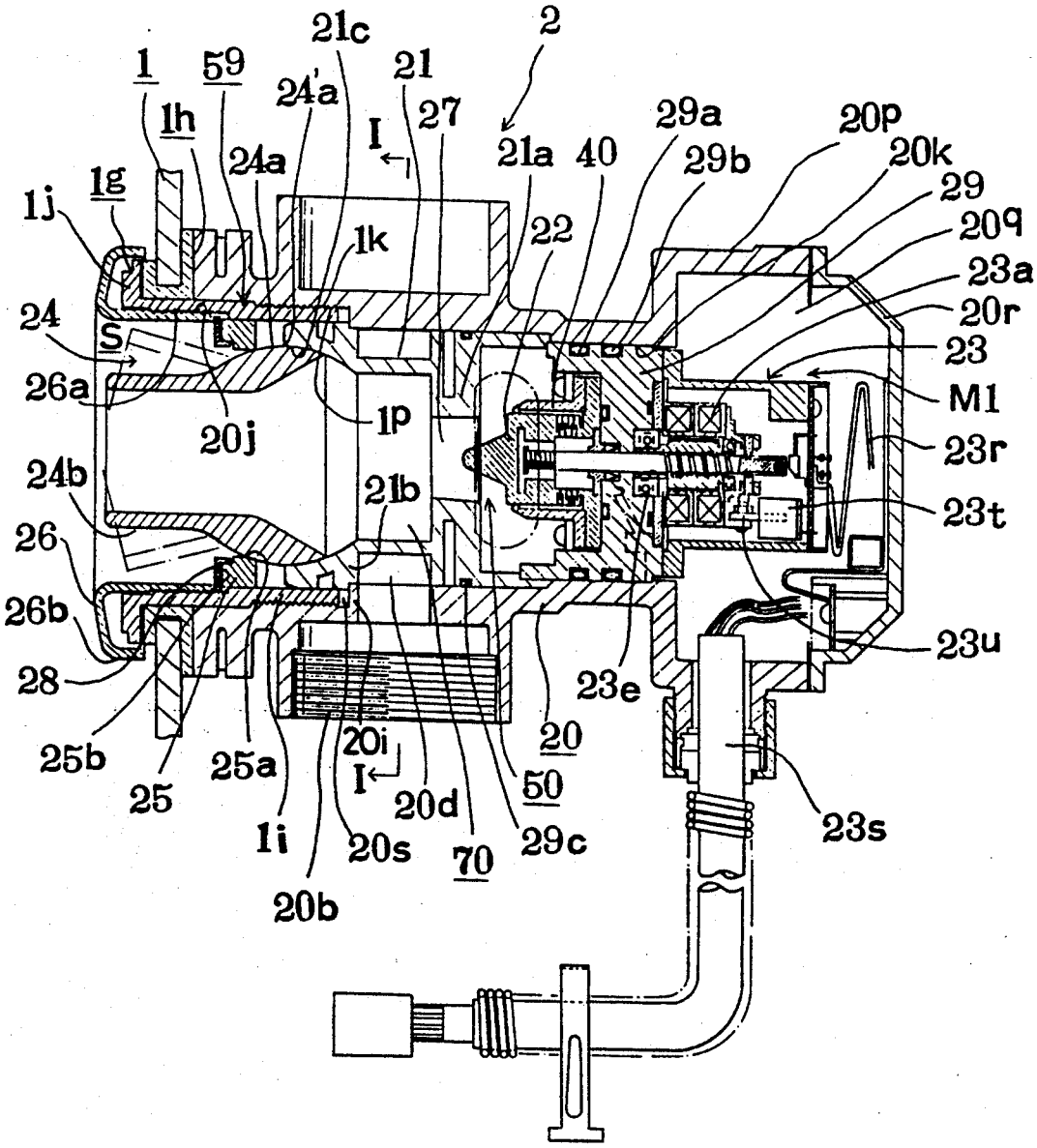
FIG. 5 is an enlarged sectional view of the blow-off nozzle.

A cylindrical nozzle casing 20 is connected to a leg-side blow-off nozzle connection port 1g of the bathtub body 1 in a cantilevered form outside the bathtub body 1 as shown in FIG. 5.

The interior of the nozzle casing 20 is composed of a hot water jet forming portion (or a turbulent hot water flow forming portion) 50 for forming the hot water supplied into the nozzle casing 20 from the hot water forced-feed pipe 11 into a hot water jet or a turbulent hot water flow; an air mixing portion 70 communicating with the air intake portion 5 through the air intake pipe 12 and functioning to mix air into the hot water jet fed from the hot water jet forming portion 50; and a throat portion 59 which determines the blow-off direction of air-mixed bubbling hot water blown off from the throat portion 59 toward the interior of the bathtub body 1.

As shown in FIG. 5, the front end of the nozzle casing 20 is connected in a watertight manner to the leg-side blow-off nozzle connection port 1g which is circular and opens into a lower part of the front wall of the bathtub body 1, while the rear end thereof is extended backwards substantially horizontally.

Numeral 1h denotes a ring-shaped packing having the outer circumferential portion thereof snugly and watertightly fitted in the connection port 1g along the peripheral edge of the same port 1g; numeral 1i denotes a nozzle mounting sleeve which has an enlarged flange portion 1j at one end thereof and an outer male threaded portion 1k on the other end thereof. The enlarged flange portion 1j is abutted to the front end surface of the ring-shaped packing 1h while the outer male threaded portion 1k is meshed to an inner threaded portion 1p so as to fixedly mount the nozzle 2 on the side wall of the bathtub body 1.

Figure 6:
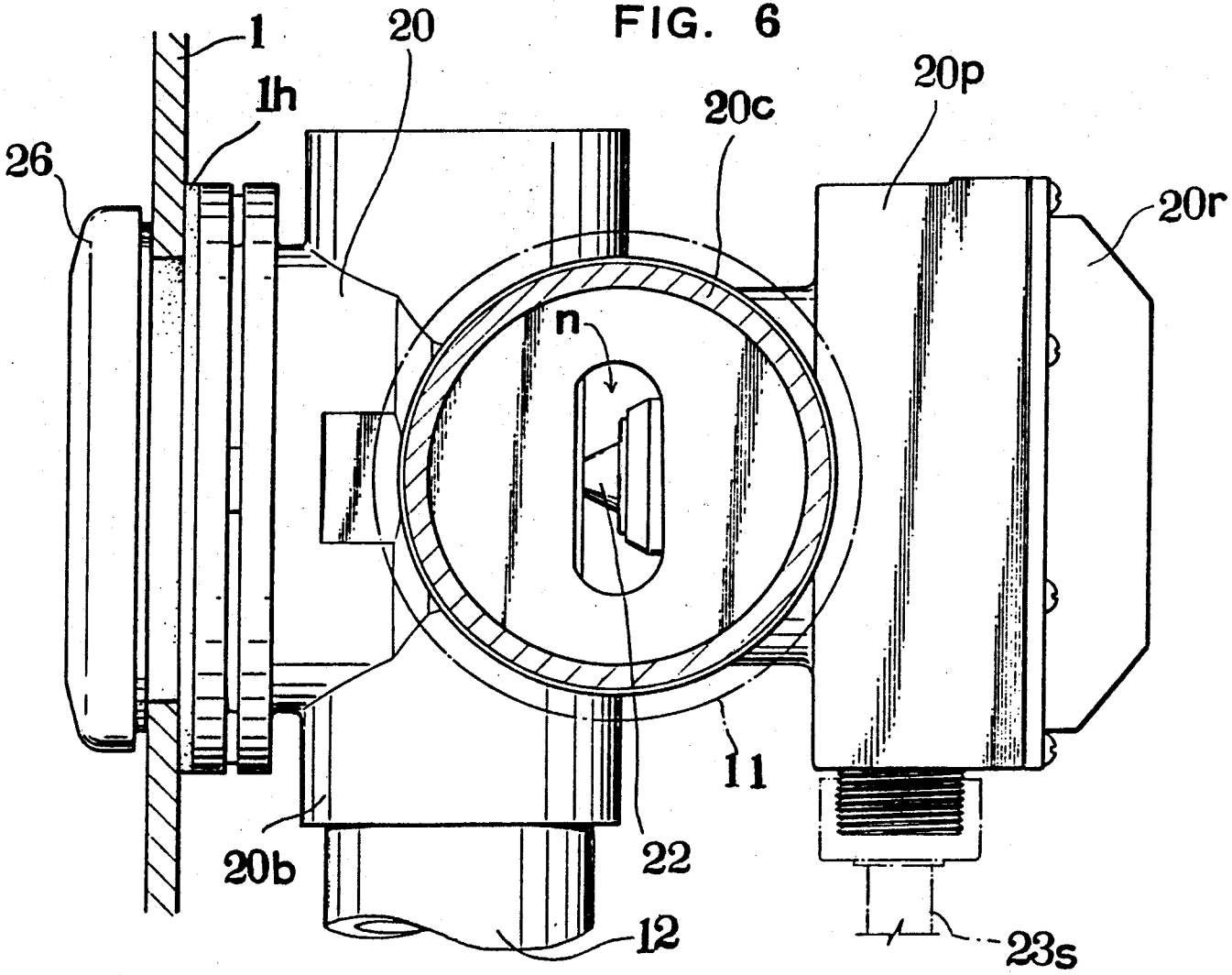
FIG. 6 is a side elevational view of the blow-off nozzle.

Numeral 20c in FIG. 6 denotes a forced-feed pipe connecting portion to which the hot water forced-feed pipe 11 is disconnectably connected. The arrow n indicates a hot water inflow direction.

Numeral 26 denotes a decorative cover having a front end portion 26b which covers both the front end of the nozzle casing 20 and the enlarged flange portion 1j of the nozzle mounting sleeve 1i.

And a later-described throat fixing member 25 is fixed by the rear end of the decorative cover 26. On the outer peripheral surface of the decorative cover 26 which is cylindrical as a whole, there is formed an outer threaded portion 26a, which is threadedly engaged disengageably with an internal threaded portion 20j formed on the inner peripheral surface of the front end portion of the nozzle casing 20.

The throat portion 59 is composed of a throat 24, a throat fixing member 25 which supports the throat 24 in a tiltable manner, and a front portion of a valve seat forming cylindrical body 21. Numeral 24a denotes a throat base having a spherical outer peripheral surface; numerals 25a and 21c denote throat supporting surfaces formed on the inner periphery of the throat fixing member 25 and that of the valve seat forming cylindrical body 21, respectively, to support the throat base 24a slidably; and numeral 24b denotes a throat tip which is cylindrical and whose outside diameter is smaller than that of the throat base 24a.

The tilting angle of the throat tip 24b is manually adjustable in the vertical and horizontal directions about the base 24a.

Besides, the throat 24 can be stopped at any desired tilted angle by a predetermined certain sliding resistance exerted from the throat supporting surfaces 25a, 21c on the base 24a of the throat 24.

The reference mark S denotes a space for throat tilting formed between the outer peripheral surface of the throat tip 24b and the inner peripheral surface of the decorative cover 26.

The throat fixing member 25 is fitted in the front portion of the nozzle casing 20 through a positioning groove formed in the inner peripheral surface of the casing front portion, and its front face 25b is fixed to the rear end of the decorative cover 26 by means of a fixing ring 28.

Further, its throat supporting surface 25a formed on the inner periphery supports the outer peripheral surface of the front portion of the throat base 24a slidably.

The valve seat forming cylindrical body 21 is inserted into the central portion of the nozzle casing 20 removably from the front-end opening 1g of the nozzle casing 20 so that its rear end face is positioned in the vicinity of the forced-feed pipe connecting portion 20c, and a convex stepped portion 21b formed on the outer peripheral surface of the front portion of the cylindrical body 21 is engaged with a concave stepped portion 20i formed in the inner peripheral surface of the nozzle casing 20 to prevent a backward slide of the cylindrical body 21.

The throat base 24a is fitted in the front portion of the valve seat forming cylindrical body 21 in contact with the throat supporting surface 21c formed on the inner peripheral surface of the front portion. In this state, a forward slide of the valve seat forming cylindrical body 21 is prevented by the throat base 24a whose forward slide is prevented by the throat fixing member 25.

The hot water jet forming portion 50 is composed of a valve seat 21a which defines interiorly a hot water jet forming path 27; a blow-off volume adjusting valve element 22 which comes into contact and moves out of contact with the valve seat 21a to adjust the degree of opening and that of closing of the hot water jet forming path 27 (that is, adjust the blow-off volume and pressure of blown-off hot water); a nozzle valve actuating motor M1 for actuating the blow-off volume adjusting valve element 22; and a rear wall forming plate 29.

Figure 7:
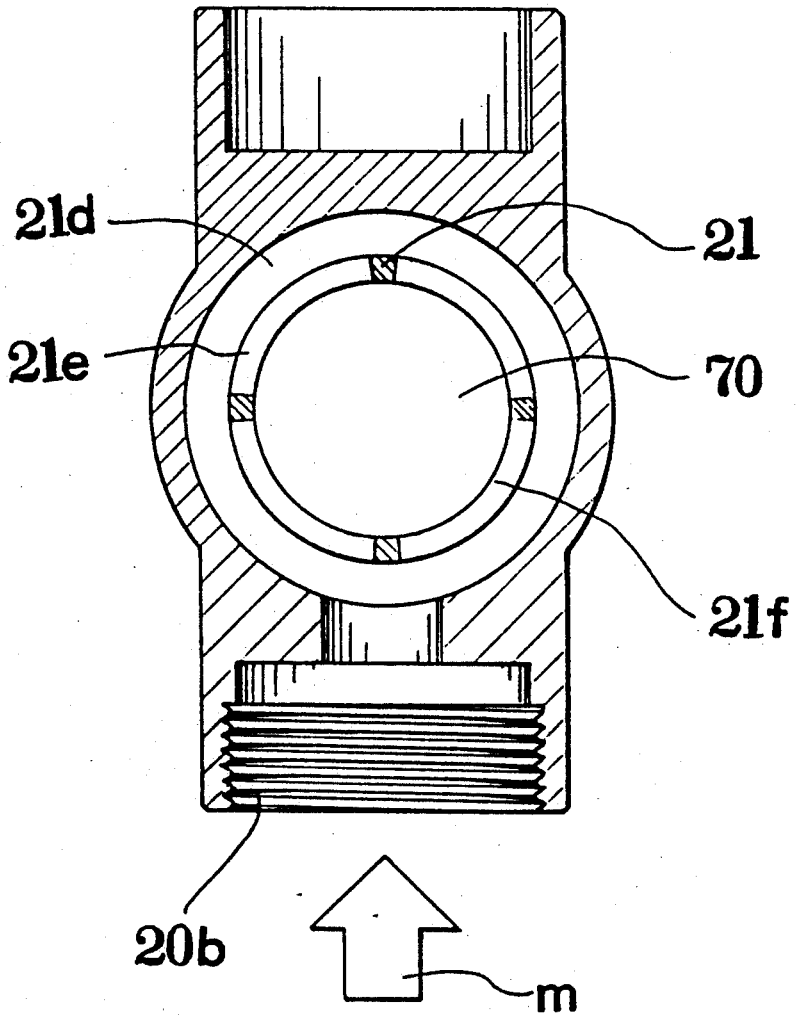
FIG. 7 is a cross-sectional view taken on line I—I of FIG. 5.

In FIGS. 6 and 7, the numeral 21d denotes an air inflow path formed annularly along the outer peripheral surface of the valve seat forming cylindrical body 21; and numerals 21e, 21f represent air inlet openings formed on the side of an air intake pipe connecting portion 20b and on the side opposite to the connecting portion 20b, respectively, in the air inflow path 21d. The interior of the valve seat forming cylindrical body 21 and the air intake pipe connecting portion 20b communicate with each other through the air inlet openings 21e, 21f to form the air mixing portion 70 within the cylindrical body 21. The arrow m indicates an air inflow direction.

Figure 8:
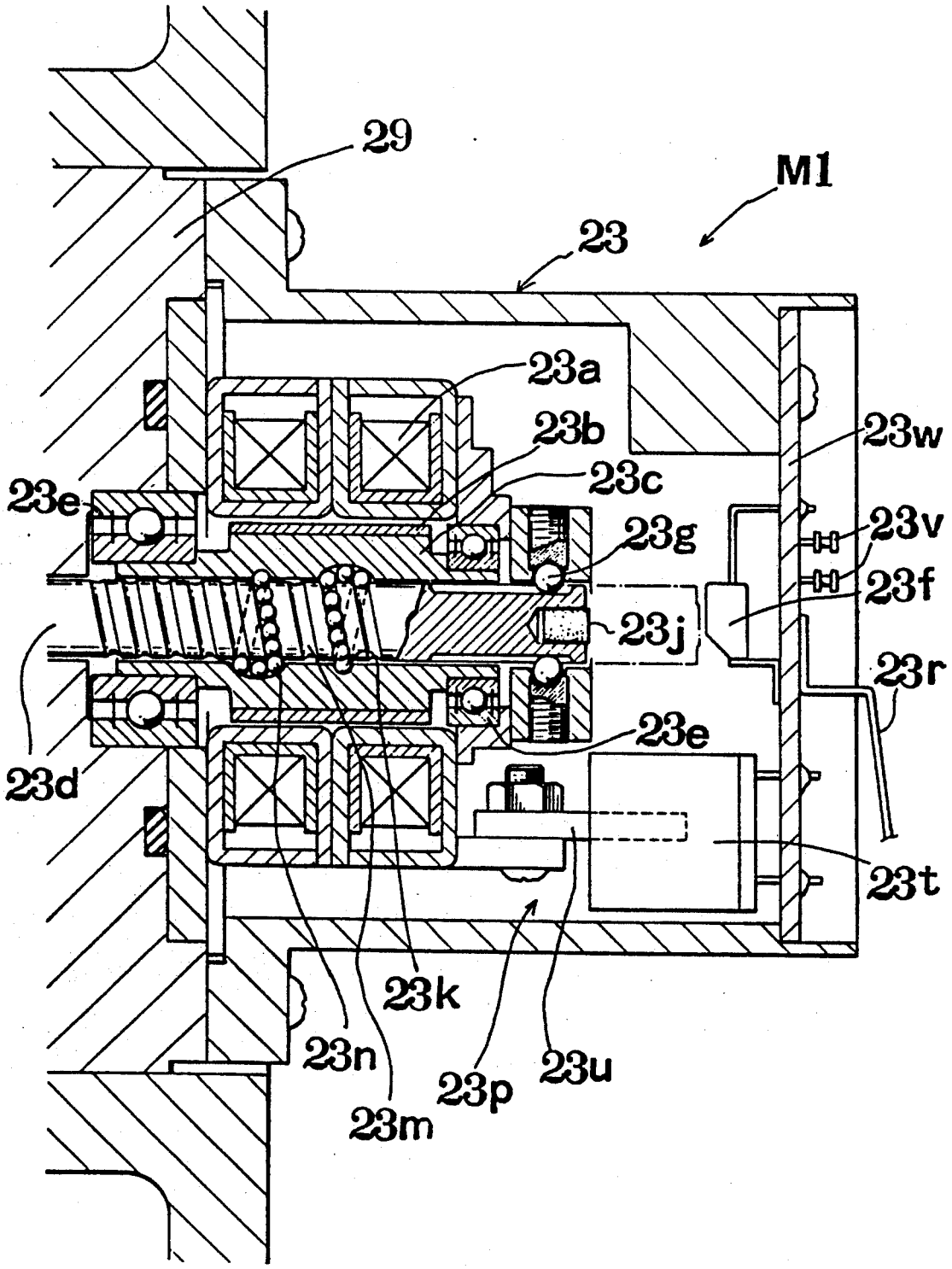
FIG. 8 is an enlarged cross-sectional view of a nozzle valve actuating motor.

According to the construction of the nozzle valve actuating motor M1 shown in FIG. 5 and FIG. 8, a cylindrical motor casing 23 is attached to the rear wall forming plate 29 removably; a cylindrical coil 23a is mounted within the motor casing 23 coaxially with the nozzle casing 20; a cylindrical magnet 23b is disposed inside the coil 23a, which magnet can be rotated forward and reverse by energizing the coil 23a; a cylindrical rotor nut 23c is mounted in the interior of the magnet 23b concentrically and integrally, which rotor nut 23c is journalled rotatably in bearings 23e; and a valve element supporting rod 23d with the blow-off volume adjusting valve element 22 mounted on the front end thereof is extended through the rotor nut 23c so as to be slidable forward and backward axially.

Further, a spiral rotor nut-side ball groove 23k is formed in the inner peripheral surface of the rotor nut 23c, while in the outer peripheral surface of the valve element supporting rod 23d, there is formed a spiral rod-side ball groove 23m in the same direction as the rotor nut-side ball groove 23k, and a plurality of balls 23n are interposed for rolling between the opposed rotor nut-side ball groove 23k and rod-side ball groove 23m. Numeral 23g denotes a rotation preventing member for preventing the valve supporting rod 23d from rotating together with the rotor nut 23c, thus converting the rotating movement of the rotor nut 23c to the reciprocating linear movement of the valve element supporting rod 23d.

On the rear end of the valve element supporting rod 23d, there is mounted a valve operation checking sensor 23f for detecting the normal operation of the nozzle valve actuating motor M1. Namely, if the sensor 23f generates an output signal, this implies that, with the activation of the motor M1, the valve element supporting rod 23d and the valve element 22 are retracted from the reference position (full valve-closed position) so as to open the hot water jet forming path 27. In other words, during the blow-off operation, if the valve operation checking sensor 23f generates no output signal, it implies that the nozzle valve actuating motor M1 is in trouble.

The sensor 23f is composed of a position detecting Hall element 23i and a position detecting magnet 23j attached to the valve supporting rod 23d in a rear end position opposed to the Hall element 23i.

The degree of opening of the hot water jet forming path 27 corresponds to the movement of the valve element supporting rod 23d, which, in turn is proportional to the number of pulses (rotational angle) from the reference position (full valve-closed position of the nozzle valve actuating motor M1). Accordingly, such degree of opening of the hot water jet forming path 27 is accurately and finely adjusted by controlling the nozzle valve actuating motor M1 by the controller C.

As shown in FIG. 5, an electrical connection for the nozzle valve actuating motor M1 substantially comprises an edge connector 23p and 23q, a flexible flat cable 23r and a sheath protected cable 23s.

The edge connector 23p is made of a socket 23t which is connected to the flexible flat cable 23r and a plug 23u of which one end is removably inserted into the socket 23t and the other end connected to the coil 23a of the nozzle valve actuating motor M1.

In the nozzle valve actuating motor M1 of the above construction, the rotor nut 23c is rotated together with the magnet 23b by energizing the coil 23a, and the valve supporting rod 23d is moved forward or backward interlockedly with the rotation of the rotor nut 23c, whereby the blow-off volume adjusting valve element 22 mounted on the front end of the valve supporting rod 23d is moved into contact with or away from the valve seat 21a to adjust the blow-off volume and pressure of hot water into the bathtub body 1.

As to the degree of opening or that of closing of the blow-off volume adjusting valve element 22, the result of detection of the reference position by the valve operation checking sensor 23f is fed to the controller C, which, in turn, controls the energization of the coil 23a to open or close the valve element 22 to an appropriate degree, so that there can be effected a fine adjustment of the volume and pressure of the hot water to be blown off into the bathtub body 1.

The nozzle valve actuating motor M1 is not specially limited if only it can move the blow-off volume adjusting valve element 22 steplessly at a very small distance to make a fine adjustment of the volume and pressure of hot water to be blown off. There may be used a piezoelectric actuator. Numeral 40 denotes a bellows-like waterproof cover formed integrally with the blow-off volume adjusting valve element 22.

The rear wall of the nozzle casing 20 is enlarged so as to form a motor portion 20p which, along with a cover lid 20r, defines a motor portion storing space 20q in which a motor portion of the nozzle valve actuating motor M1 is installed.

Numerals 29a and 29b denote packings provided on the circumferential surface of the rear wall forming plate 29, while numeral 29c denotes a packing provided on the circumferential surface of the valve seat forming cylindrical body 21.

Numeral 23v is a water leakage sensor which is mounted on a printed circuit 23w. Upon detecting the presence of water in the motor portion storing space 20q, the controller C stops the activation of the valve element actuating motor M1.

Due to such construction, accidental leakage of electricity from the nozzle valve actuating motor M1 to the hot water filled in the interior of the bathtub body 1 and, thus, to the bather is prevented.

Furthermore, as shown in FIG. 5, the outside diameter of the motor casing 23 is made smaller than the inside diameter of a rear end opening 20k of the nozzle casing 20.

Due to such construction, the nozzle valve actuating motor M1 can be inserted into the nozzle casing 20 removably from the front end opening of the latter. Namely, the leg-side blow-off nozzle 2 can be disassembled from the interior of the bathtub body 1.

In disassembling operation, the decorative cover 26 is first removed and a nozzle mounting sleeve 1i is removed. Subsequently, the fixing ring 28, the throat fixing member 25, the throat 24 and the valve seat forming cylindrical body 21 are removed. Finally, the nozzle valve actuating motor M1 is removed together with the rear wall 29 while assuring the electrical connection due to the elongated flexible flat cable 23r, thus facilitating the maintenance of the nozzle valve actuating motor M1.

Also, the back- and belly-side blow-off nozzles 3, 4 are of the same construction as that of the blow-off nozzle 2 described above to permit adjustment of the volume and pressure of hot water to be blown off.

Adjustment of the blow-off nozzles 2, 3, 4 can be performed by the operating panel 6 of the wireless remote controller 30 as will be described later.

There are two kinds of use patterns of the six leg-, back and belly-side blow-off nozzles 2, 3, 4 described above. According to one pattern, hot water is blown off from all of the six nozzles 2, 3, 4 at a time, while according to the other pattern, one or two pairs of nozzles are selected and used, as will be later explained with reference to FIG. 36. Each use pattern can be selected by a blow-off nozzle use pattern change-over switch on the operating panel 6 or of the wireless remote controller 30.

The following description is now provided about initializing (adjusting) the nozzle valve actuating motor M1 in the blow-off nozzles 2, 3, 4.

When the power is turned ON (when the plug is inserted):

(1) The nozzle valve actuating motor M1 is driven in a closing direction of the blow-off volume adjusting valve element 22 for 0.5 second at a normal voltage (e.g. 12 V), 50 pps.

(2) The nozzle valve actuating motor M1 is driven in a closing direction of the blow-off volume adjusting valve element 22 for 1.5 second at a low voltage (e.g. 4 V), 200 pps.

Then, with the valve element 22 in a completely closed position, the motor M1 is allowed to step out for a certain time (e.g. 2 seconds) to make initialization.

(3) The nozzle valve actuating motor M1 is driven at a normal voltage (e.g. 12 V), 200 pps, to retract the blow-off volume adjusting valve element 22 by 6 mm from the initialized, completely closed position.

Initialization (adjustment) can be done by operating the nozzle valve actuating motor M1 like the above (1) to (3). The numerical values mentioned above are examples and constitute no limitation.

By such initialization (adjustment) of the nozzle valve actuating motor M1, there are obtained the following effects.

a) By the above operation (1), it is possible to remove oil sticking to the sealing portion and ensure a subsequent smooth operation of the motor M1.

b) By the above operation (2), the blow-off volume adjusting valve element 22 can be brought into abutment with the valve seat 21*a* at a relatively low urging force, so it is possible to prevent damage, etc. of the valve element 22 and the valve seat 21*a*.

c) By the above operation (3), the blow-off volume adjusting valve element 22 is retracted and opened 6 mm from the completely closed position, thereby permitting smooth feed and draining of hot water.

Further, at the time of start of a later-described blow-off operation, the above operations (2) and (3) of the nozzle valve actuating motor M1 are performed, whereby the mild blow-off as an initializing blow-off can be effected smoothly.

Figure 8A:
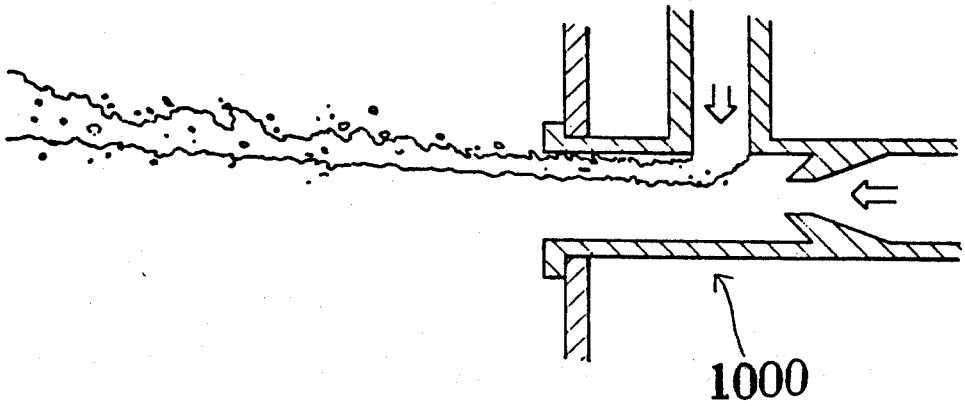
FIG. 8a PRIOR ART
FIG. 8*a* is an explanatory view showing the manner of mixing air into the hot water by a conventional blow-off nozzle.
Figure 8B:
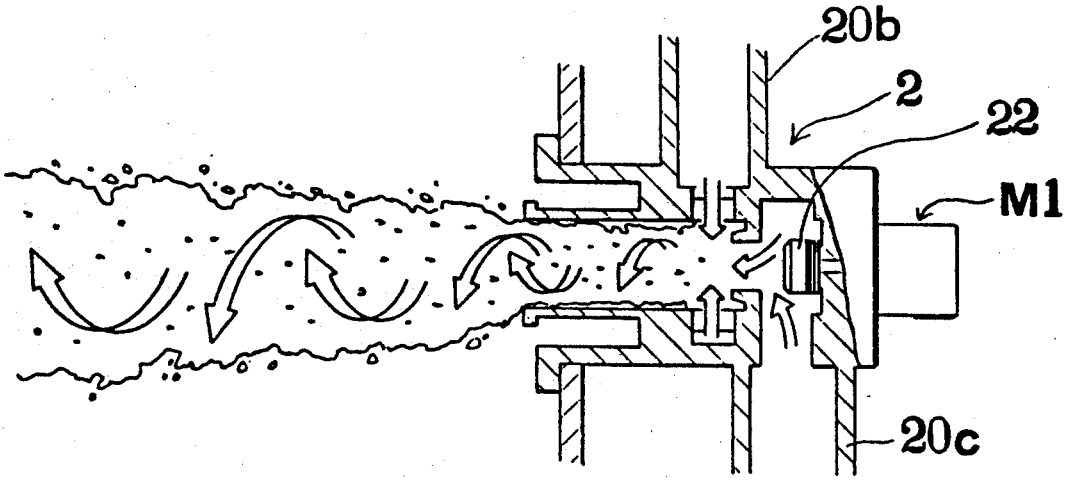
FIG. 8*b* is an explanatory view showing the manner of mixing air into the hot water by the blow-off nozzle of the present invention.

In FIG. 8*a*, the manner of mixing air into the hot-water flow with a conventional blow-off nozzle 1000 is shown. As can be readily understood from the drawing, the air passes through the blow-off nozzle 1000 along the upper inner surface thereof so that the hot water blown off from the blow-off nozzle 1000 contains a small amount of air therein resulting in a poor massaging effect.

According to the blow-off nozzle 2 of the present invention, due to the provision of the hot water jet path 27 and the reciprocating valve element 22, a vigorous hot water jet flow or turbulent hot water flow is produced and the air from the air intake portion 5 is sufficiently mixed into the hot water jet flow whereby the hot water flow blown off from the blow-off nozzle 2 contains a large amount of air therein resulting in an extremely effective massaging effect including stimulating effect and relaxing effect.

(II-2) Description of the Construction of Hot Water Suction Port

The construction of a suction port fitting 350 which is attached to the suction port 1*m* is described hereinafter.

Figure 8C:
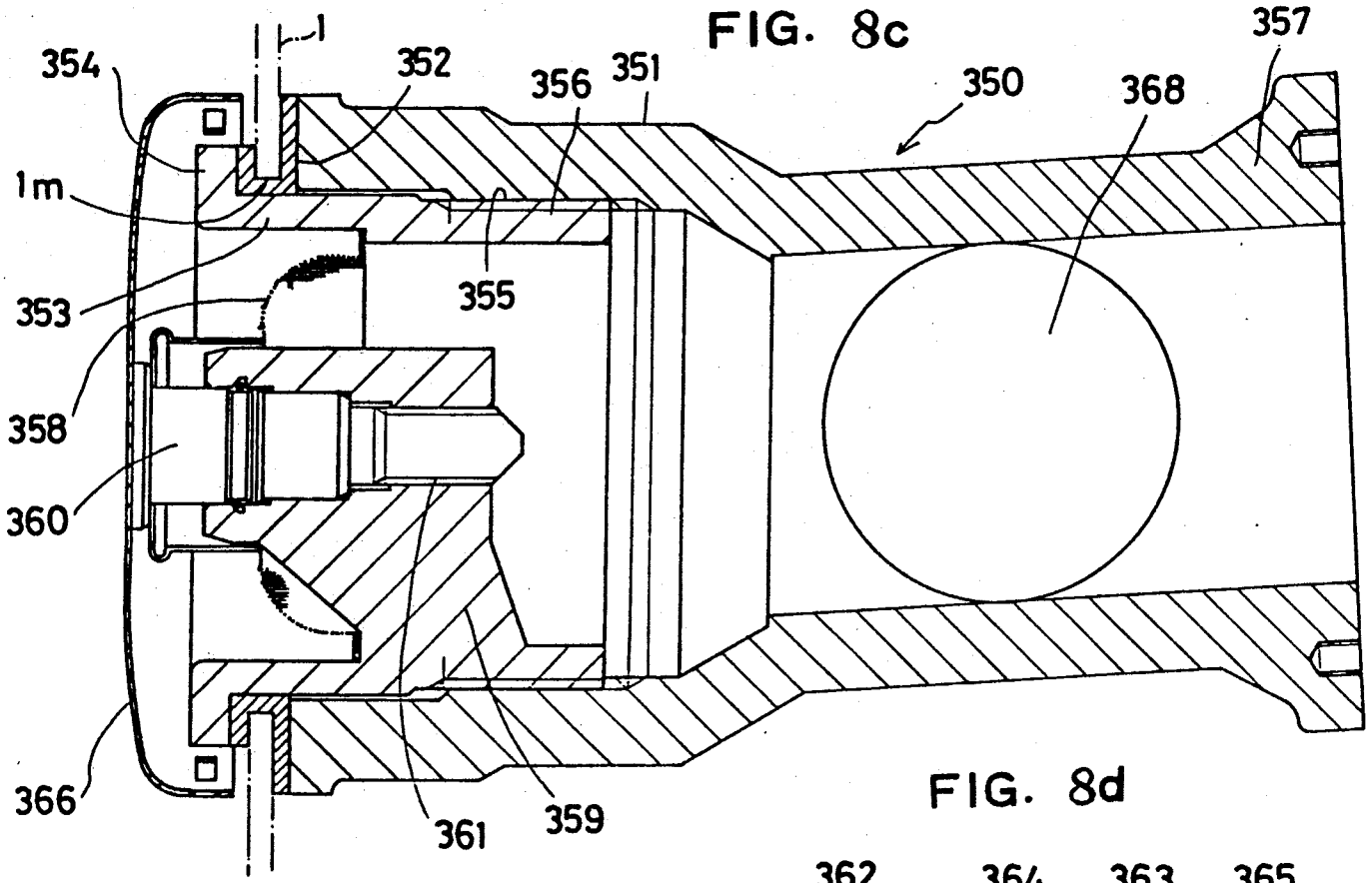
FIG. 8*c* is an enlarged longitudinal cross-sectional view of a hot water suction port fitting of the whirlpool bath.
Figure 8D:
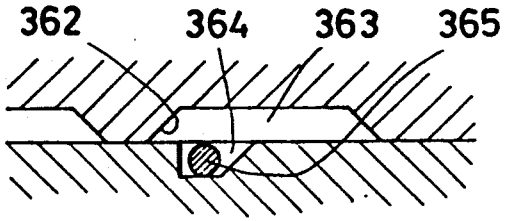
FIG. 8*d* is an enlarged explanatory view of showing the essential part of the hot water suction port fitting.
Figure 8E:
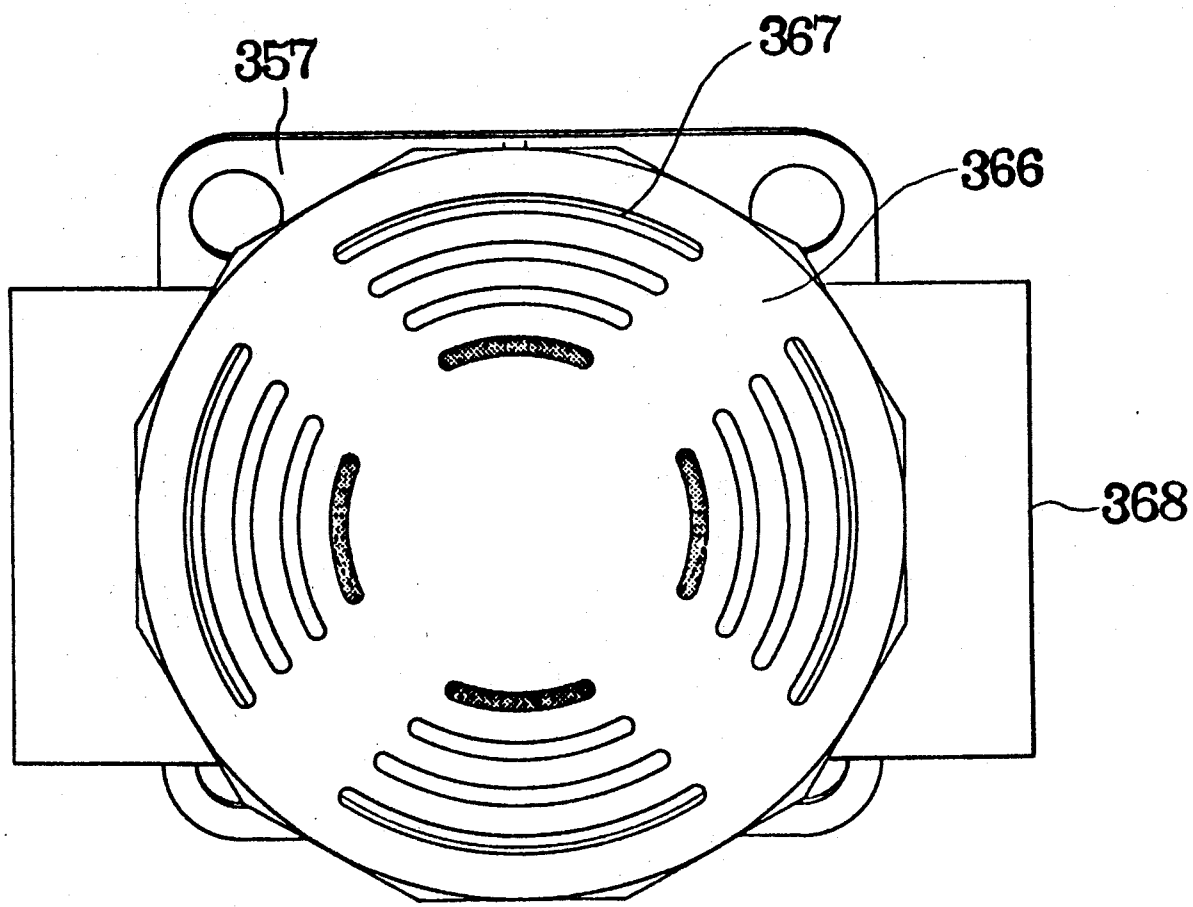
FIG. 8*e* is an enlarged front view of the decorative cover of the hot water suction port fitting.

As shown in FIGS. 8*c*, 8*d* and 8*e*, the front end of a cylindrical sleeve 351 is connected in a watertight manner to the suction port 1*m* of the bathtub body 1 which is circular and opens into a lower part of the side wall of the bathtub body 1, while the rear end thereof is extended backwards substantially horizontally.

Numeral 352 indicates a ring-shaped packing having the outer circumferential portion thereof snugly and water-tightly fitted in the suction port 1*m* along the peripheral edge of the same port 1*m*. Numeral 353 indicates a sleeve mounting collar which has an enlarged flange portion 354 at one end thereof and an outer male threaded portion 355 on the other end thereof. The enlarged flange portion 354 abuts against the front end surface of the ring-shaped packing 352 while the outer male threaded portion 355 is meshed to an inner threaded portion 356 of the cylindrical sleeve 351 so as to fixedly mount the suction port fitting 350 to the side wall of the bathtub body 1 in a cantilever manner.

Numeral 357 indicates a suction-pipe connecting portion of the cylindrical sleeve 351 to which one end of the hot water suction pipe 10 is connected.

In the cylindrical sleeve 351, an annular filter element 358 is provided so as to prevent debris such as human hair from entering into the circulating pump P whereby the occurrence of trouble in the circulating pump P can be effectively prevented.

The filter element 358 is fixedly and stably attached to the inside of the cylindrical sleeve 351 by means of a filter support 359 which has a proximal end fixedly mounted on the inner wall of the cylindrical sleeve 351.

For enabling a quick and firm mounting and replacement of the filter element 358 to the filter support 359, a threaded shaft 360 is threaded into a female threaded hole 361 formed in the filter support 359 and an annular protrusion 362 and an annular groove 363 are formed on an intermediate portion of the outer surface of the filter support 359 while an annular groove 364 is formed in the inner surface of the filter support 359 at a position correspondent to the groove 363 and an O-ring 365 is accommodated in a space defined by two grooves 363 and 364.

Furthermore, the suction port fitting 350 is also provided with a decorative cover 366 and such cover 366 has the central portion thereof connected to the head surface of the threaded shaft 360.

As shown in FIG. 8*e*, such decorative cover 366 is provided with a plurality of arcuate openings 367 for preventing debris of considerable size from entering into the hot water circulation path D.

Numeral 368 indicates a pair of auxiliary suction-pipe connecting portions of the cylindrical sleeve 351 which are usually closed by plugs or lids and opened in case the hot water suction pipe 10 must be led to the hot water suction port 1m from a different direction.

(II-3) Description of the Construction of Air Intake Portion

The construction of the air intake portion 5 will be described below.

As shown in FIGS. 9, 9a and 9b, the air intake portion 5 is mounted on the marginal flange-like portion 1a of the bathtub body 1.

The intake portion 5 is composed of a rectangular box-shaped air intake body 92 having an open top and containing a plurality of silencers 92a, 92b in two rows; a cover 82 having an air intake port 82a formed outside and covering the top opening of the air intake body 92; a plurality of air intake pipe connecting portions 83a, 83b, 83c having upper ends thereof connected to the silencers 92b and lower ends connected to the air suction pipes 12a, 12b, 12c; and a plurality of air volume adjusting valves 87a, 87b, 87c disposed in communication paths which bridge between the silencers 92b and the air intake pipe connecting portions 83a, 83b, 83c to open and close the above communication paths.

Due to such construction, a finely regulated amount of air can be fed to the blow-off nozzles 2, 3, 4 through the air suction pipes 12a, 12b and 12c.

Each air volume adjusting valve 87a, 87b, 87c is composed of a cylindrical valve body 88 having an upper edge which defines an opening 88a; an air volume adjusting valve actuating motor M2 mounted to the bottom of the cylindrical valve body 88; a valve element supporting rod 89 connected to the motor M2; and a valve element 90 mounted to the front end of the rod 89 and capable of moving into and out of contact with a valve seat 88b formed at the upper edge of the valve body 88. Numeral 88d denotes a communication opening formed in the peripheral wall of the valve body 88.

The air volume adjusting valve actuating motor M2 is of a linear stepping motor structure which is the same as the structure of the nozzle valve actuating motor M1, and it can be controlled by the controller C as will be described later.

In this embodiment, however, there is not performed an adjustment of the air volume through the valve element 90 by driving the motor M2 during the blow operation, but there is performed the blow-off operation with a preset air volume.

Numerals 93a, 93b denote a pair of upper and lower silencer supporting plates disposed horizontally in two rows within the air intake body 92 to support the silencers 92a, 92b. A plurality of communication holes 94a, 94b which are formed in silencers 92a, 92b of the upper row are respectively aligned with a plurality of communication holes 94a, 94b which are formed in silencers 92a, 92b of the lower row. The arrow r indicates an air inflow direction.

Furthermore, as can be understood from FIGS. 9, 9a and 9b, the operating panel 6 is incorporated into the cover 82 and when a panel cover 6a is opened, a panel switching surface 6b is readily accessible thus facilitating the blow-off operation together with a remote controller 30 which will be described later in detail.

(II-4) Description of Functional Unit

The construction of the functional unit 9 is hereinafter explained in view of FIG. 10, FIG. 11 and FIG. 12.

The functional unit 9 includes a rectangular box-shaped casing 60 which is made of an upper plate 60a, a bottom frame 60b, a pair of side plates 60c, 60d, a front plate 60e and a rear plate 60f.

In the inner space defined within the functional unit 9, a virtually horizontal shelf 61 made of three frame members 61a, 61b and 61c bridges between the side plates 60c, 60d defining an upper storing space 62 and a lower storing space 63.

In the upper space 62, a plurality of electric devices are disposed while, in the lower space 63, a plurality of substantially non-electric devices are disposed.

Namely, a leakage breaker 64 and an insulating transformer 65 are mounted on the frame member 61a, a power source transformer 66 and a noise filter 67 are mounted on the frame member 61b and the control unit C and an inverter E are mounted on the frame member 61c.

On the bottom frame 60b, the circulating pump P provided with a cold-proofing heater and the filter 43 for cleaning hot water are mounted on the bottom frame 60b.

Due to such construction, electrical insulation between the electric devices and non-electric devices is reliably achieved whereby leakage of electricity from electric devices to the hot water in the bathtub body 1 by way of non-electric devices is completely prevented, assuring the complete safety of the bather.

Referring to the other construction in the functional unit 9, a plurality of rubber connections 68 are provided at junctions of various pipings in the function unit 9.

For providing ventilation of the functional unit 9, air vents 69 are provided on both side plates 60c, 60d of the casing 60.

(II-5) Description of Circulating Pump

The construction of the circulating pump P will be described below.

Figure 13:
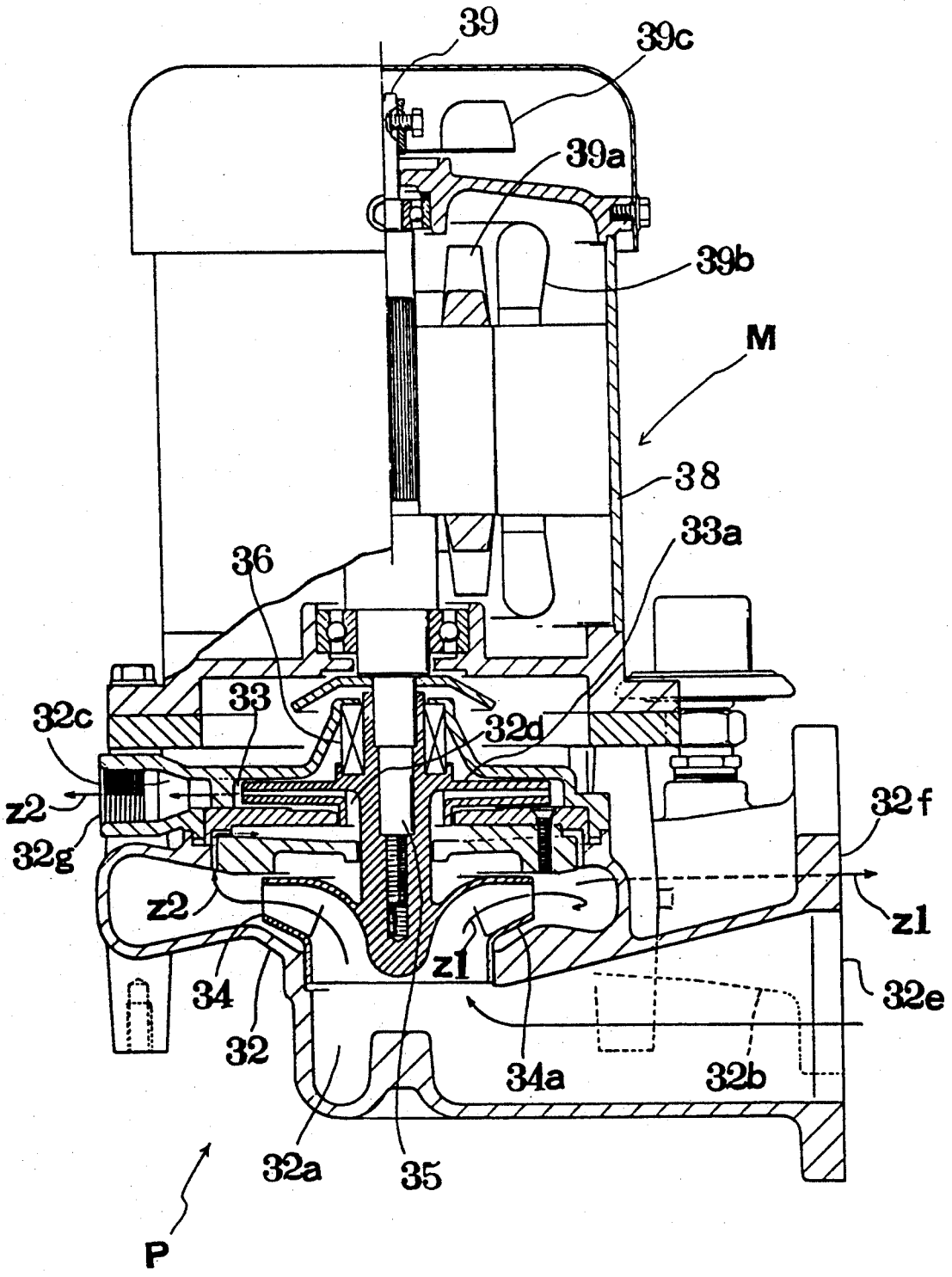
FIG. 13 is a partially cut-away elevational view of the circulating pump provided with a pump-operating motor.

The circulating pump P has such a construction as shown in FIG. 13. An upper impeller chamber 33 and a lower impeller chamber 34 communicate with each other through a communication path 32d in a pump casing 32. The lower impeller chamber 34 is in communication with the hot water suction pipe 10 through a hot water suction path 32a formed on one side of the lower portion of the pump casing 32, also with the hot water forced-feed pipe 11 through a hot water forced-feed path 32b formed on the other side of the lower portion of the pump casing 32, and further with one end of an incoming pipe 41 of the filter 43, which will be described later, through a filtering forced-feed path 32c formed on one side of the upper impeller chamber 33. Numeral 32e denotes a suction port; numeral 32f a lower discharge port; numeral 32g an upper discharge port; z1 indicates a circulation flow direction; and z2 indicates a filtration flow direction.

An impeller shaft 35 extends vertically through the centers of the upper and lower impeller chambers 33, 34, and upper and lower impellers 33a, 34a are mounted on the impeller shaft 35 coaxially within the upper and lower impeller chambers 33, 34, respectively. The impeller shaft 35 is interlocked with a drive shaft 39 of the pump driving motor M which is mounted on the pump casing 32 integrally in a watertight manner. Numeral 36 denotes a sealing member which ensures watertightness of the interior of the pump casing 32.

Figure 13A:
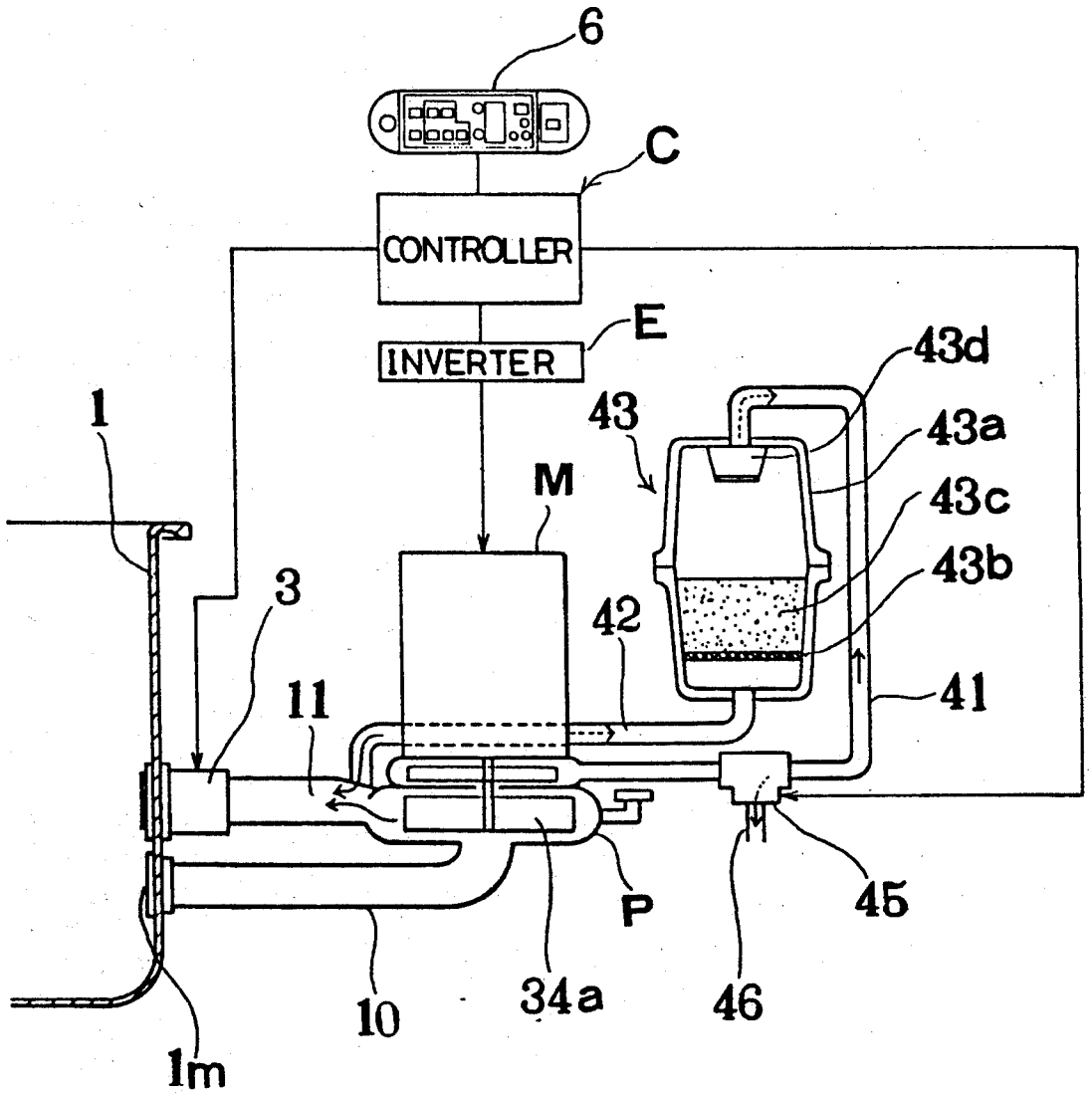
FIG. 13*a* is a schematic view including piping, motor, pump, controls, the bathtub body and a filter used for cleaning hot water and which itself is cleaned.

To the upper impeller chamber 33 of the circulating pump P is connected filter 43 through the incoming pipe 41 and a return pipe 42, as shown in FIG. 13a. A portion of the hot water which has been sucked into the lower impeller chamber 34 is fed to the filter 43 through the incoming pipe 41 connected to the upper discharge port 32g of the upper impeller chamber 33, then the hot water filtered by the filter 43 is fed to the hot water forced-feed pipe 11 through the return pipe 42 and merged with the hot water being fed forcibly into the pipe 11 from the lower discharge port 32f of the lower impeller chamber 34.

Under the above construction, upon rotation of the upper impeller 33a, the hot water in the bathtub body 1 is sucked into the hot water suction path 32a of the lower impeller chamber 34 through the suction port 32e from the hot water suction pipe 10, then fed forcibly from the lower impeller chamber 34 to the lower discharge port 33a through the hot water forced-feed path 32b and further into the bathtub body 1 through the hot water forced-feed pipe 11.

In this case, a portion of hot water which entered the lower impeller chamber 34 passes through the communication path 32d and enters the upper impeller chamber 33, then passes through the filtering forced-feed path 32c, further through the incoming pipe 41 from the upper discharge port 33a, and is fed to the filter 43. The hot water thereby filtered is fed into the hot water forced-feed pipe 11 through the return pipe 42.

Thus, the hot water which is circulated through the hot water circulation path by means of the circulating pump P having upper and lower impellers 33a, 34a is partially filtered by the filter 43.

On the outer periphery of the circulating pump P there is provided a heater H1 (FIG. 3) for freeze proofing the pump. The heater H1 is controlled by the controller C in accordance with the result of detection of the temperature of the hot water in the hot water forced-feed pipe 11 by the hot water temperature sensor T, whereby the freezing of the hot water in the circulating pump P can be prevented.

The pump driving motor M is a three-phase induction type provided with a fan for cooling the motor M. Numeral 39a denotes a rotor mounted on the outer peripheral surface of the drive shaft 39 of the pump driving motor M; numeral 39b denotes a fixed magnetic pole attached to the inner peripheral surface of a motor casing 38 in an inside-outside opposed state with respect to the rotor 39a; and numeral 39c denotes a cooling fan.

The inverter E, which is disposed between the pump driving motor M and an output interface 52 (FIG. 3), performs a conversion processing for the input frequency fed from a commercial AC supply, in accordance with a program stored in a memory 53 of the controller C as will be described later. More specifically, the inverter E converts the power from an AC 100 V power supply into a three-phase 200 V power and outputs the latter.

Then, the rate of revolution of the pump driving motor M is controlled in proportion to the output frequency which has gone through the conversion processing in the inverter E to thereby control the rate of revolution of the circulating pump P, thereby permitting the volume and pressure of the hot water from the blow-off nozzles 2, 3, 4 to be changed in accordance with the aforementioned program.

In this way the rate of revolution of the circulating pump P can be controlled smoothly and certainly by the inverter E. As a result, the following effects are obtained.

(1) By suitably combining the change in the rate of revolution of the circulating pump P made by the inverter E with the opening and closing operations of the blow-off nozzles 2, 3, 4 it is made possible to change the blow-off mode variously according to likings of bathing persons and thus it is possible to satisfy various likings of bathing persons.

(2) The blow strength can be changed in several steps or steplessly according to likings of bathing persons by changing the rate of revolution of the circulating pump P with the inverter E, so it is possible to give a feeling of ample satisfaction to bathing persons.

(3) Since the change in the rate of revolution of the circulating pump P can be done smoothly by the inverter E together with the opening or closing operation of the blow-off nozzles 2, 3, 4, it is possible to effect the change from one blow-off mode to another and further the change of the blow strength in various blow-off modes smoothly and slowly without giving any uncomfortable feeling to the person taking a bath.

(4) Since the circulating pump P can be given a slow initial rotation by the inverter E, it is possible to prevent the occurrence of an accident such as falling down of the bathing person, particularly a child or an old person due to sudden blow-off of hot water.

(5) Since the circulating pump P can be given a slow initial rotation by the inverter E, it is possible to prevent the inconvenience that the pump P takes in air and races, so a smooth blow-off of hot air can be ensured by the pump P.

(6) Since the circulating pump P can be given a slow initial rotation by the inverter E, it is possible to reduce the discharge sound of air in pipes and so the reduction of noise can be attained.

(7) When the change of blow-off strength or the change of blow-off mode is performed by changing the blow-off volume and pressure as in this embodiment, waste of electric power can be avoided and so power saving can be attained.

(8) Since the circulating pump P can be reverse-rotated by the inverter E, it is possible to remove foreign matter such as rust from pipes.

(II-6) Description of Filter

The construction of the filter will be described below.

As shown in FIG. 13a, the filter 43 is composed of a filter body 43a, an acrylic mesh 43b stretched across a lower portion of the filter body 43a, a filter medium 43c provided on the mesh 43b, and a baffle 43d attached to the inner surface of the upper wall of the filter body 43a.

One end of the incoming pipe 41 is connected to the upper end of the filter body 43a, while one end of the return pipe 42 is connected to the lower end of the filter body 43a, and hot water is allowed to pass from above the filter body 43a downwards through the filter medium 43c, whereby the hot water is filtered.

A filter heater H2 (FIG. 3) for freeze proofing is mounted on the outer periphery of the filter 43 and it is controlled by the controller C according to the result of detection of the temperature of the hot water in the hot water forced-feed pipe 11 by the hot water temperature sensor T, whereby the freezing of the hot water in the filter 43 can be prevented.

Further, at an intermediate location in the incoming pipe 41, there is provided the motor-driven three-way valve 45, and a drain pipe 46 is connected to one end of the three-way valve 45, so that the incoming pipe 41 and the drain pipe 46 can be brought into communication with each other through the three-way valve 45.

By changing over the motor-driven three-way valve 45 to make communication between the incoming pipe 41 and the drain pipe 46 and rotating the upper and lower impellers 33*a*, 34*a* of the circulating pump P, a portion of hot water is passed through the return pipe 42 and then passed from the lower portion of the filter body 43*a* upwards through the filter medium 43*c*, thereby effecting washing of the filter medium 43*c*.

The change-over operation of the motor-driven three-way valve 45 can be done by the remote controller 30 which will be described later.

(II-7) Description of Controller

The construction of the controller C will be described below.

As shown in FIG. 3, the controller C is composed of a microprocessor MPU, input/output interfaces 51, 52, a memory 53 comprising ROM and RAM, and a timer 54.

In the above construction, to the input interface 51, there are connected the valve operation checking sensor 23*f* for detecting the degree of opening and that of closing of the blow-off volume adjusting valve 22; a valve opening checking sensor 91 for checking the opening of the air volume adjusting valve 87*a*, 87*b*, 87*c*; the pressure sensor 48 for detecting the water pressure in the hot water forced-feed pipe 11; the hot water temperature sensor T for detecting the temperature of hot water in the bathtub body 1; the operating panel 6; and the infrared ray sensor 30*b* for sensing a drive signal using infrared rays provided from the remote controller 30.

On the other hand, to the output interface 52, there are connected later-described clock display portion 115 and hot water temperature indicating portion on the operating panel 6, the pump driving motor M, the nozzle valve actuating motor M1, the air volume adjusting valve actuating motor M2, the pump heater H1, the filter heater H2 and the motor-driven three-way valve 45. The pump driving motor M is connected to the output interface 52 through the inverter E.

In the memory 53, there is stored a drive sequence program for operating drive portions such as the motors M, M1, M2 and the motor-driven three-way valve 45 in accordance with output signals from the above sensors and drive signals from the operating panel 6 or from the remote controller 30.

(II-8) Description of Operating Panel

The following description is now provided with reference to FIG. 9, FIG. 9*a* and FIG. 9*b* about the operating panel 6 which is for manually transmitting driving outputs to the controller C.

The operating panel 6 is, as previously described, incorporated in the cover 82 of the air intake portion 5.

As readily understood from FIG. 9*b*, the operating panel 6 is provided with an operation switch 100, blow operation switches such as a mild blow-off switch 101, a spot (which may also be called "finger-pressure") blow-off switch 102, a pulse blow-off switch 103, a wave blow-off switch 104, a cycle blow-off switch 105 and a program ("random") blow-off switch 106, hot water blow-off strength increasing and decreasing switches 107, 108, blow-off nozzle use pattern change-over switches such as a back-side blow-off nozzle use pattern switch 111, a leg-side blow-off nozzle use pattern switch 112 and a belly-side blow-off nozzle use pattern switch 113, a timer switch 114, a clock display portion 115 which also serves as a timer display portion, a hot water temperature indicating portion, a filter washing switch 117, a time setting switch 118 for making correction of the time displayed on the clock display portion 115, an hour setting switch 119, and a minute setting switch 120.

The later-described blow-off operation can be started by turning ON the operation switch 100.

Numeral 100*a* denotes a pilot lamp which goes on upon turning ON of the operation switch 100; numerals 101*a*, 102*a*, 103*a*, 104*a*, 105*a* and 106*a* denote blow-off operation switch indication lamps; numerals 109*a*, 109*b*, 109*c*, 109*d* and 109*e* denote strength level indication lamps; numerals 111*a*, 112*a* and 113*a* denote leg-, back- and belly-side indication lamps, respectively; numerals 121, 122 and 123 denote lamps which indicate selection patterns A, B and C in later-described pulse blow-off, wave blow-off, cycle blow-off and program blow-off; and numeral 117*a* denotes a filter washing indication lamp; and a filter operation indication lamp is also provided.

The operating panel 6 is further provided with the infrared ray sensor 30*b* at one side end portion thereof as shown in FIG. 9*b*.

When any of the switches provided on the remote controller 30 which will be described later is operated, an infrared ray of a predetermined wave length corresponding to the operated switch is emitted from an infrared ray radiating portion 30*a* provided in the remote controller 30 in accordance with a preset multi-frequency tone modulation system (MFTM). The infrared ray thus emitted is detected by the infrared ray sensor 30*b* and the detected signal is fed to the input interface 51 of the control unit C, whereby a desired drive unit is operated in accordance with a drive program read out from the memory 53.

To the upper surface of the operating panel 6, as described before, is attached the cover 6*a* which can be opened and closed and which covers the switches and indication lamps other than the timer switch 114, clock display portion 115, hot water temperature indicating portion, filter operation indicating lamp and infrared ray sensor 30*b*.

Further, the infrared ray sensor 30*b* may be disposed at a place where it is easy for the sensor to sense infrared rays other than on the operating panel 6.

(II-9) Description of Remote Controller

The following description is now provided about the remote controller 30 which enables the user, for example while bathing, to manually transmit driving outputs to the controller C without using the operating panel 6.

As shown in FIG. 14, FIG. 15 and FIG. 15*a* to FIG. 15*d*, the remote controller 30 is constructed as follows. A partition wall 235 is provided within a vertically long, rectangular box-like case 231 to define in an isolated manner a substrate receiving chamber 236 for receiving therein a substrate 241 in the form of a printed circuit board and a battery receiving chamber 237 for receiving therein a battery B in an energized state.

In the upper end portion within the substrate receiving chamber 236 there is provided an infrared ray emitting portion 245 which is connected with the substrate 241, and in the upper portion of the interior of the substrate receiving chamber 236 there is provided a blow-off state display portion 233 which is connected to the substrate 241.

Further, various operating switches 234 of a membrane switch type are mounted on the lower-half surface portion of the case 231 so that they are connected to the substrate 241. The whole of the remote controller 30 is watertight.

The case 231 is formed using an acrylonitrile-butadiene-styrene (ABS) resin to ensure rigidity, strength, impact resistance and watertightness. Numeral 233*a* denotes a viewing window plate made of an acrylic resin which is transparent so that the blow-off state display portion 233 can be seen from the exterior.

Figure 15:
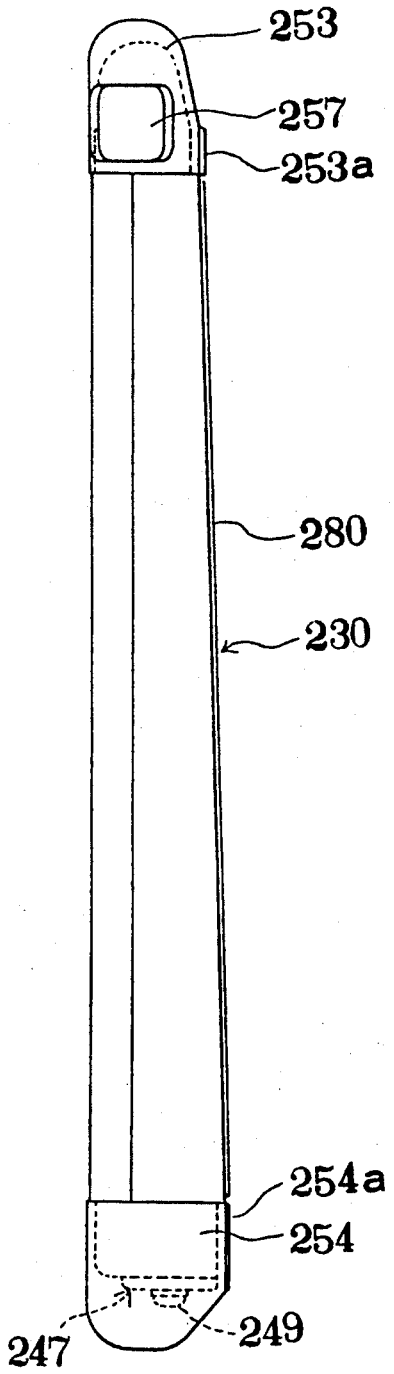
FIG. 15 is a side view of the remote controller.
Figure 15A:
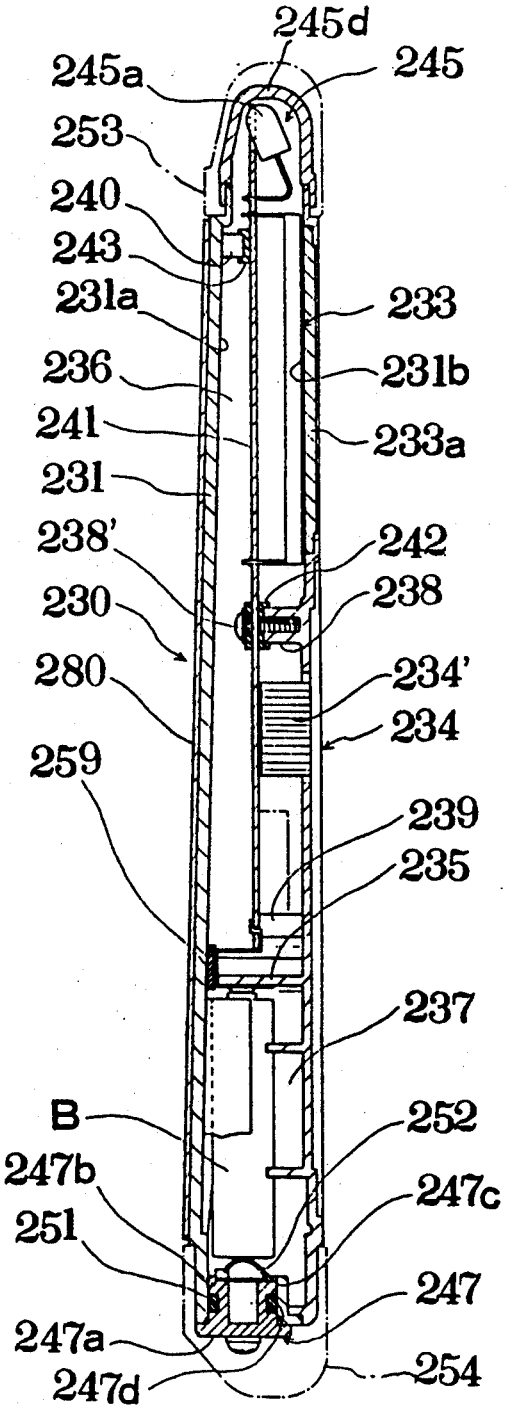
FIG. 15*a* is a longitudinal cross-sectional view of the remote controller.
Figure 15B:
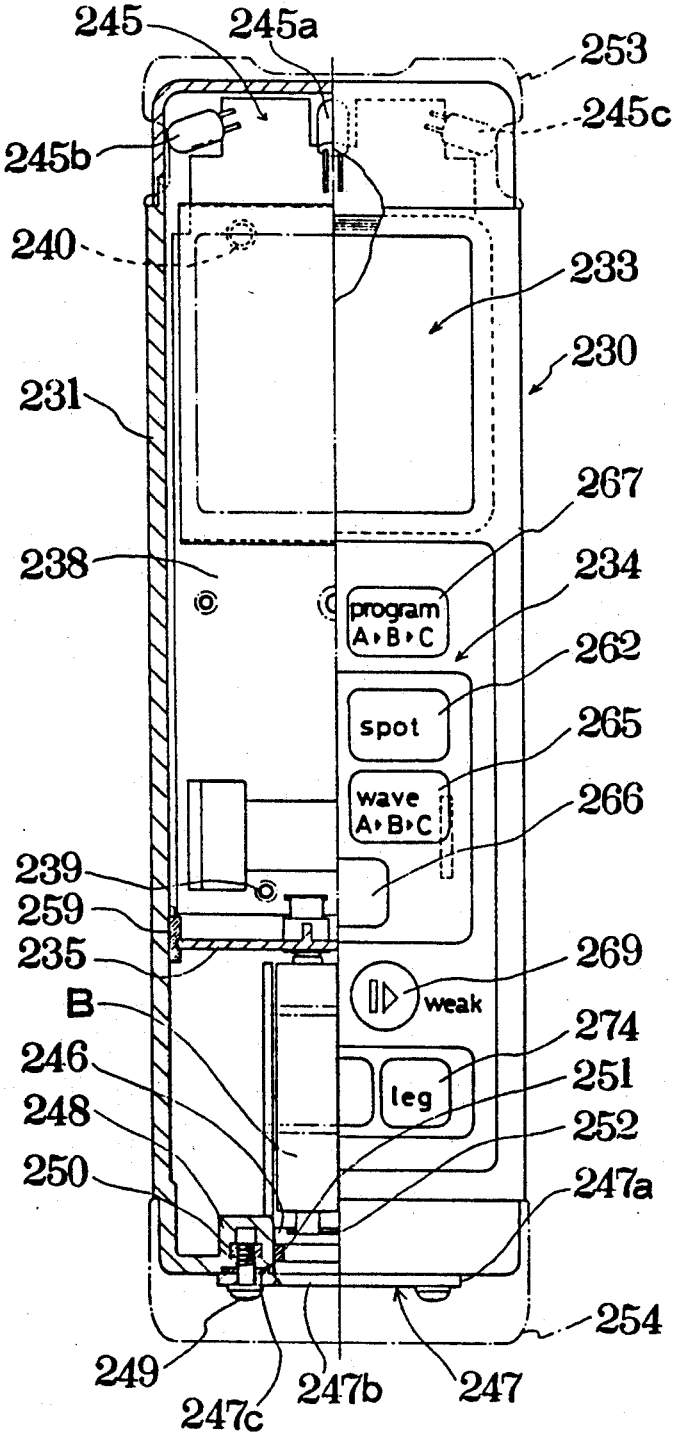
FIG. 15*b* is a partially cut-away plan view of the remote controller showing the inner construction thereof.

Since the operating switches 234 are membrane switches, the remote controller 30 can be made thin, light in weight and compact, the switches can be arranged freely, and sealing is ensured. Those switches are each connected to the substrate 241 through a flexible cable 234' as shown in FIG. 15*a*.

Regarding the operating switches 234, numeral 260 denotes an operation switch; numeral 261 denotes a mild blow-off switch; numeral 262 denotes a spot blow-off switch; numeral 263 denotes a pulse blow-off switch; numeral 265 denotes a wave blow-off switch; numeral 266 denotes a cycle blow-off switch; numeral 267 denotes a program blow-off switch; numerals 268 and 269 denote hot water blow-off strength increasing and decreasing switches, respectively; and numerals 274, 275 and 276 denote leg-, back- and belly-side blow-off nozzle use pattern switches, respectively.

In the blow-off state display portion 233, numeral 431 denotes a blow-off mode character indicating portion; numeral 432 denotes a wave blow-off indicating portion; numeral 433 denotes a blow-off position indicating portion; and numeral 434 denotes a strength level indicating portion. The indicating portions 431, 432, 433 and 434 each operate using liquid crystal.

The partition wall 235 is provided at a position approximately one-third from the lower end in the case 231 to form the substrate receiving chamber 236 and the battery receiving chamber 237 at the upper and lower sides thereof, respectively, within the case 231. The chambers 236 and 237 are isolated from each other while ensuring watertightness by means of a packing 259 provided along the side edges of the partition wall 235.

The substrate receiving chamber 236 and the battery receiving chamber 237 can be isolated from each other while ensuring watertightness by positively bonding the side edges of the partition wall 235 to the inner surface of the case 231 using an adhesive.

The entire interior of the substrate receiving chamber 236 may be subjected to potting, that is, filled with a thermosetting resin, to impart impact and vibration resistance thereto and to provide protection from moisture and avoid consequent corrosion.

By potting using an expandable polyurethane resin it is possible to protect the interior of the remote controller 30 while reducing the weight thereof as compared with the use of conventional thermosetting potting resins and thereby render the remote controller 30 buoyant and floatable on the hot water surface.

Further, by partially supporting the substrate 241 with an expanded polyurethane resin it is possible to protect the substrate 241 without the provision of any special substrate supporting member.

In this way, even in the event the remote controller 30 should be dropped into the bath at the time of battery change, it is possible to prevent the hot water which has entered the batter receiving chamber 237 from entering the substrate receiving chamber 236. Also in the event of leakage of the battery fluid, it is possible to prevent the liquid from entering the substrate receiving chamber 236.

Within the substrate receiving chamber 236 the substrate 241 connected to the blow-off state display portion 233 and the operating switches 234 is supported in a suspended state by means of first and second projecting support pieces 238, 239 which are projecting from a central part of a surface wall 231*a* of the case 231 toward a rear wall 231*b* thereof and a third projecting support piece 240 projecting from an upper part of the rear wall 231*b* toward the surface wall 231*a*. Between the projecting support pieces 238, 240 and the substrate 241 there are disposed first and second packings 242, 243 as shock absorbing members. The packings may be substituted by rubber springs, etc. Numeral 238' denotes a fixing bolt.

Further, an infrared ray emitting portion 245 for emitting infrared rays toward the infrared ray sensing portion 30*b* on the operating panel 6 is provided in the inner upper portion of the substrate receiving chamber 236.

The infrared ray emitting portion 245 comprises a case 245*d* formed of an acrylic which permits infrared rays to pass therethrough and a total of three light emitting diodes 245*a*, 245*b*, 245*c* as infrared ray emitters provided in central and left and right positions within the case 245*d*. The central light emitting diode 245*a* can emit infrared rays forwards, while the left and right light emitting diodes 245*b*, 245*c* can emit infrared rays downward left- and rightwards, respectively.

Further, from the infrared ray emitting portion 245 there are emitted predetermined code signals corresponding to the operating switches 234 o the basis of a preset serial code emitting signal.

The infrared ray thus emitted is detected by the infrared ray sensing portion 30*b*, then the detected signal is fed to the input interface 51 of the controller C, and a desired driving unit is operated in accordance with a driving program read out from the memory 53.

Within the battery receiving chamber 237, there can be received a battery B which serves as a power source, and a lid 247 for opening and closing is mounted in a battery opening 246 formed in the underside of the case 231. By opening and closing the lid 247, the battery B can be loaded and unloaded with respect to the battery receiving chamber 237.

The lid 247 is composed of a connection plate 247*a* of a large width capable of closing the battery opening 246 and a fitting projection 247*b* projecting from the inner surface of the connection plate 247*a* and which is to be fitted in the battery opening 246.

The connection plate 247*a* is mounted removably with small bolts 249 to the underside of a lid receptacle 248 which defines the battery opening 246. Numeral 250 denotes a nut provided in the lid receptacle 248.

The fitting projection 247*b* is fitted in the battery opening so that a peripheral surface 247*c* thereof comes into contact with the inner peripheral surface of the lid receptacle 248. An O-ring mounting groove 247*d* is formed centrally in the peripheral surface 247*c*, and an O-ring 251 is mounted therein. Further, a current conducting plate 252 which turns conductive upon contact with the end face of the battery B is attached to the end face of the fitting projection 247*b*.

Under the above construction, by inserting the fitting projection 247*b* of the lid 247 into the lid receptacle 248 and mounting the connection plate 247*a* onto the lid receptacle 248, the current conducting plate 252 attached to the end face of the fitting projection 247*b* comes into contact with the end face of the battery B and can be turned conductive thereby.

In this case, waterproofness of the interior of the battery receiving chamber 237 is ensured by the O-ring mounted to the peripheral surface of the fitting projection 247*b*.

Further, the upper and lower portions of the remote controller 30 constructed as above are provided with upper and lower protectors 253, 254, respectively, as shown in FIGS. 14, 15, 15*a*, 15*b* and 15*c* to prevent the remote controller 30 itself, the bathtub body 1, the bathroom tile, etc. from being damaged by dropping of the remote controller 30.

More specifically, the upper protector 253 is formed in the shape of a cap capable of being fitted on the upper portion of the remote controller 30 to cover the upper portion and it is provided with infrared ray passing openings 255, 256 and 257 in positions corresponding to the central portion and right and left infrared ray emitting windows. Numeral 253*a* denotes a wall surface abutting portion.

The lower protection 254 is formed in the shape of a cap capable of being fitted on the lower portion of the remote controller 30 to cover the lower portion. Numeral 254*a* denotes a wall surface abutting portion.

As the material of the protectors 253 and 254 there is used one having a shock absorbing function. For example, there may be used an elastic rubber such as nitrile butadiene rubber (NBR), an expanded polyurethane or an ethylene-propylene trimer (EPDM). Where a material of a small specific gravity such as an expanded polyurethane is used, it is possible to float the remote controller 30 on the hot water surface by adjusting the specific gravity of the same controller.

In this embodiment, moreover, as shown in FIGS. 15, 15*a*, 15*c* and 15*d*, a magnet 280 is provided on the back of the remote controller 30, while a magnetic material 280' is provided on a side wall of the bathtub body 1 or the bathroom side wall W, so that the remote controller can be attached removably to the bathroom side wall W by virtue of magnetism.

The magnet 280, which is in the form of a thin rectangular plate, is provided throughout the entire surface of the back of the remote controller 30 except the upper and lower portions of the controller covered with the upper and lower protectors 253, 254. Thus it is provided to enlarge the area of contact thereof with the magnetic material 280' provided on the bathroom side wall W for example.

The magnetic force of the magnet 280 can be set to a suitable magnitude so that the remote controller 30 can be mounted positively and detached easily.

Figure 15C:
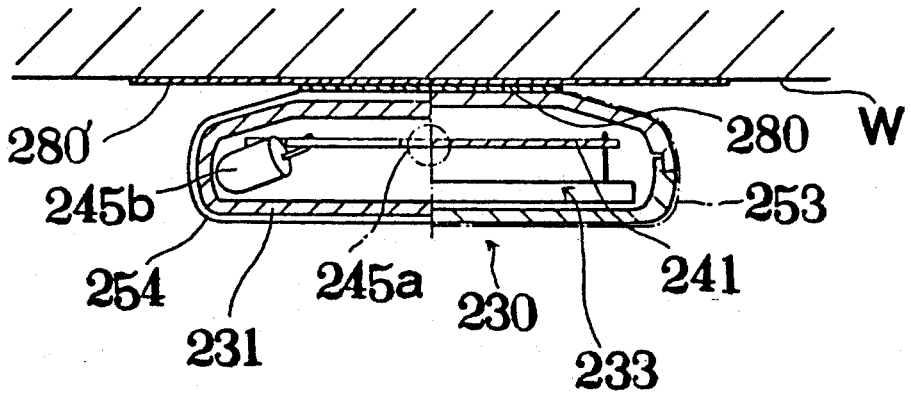
FIG. 15*c* is a transverse cross-sectional side view of the above remote controller.
Figure 15D:
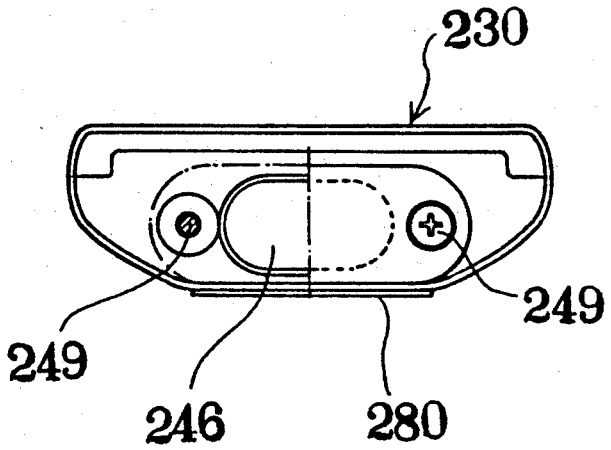
FIG. 15*d* is a rear-side view of the above remote controller showing the battery storage portions.

On the other hand, on the side wall of the bathtub body 1 or the bathroom side wall W there is provided the magnetic material 280' which is in the form of a thin plate, as shown in FIG. 15*c*. The magnetic material 280' is provided either on the bathroom side wall W either in the form of segments or formed as a wide integral piece to cover a wide area.

The bathtub body 1 may be formed using the magnetic material 280' to increase the degree of freedom for the mounting and storage of the remote controller 30.

Thus, by increasing the degree of freedom for the mounting and storage of the remote controller 30, the user can attach the remote controller to a place permitting easy mounting and removal and so it is made possible to use the remote controller in a more convenient manner.

Contrary to the above, the magnetic material 280' may be provided on the remote controller 30, while the magnet 280 may be provided on the bathroom side wall W.

In this embodiment, moreover, since the upper and lower protectors 253, 254 are mounted on the remote controller 30, the magnet 280 or the magnetic material 280' as a mounting means may be provided on those protectors.

The mounting means is not limited to the magnet 280. There may be used any mounting means if only it can attach the remote controller 30 to the bathroom side wall W or any other suitable place detachably, for example, a mounting means using adhesive force such as a face fastener or the like. Because there is a correspondence between the parts in this modification and the parts in the controller 30, the corresponding parts are indicated by the same reference numbers as in the controller 30 but with the addition of six hundred and, to avoid repetition, this modification is not otherwise described in detail.

Figure 15E:
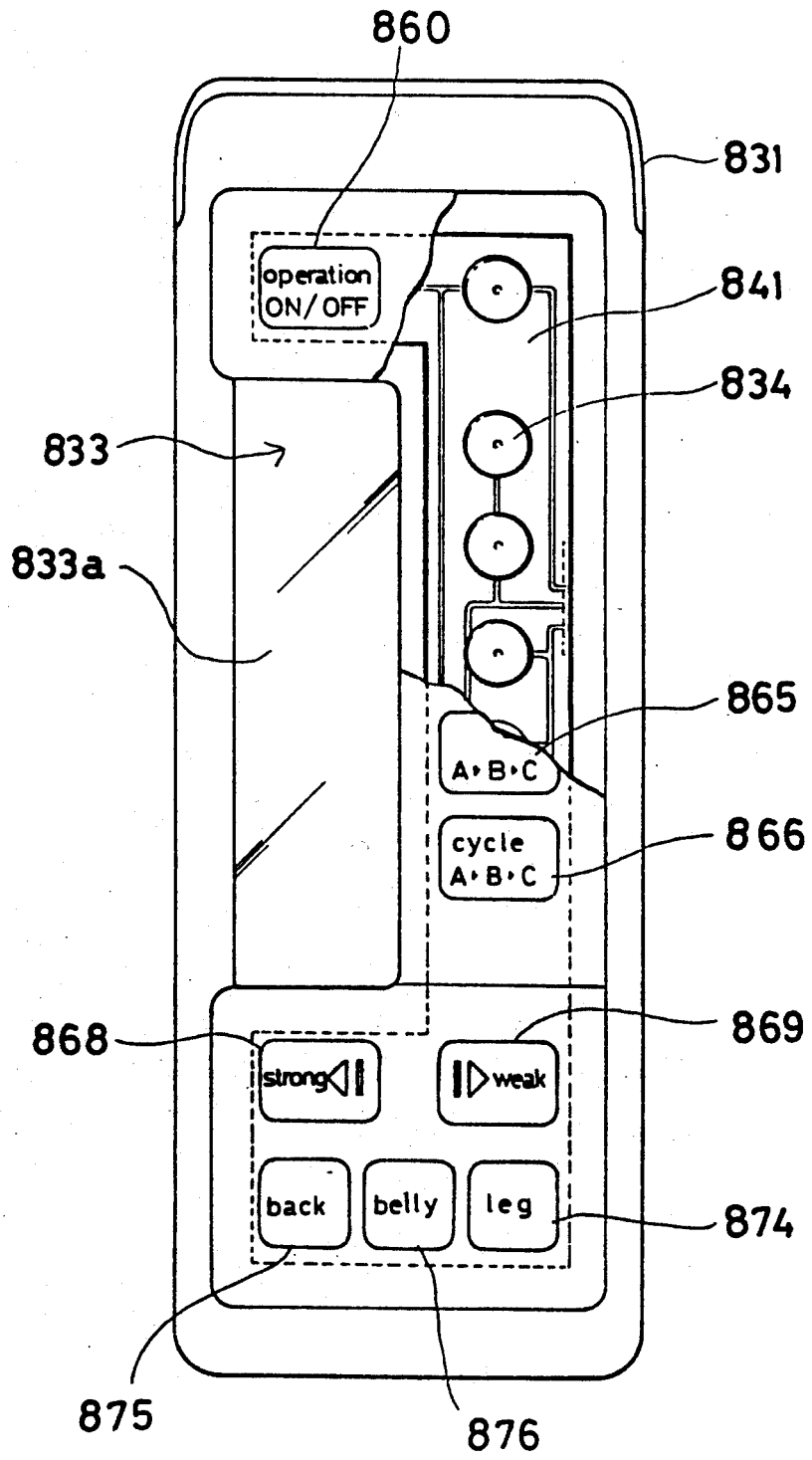
FIG. 15*e* is a partially cut-away plan view of a modification of the remote controller.
Figure 15F:
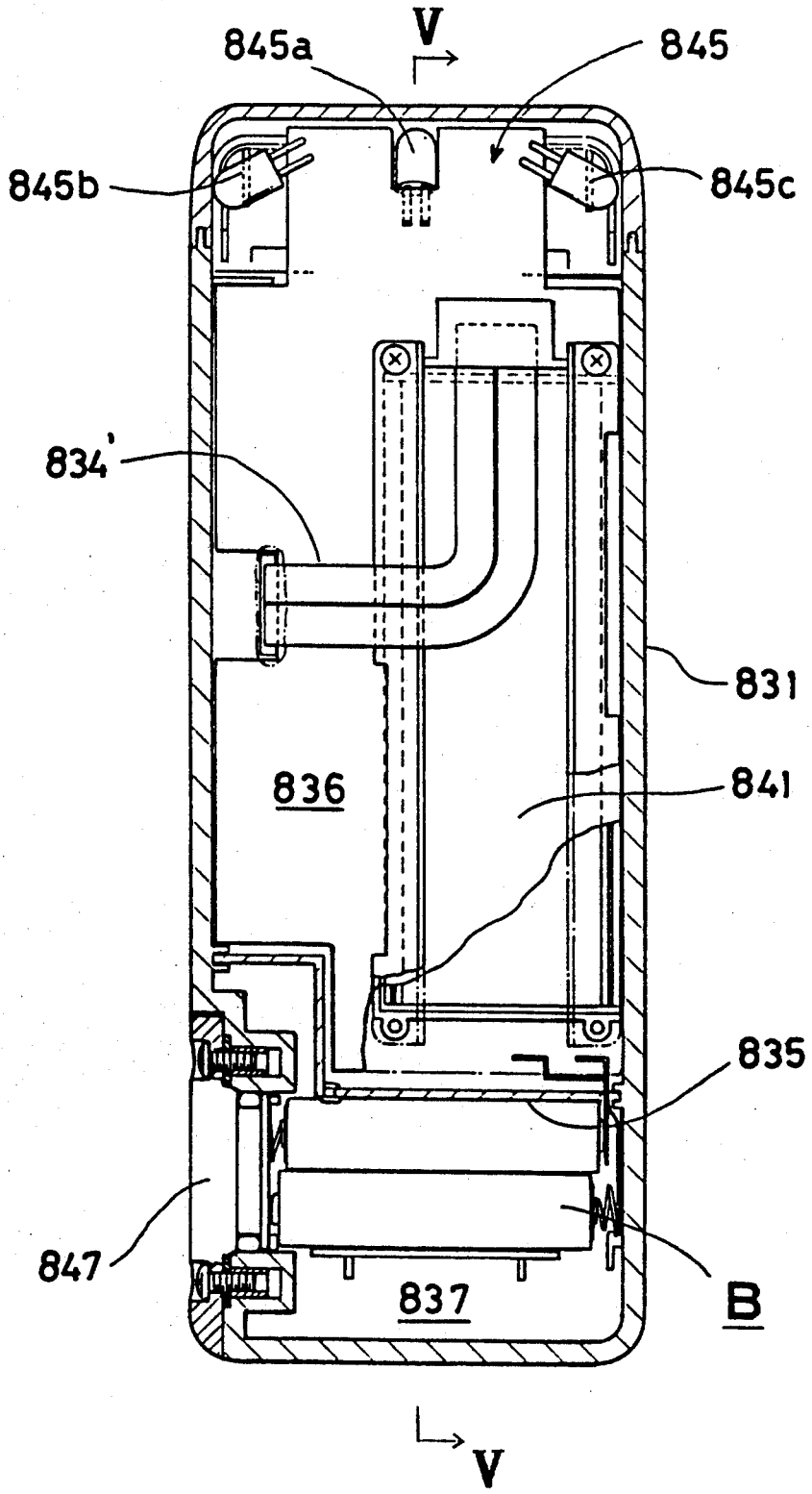
FIG. 15*f* is a cross-sectional plan view of the remote controller of FIG. 15*e* showing the inner construction thereof.
Figure 15G:
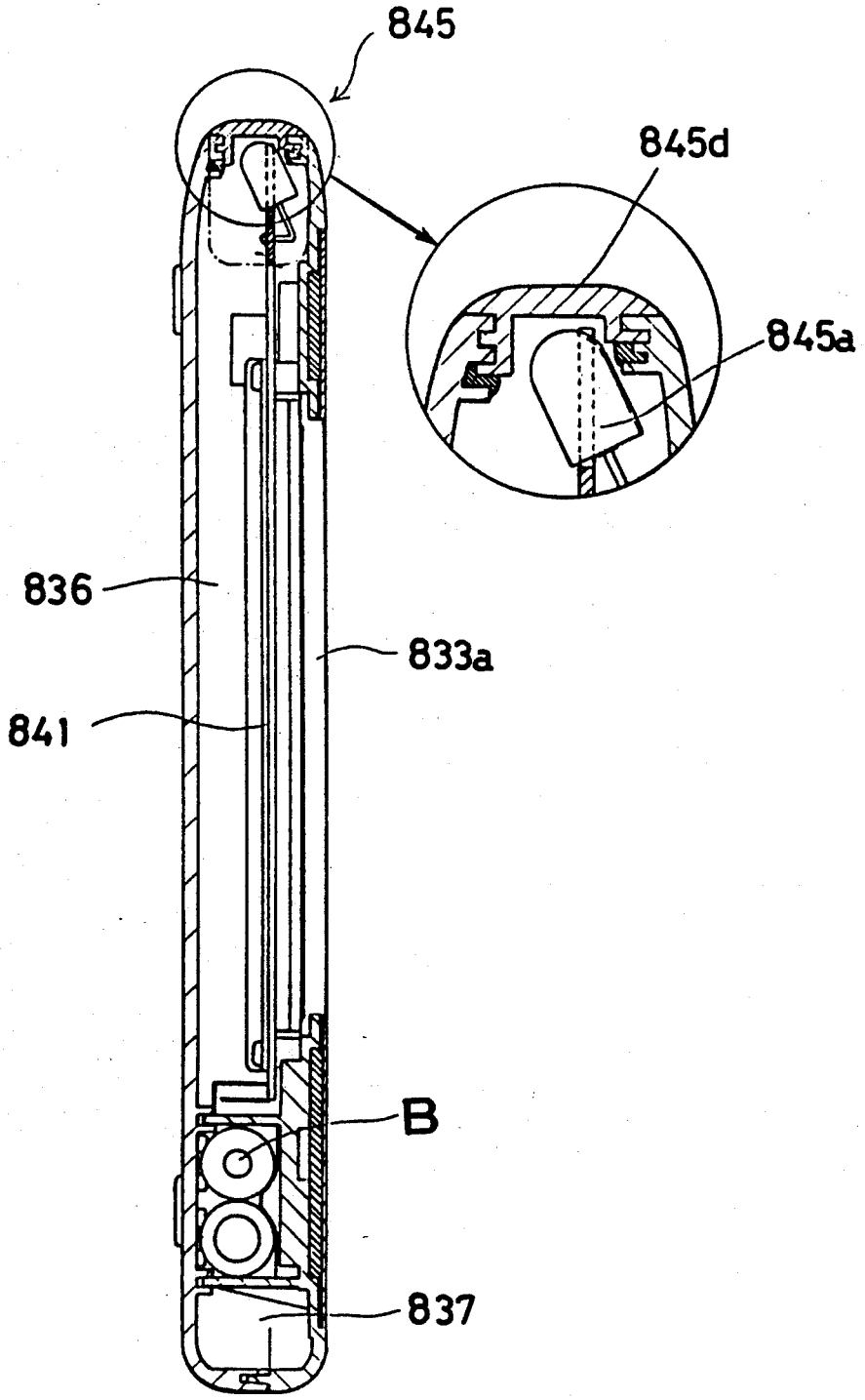
FIG. 15*g* is a longitudinal cross-sectional side view of the above remote controller taken along the line V—V of FIG. 15*f*.

In FIGS. 15*e*, 15*f* and 15*g*, a modification of the above-mentioned remote controller 30 is shown.

Figure 14:
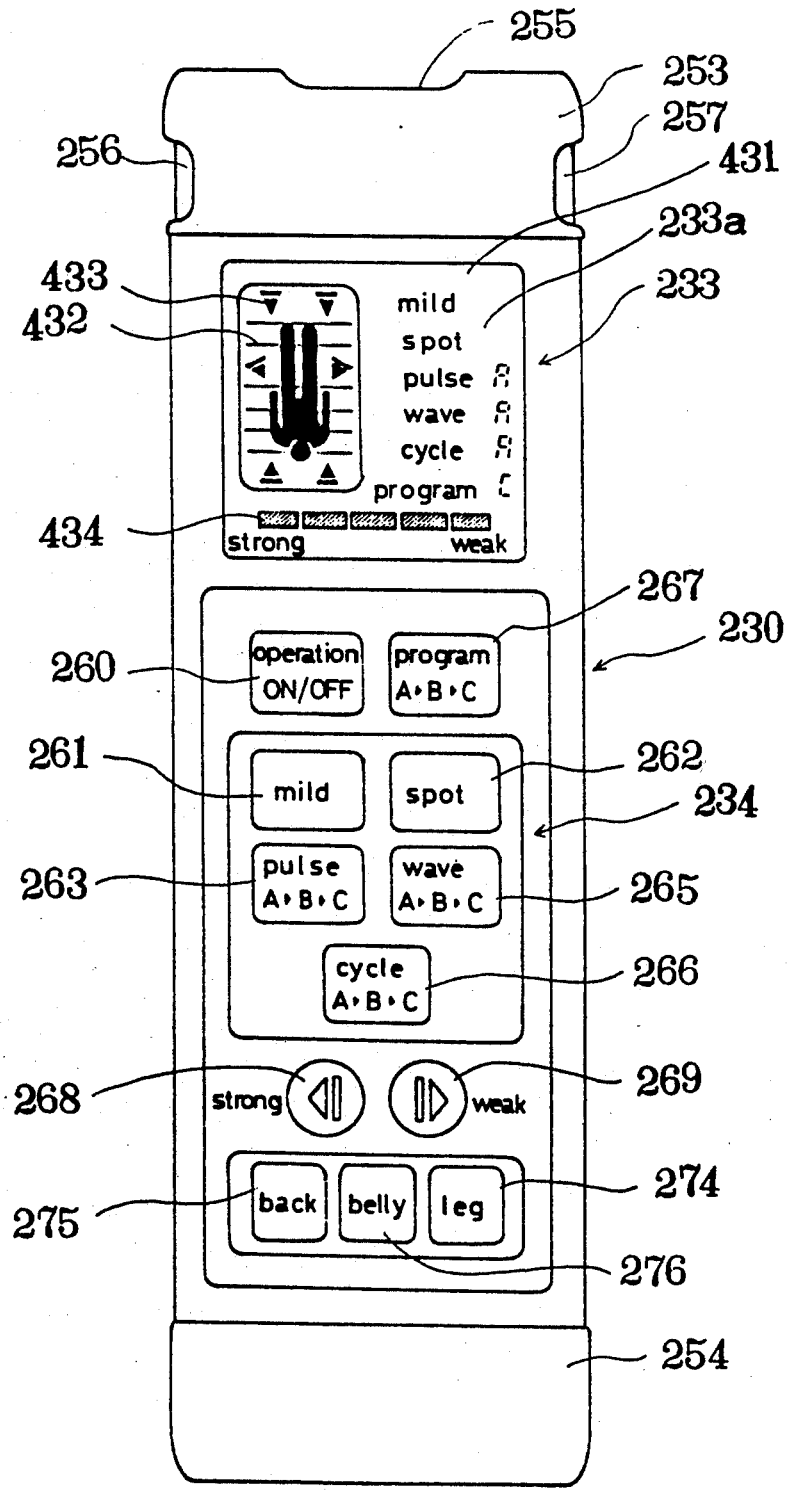
FIG. 14 is a plan view of a remote controller.

The modification is substantially characterized in that the size or area of a blow-off state display portion 833 is considerably enlarged compared to the blow-off state display portion 233 shown in FIG. 14 so that a bather can enjoy more easily the blow-off states such as shown in FIG. 15*h* to FIG. 15*m*.

In FIG. 15*h*, a mild blow-off state wherein the blow-off is of relatively high volume and low pressure is expressed visually.

In FIG. 15*i*, a spot blow-off state wherein the blow-off is of relatively small volume and high pressure is expressed visually.

In FIG. 15*j*, a pulse blow-off state wherein the blow-off operation is one in which the blow-off of a desired blow-off mode, e.g. the spot blow-off is operated periodically is expressed visually.

In FIG. 15*k*, a cycle blow-off state wherein the blow-off is one in which the nozzles at which the blow-off occurs are changed in a certain cycle by opening or closing each blow-off nozzle at the certain cycle in each blow-off mode is expressed visually.

In FIG. 15*l*, a wave blow-off state wherein the blow-off is one in which the volumetric rate of the blow-off is changed periodically by changing rate of revolution of the circulating pump P is expressed visually.

In FIG. 15*m*, a random (i.e., program) blow-off state wherein the blow-off operation is one in which the blow-off mode is randomly shifted from the blow-off mode to another thereby to continuously reinvigorate the bather is expressed visually.

These blow-off modes are further explained in detail hereinafter.

Furthermore, the modification is also characterized by the additional waterproofing so as to assure trouble-free use of the remote controller while bathing.

(III) DESCRIPTION OF BLOW-OFF MODES

The blow-off modes (mild, spot, pulse, wave, cycle, and program) obtained by this embodiment will be described below with reference to FIGS. 16*a* to 26.

(III-1) Mild Blow-Off

The mild blow-off mode is a blow-off mode in which the blow-off volume of hot water from the blow-off nozzles 2, 3, 4 is large and the blow-off pressure thereof is low. According to this blow-off mode, the whole of the bather's body is wrapped in hot water mildly and softly to give the feeling of massage to the bather.

More specifically, in the mild blow-off mode, the blow-off volume adjusting valves 22 in the blow-off nozzles 2, 3, 4 are opened almost fully, the rate of revolution of the circulating pump P is changed within a predetermined range (e.g. 1700–3000 r.p.m.), and the discharge pressure of the pump P is set to several stages (e.g. five stages) of strength levels within a preset low pressure range (e.g. 0.2–0.5 kg/cm$^2$) thereby permitting a large amount of hot water (e.g. 40–80 l/min) to be blown off from the nozzles 2, 3, 4.

Figure 16A:
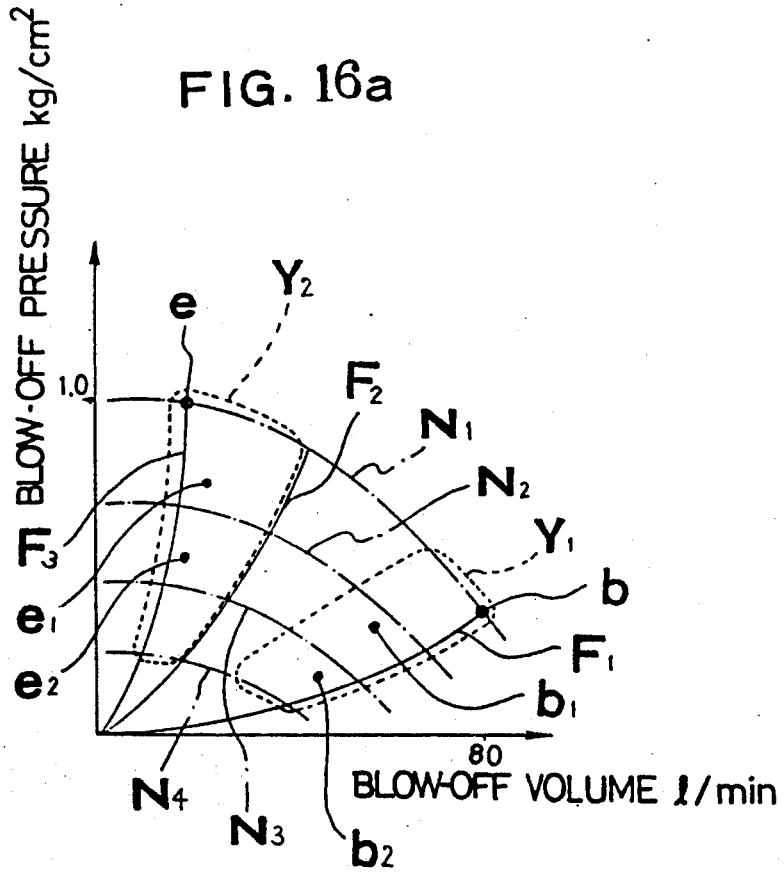
FIGS. 16*a* and 16*b* are explanatory views of blow-off volume, blow-off pressure characteristics.
Figure 16B:
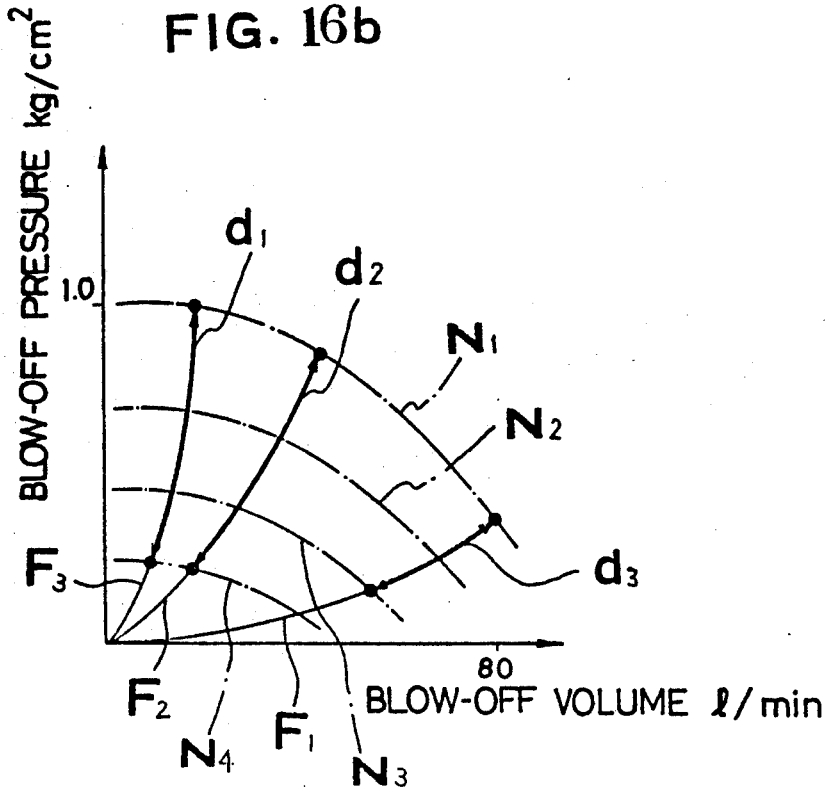

FIGS. 16*a* and 16*b* show blow-off volume-blow-off pressure characteristic curves F1, F2, F3 which vary as the rate of revolution of the circulating pump P changes. N1, N2, N3, and N4 represent revolution performance curves of the circulating pump P in which N1>N2>N3>N4 in terms of the rate of revolution.

In FIG. 16*a*, the point b on the blow-off volume-blow-off pressure characteristic curve F1 indicates the state of mild blow-off, assuming that the rate of revolution of the circulating pump P is near its maximum N1 (e.g. 3000 r.p.m.). Y1 represents a mild blow-off zone, while the points b1 and b2 indicate mild blow-off states in the mild blow-off zone Y1.

Figure 17A:
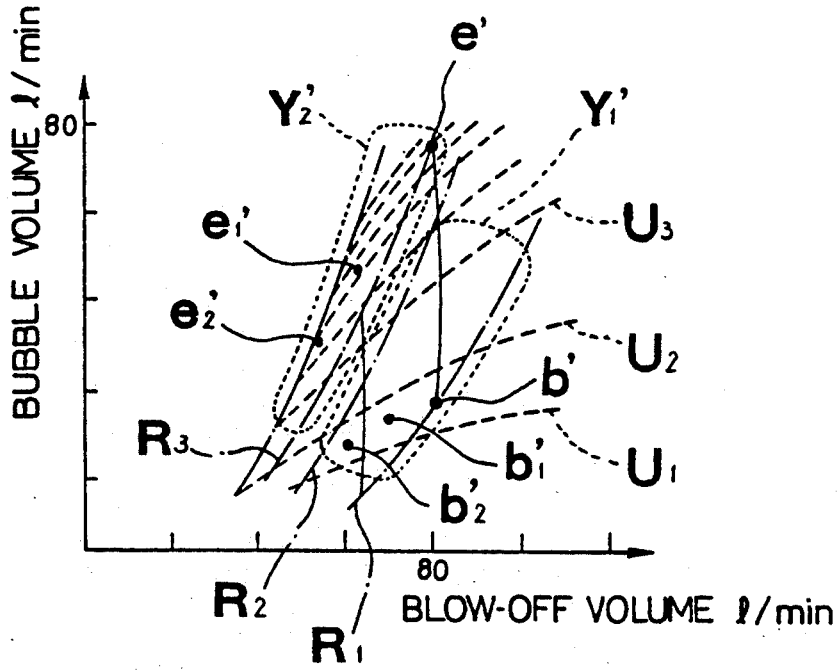
FIGS. 17*a* and 17*b* are explanatory views of blow-off nozzle characteristics.
Figure 17B:
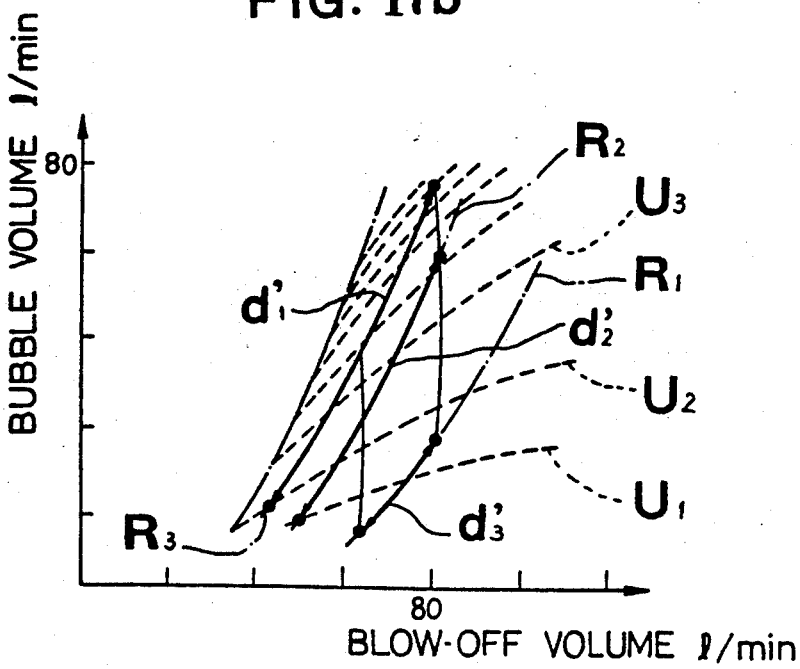

In FIGS. 17*a* and 17*b*, there are shown blow-off nozzle characteristic curves R1, R2, and R3 obtained when the blow-off volume adjusting valves 22 are fully open, half open and quarter open. In the same figure, U1, U2, and U3 represent blow-off pressure curves in which U1>U2>U3 in terms of magnitude.

The point b in FIG. 16*a* is indicated as point b' on the blow-off nozzle characteristic curve R1 shown in FIG. 17*a*.

In FIG. 17*a*, Y'1 represents a mild blow-off zone, while the points b'1 and b'2 represent mild blow-off states in the mild blow-off zone Y'1.

The above mild blow-off operation is performed by turning ON the mild blow-off switch 261 of the remote controller 30.

The change-over of switches at the time of changing the strength level in the mild blow-off mode or changing the blow-off nozzle use pattern is performed in a short time (e.g. about 1 sec).

Figure 18:
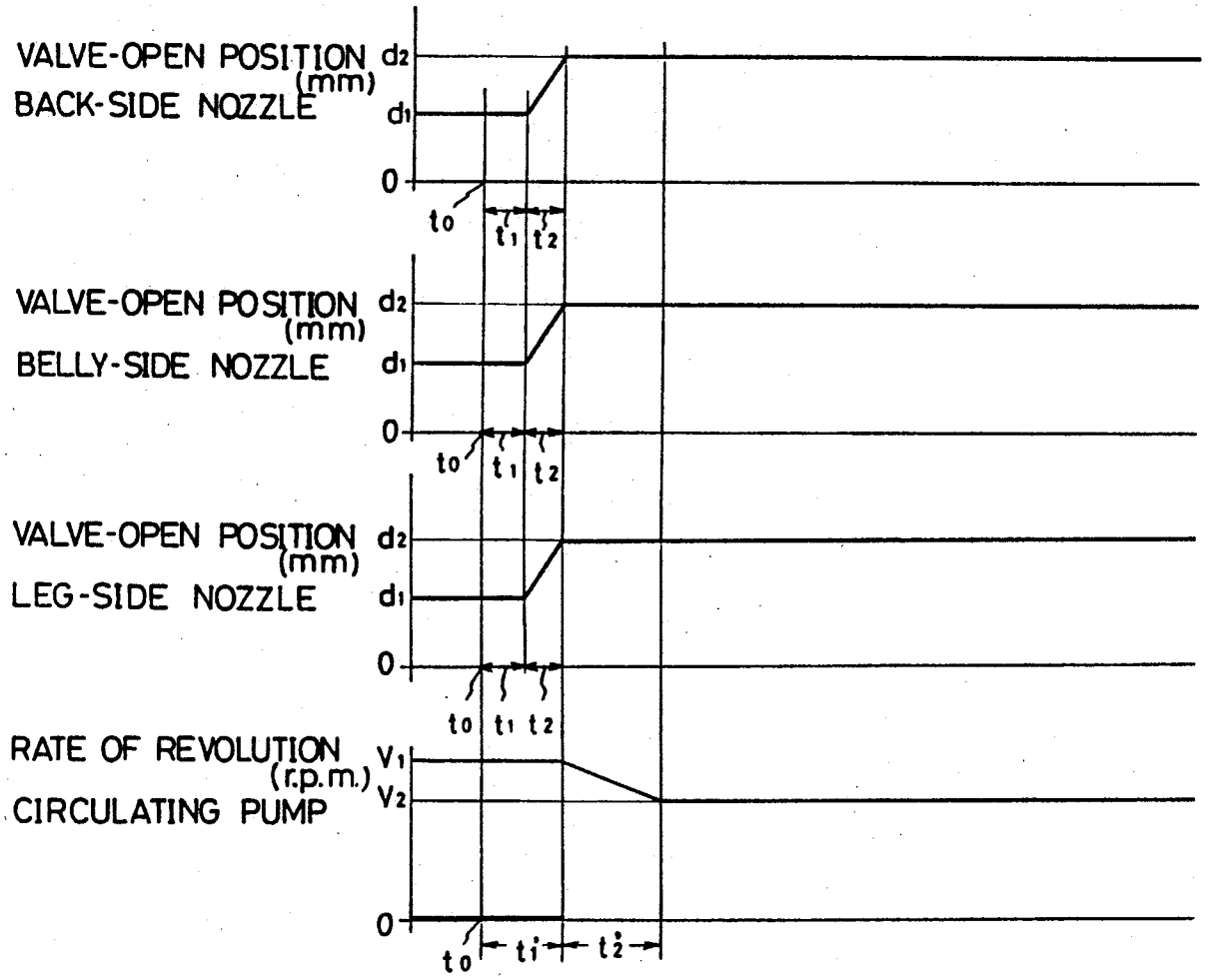
FIG. 18 is an operation timing chart of each blow-off nozzle and the circulating pump in a mild blow-off mode.

FIG. 18 is a timing chart relating to the opening/closing operation of the blow-off volume adjusting valves 22 in the leg-, back- and belly-side blow-off nozzles 2, 3, 4 and the operation of the circulating pump P.

For a certain time $t_2$ (e.g. 1 sec) after the lapse of a certain time $t_1$ (e.g. 0 sec) from the time $t_0$ when the mild blow-off switch was operated, the blow-off volume adjusting valves 22 in the leg-, back- and belly-side blow-off nozzles 2, 3, 4 are each operated from a medium-open position $d_1$ (the open position before the blow-off mode change) to a preset open position $d_2$ (e.g. a valve-open position 6 mm retracted from a fully closed position) at a high speed (preferably the maximum speed).

From just before the lapse of end time $t'_1$ of the preset valve opening of each blow-off volume adjusting valve 22, the rate of revolution $V_1$ (e.g. 2800 r.p.m.) before the blow-off mode change of the circulating pump P is decreased gradually so that a certain rate of revolution $V_2$ (e.g. 2400 r.p.m.) is reached within a certain time $t'_2$ (3 sec).

In this embodiment, moreover, upon start of operation (upon turning ON of the operation switch 260 or 100) the blow-off operation is started. In the blow-off operation, the blow-off mode is set to the mild blow-off mode and the strength level is initialized to "Medium", taking into account safety during bathing of a child or an old person, (this blow-off operation will hereinafter be referred to as the "child safety blow-off").

Figure 19:
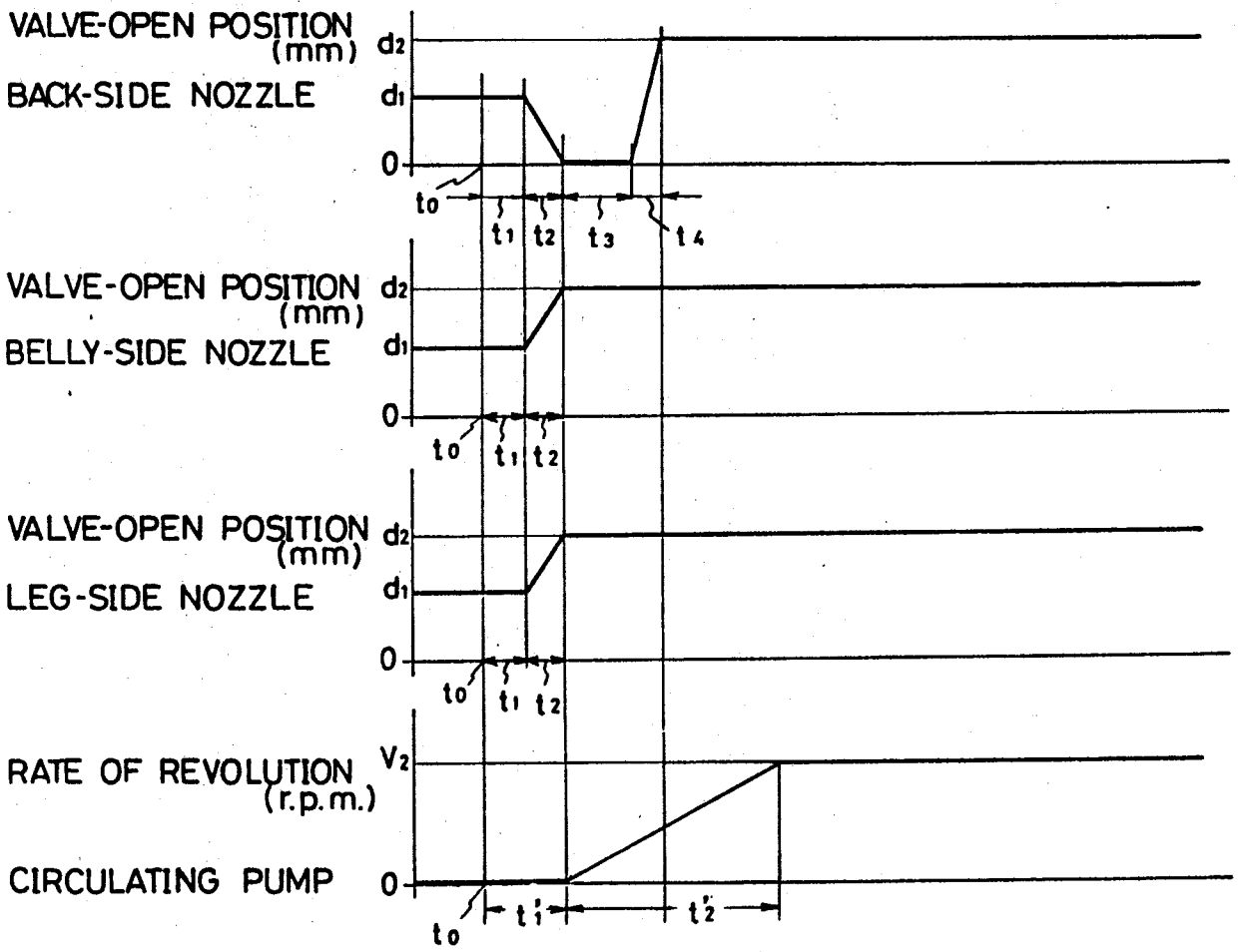
FIG. 19 is an operation timing chart of each blow-off nozzle and the circulating pump in a child safety blow-off mode.

In this embodiment, moreover, as shown in the timing chart of FIG. 19, only the blow-off volume adjusting valves 22 in the back-side blow-off nozzles 3 are once operated up to a fully closed position at the time of operation start to prevent cold water remaining in pipes after the previous use from blowing off from the back-side nozzles 3, which would cause discomfort to the user or might endanger the user.

More specifically, in FIG. 19, for a certain time $t_2$ (e.g. 1 sec) after the lapse of a certain time $t_1$ (e.g. 0 sec) from the time $t_0$ when the mild blow-off switch was operated, the blow-off volume adjusting valves 22 in the back-side nozzles 3 are each operated from a medium position (the valve-open position before the blow-off mode change) to a fully closed position at a high speed (preferably the maximum speed), and for a certain time $t_4$ (e.g. 1 sec) after this closed state is maintained for a certain time $t_3$ (e.g. 2 sec), the blow-off volume adjusting valves 22 are each operated up to a preset open position $d_2$ (e.g. a valve-open position 6 mm retracted from a fully closed position) at a high speed (preferably the maximum speed).

As to the blow-off volume adjusting valves 22 in the leg- and belly-side blow-off nozzles 2, 4, for a certain time $t_1$ (e.g. 1 sec) after the lapse of a certain time $t_1$ (e.g. 1 sec) from the time $t_0$ when the mild blow-off switch was operated, those valves are each operated from a medium-open position $d_1$ (the open position before the blow-off mode change) to an almost fully open position $d_2$ (e.g. a valve-open position retracted 6 mm from a fully closed position) at a high speed (preferably the maximum speed).

The circulating pump P is operated just after the lapse of end time $t'_1$ of the closing or preset opening operation of each blow-off volume adjusting valve 22, and the rate of revolution thereof is increased gradually so that a certain rate of revolution $V_2$ (e.g. 2800 r.p.m.) is reached within a certain time $t'_2$ (e.g. 10 sec).

The control timing for both the opening or closing operation of the blow-off volume adjusting valve 22 in each of the blow-off nozzles 2, 3, 4 and the change of the rate of revolution of the circulating pump P is determined so as to avoid discomfort to the bather such as would be caused by a sudden increase in discharge pressure of the circulating pump P. This point will be explained later in (IV-7).

(III-2) Spot Blow-Off

The spot blow-off mode is a blow-off mode in which the blow-off volume of hot water from the blow-off nozzles 2, 3, 4 is small and the blow-off pressure thereof is high and in which a hot water jet is applied vigorously to a part of the user's body, whereby the user is given a feeling of massage involving a finger-pressure feeling.

More specifically, in the spot blow-off mode, the blow-off volume adjusting valve element 22 in each of the blow-off nozzles 2, 3, 4 is slightly opened, the rate of revolution of the circulating pump P is changed within a certain range (e.g. 2000 to 3000 r.p.m.), and the discharge pressure of the pump P can be set to several stages (e.g. five stages) of strength levels within a preset high pressure range (e.g. 0.5 to 1.0 kg/cm$^2$).

The point e on the blow-off volume-blow-off pressure characteristic curve F3 in FIG. 16*a* indicates the state of spot blow-off at a minimum blow-off volume (e.g. 30 l/min) of hot water.

In FIG. 16*a*, moreover, Y2 represents a spot blow-off zone in the blow-off volume - blow-off pressure characteristics, and the points e1 and e2 each indicate a state of spot blow-off within the spot blow-off zone Y2.

The point e in FIG. 16*a* can be expressed as point e' on the blow-off nozzle characteristic curve R3 shown in FIG. 17*a*.

In FIG. 17*a*, Y'2 represents a spot blow-off zone in the blow-off nozzle characteristics, and the points e'1 and e'2 each indicate a state of spot blow-off within the spot blow-off zone Y'2.

The above spot or finger-pressure blow-off operation is performed by turning ON the spot blow-off switch 262 of the remote controller 30.

Figure 20:
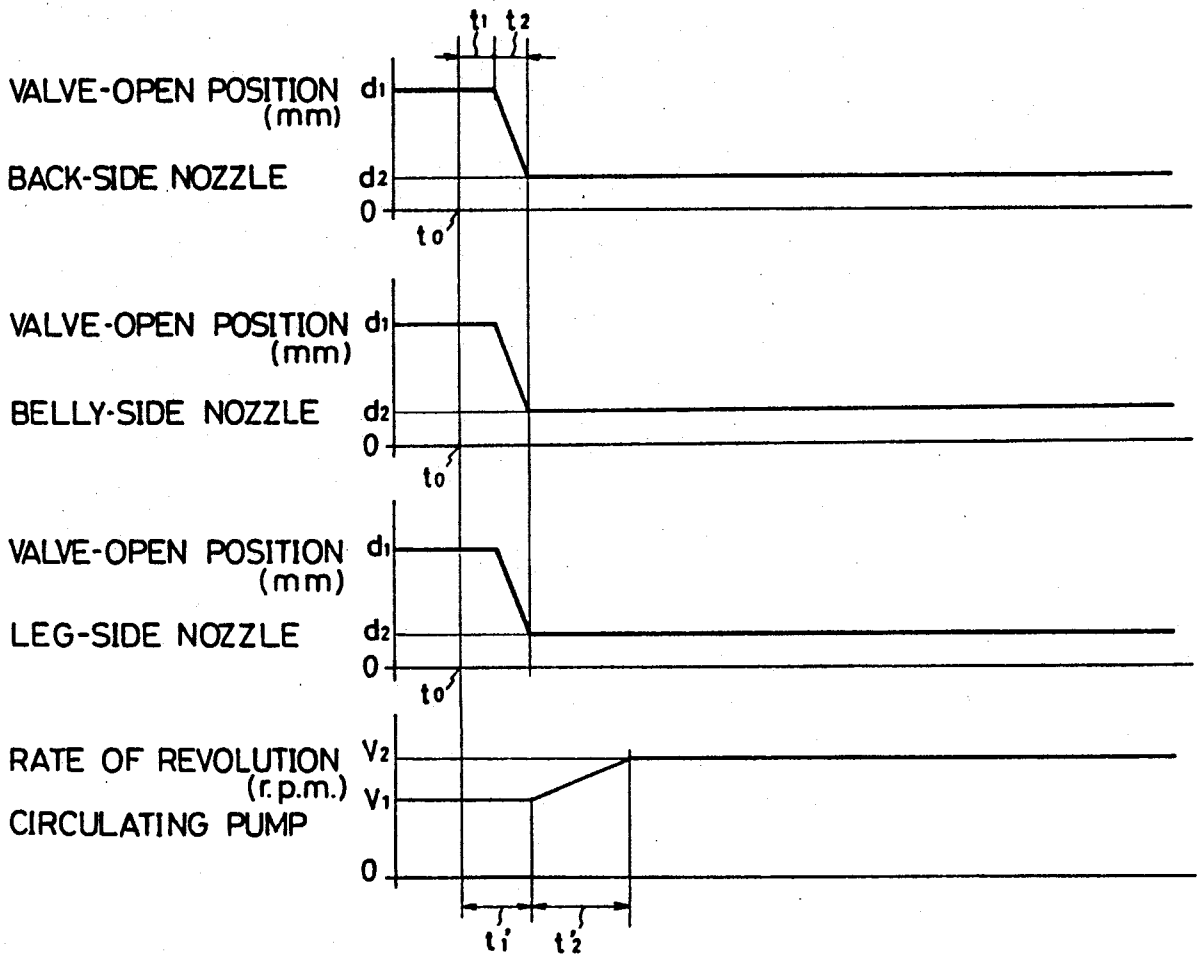
FIG. 20 is an operation timing chart of each blow-off nozzle and the circulating pump in a spot blow-off mode.

FIG. 20 is a timing chart relating to the opening/closing operation of the blow-off volume adjusting valve elements 22 in the leg-, back- and belly-side blow-off nozzles, 2, 3, 4 and the operation of the circulating pump P.

More specifically, in FIG. 20, for a certain time $t_2$ (e.g. 1 sec) after the lapse of a certain time $t_1$ (e.g. 0 sec) from the time $t_0$ when the spot blow-off switch was operated, each blow-off volume adjusting valve element 22 is operated from the open position $d_1$ before the blow-off mode change (e.g. a valve-open position retracted 6 mm from a fully closed position) to a preset open position $d_2$ (e.g. a valve-open position 1.5 mm retracted from the fully closed position) at a high speed (preferably the maximum speed).

Then, from just after the lapse of end time $t'_1$ of the preset opening operation of each blow-off volume adjusting valve element 22, the circulating pump P gradually increases its rate of revolution $V_1$ before the blow-off mode change (e.g. 2400 r.p.m.) so that a certain rate of revolution $V_2$ (e.g. 2800 r.p.m.) is reached within a certain time $t'_2$ (e.g. 3 sec).

(III-3) Pulse Blow-Off

The pulse blow-off mode is a blow-off mode in which the blow-off of hot water and stopping thereof are performed in an alternate manner by opening and closing the individual blow-off nozzles, 2, 3, 4 periodically to alternate the blow-off of a hot water jet and stopping thereof pulsewise, thereby giving a sharp stimulation to the user.

According to the pulse blow-off mode, in the foregoing spot blow-off operation the blow-off volume adjusting valve elements 22 in the blow-off nozzles 2, 3, 4 are each moved at a high speed (preferably the maximum speed) to a preset open position and a fully closed position alternately in a short time (e.g. 1 sec) at every lapse of a certain time, whereby there can be alternately created a state in which hot water is blown off and a state in which hot water is not blown off. In some cases the hot water blown off contains bubbles, while in the other it does not.

The change of the strength level of such pulse blow can be done by setting the blow-off volume of hot water in several stages (e.g. five stages) within a certain range (e.g. 30 to 50 l/min) which can be effected by changing the rate of revolution of the circulating pump P.

The above pulse blow-off operation is performed by turning ON the pulse blow-off switch 263 of the remote controller 30.

Figure 21:
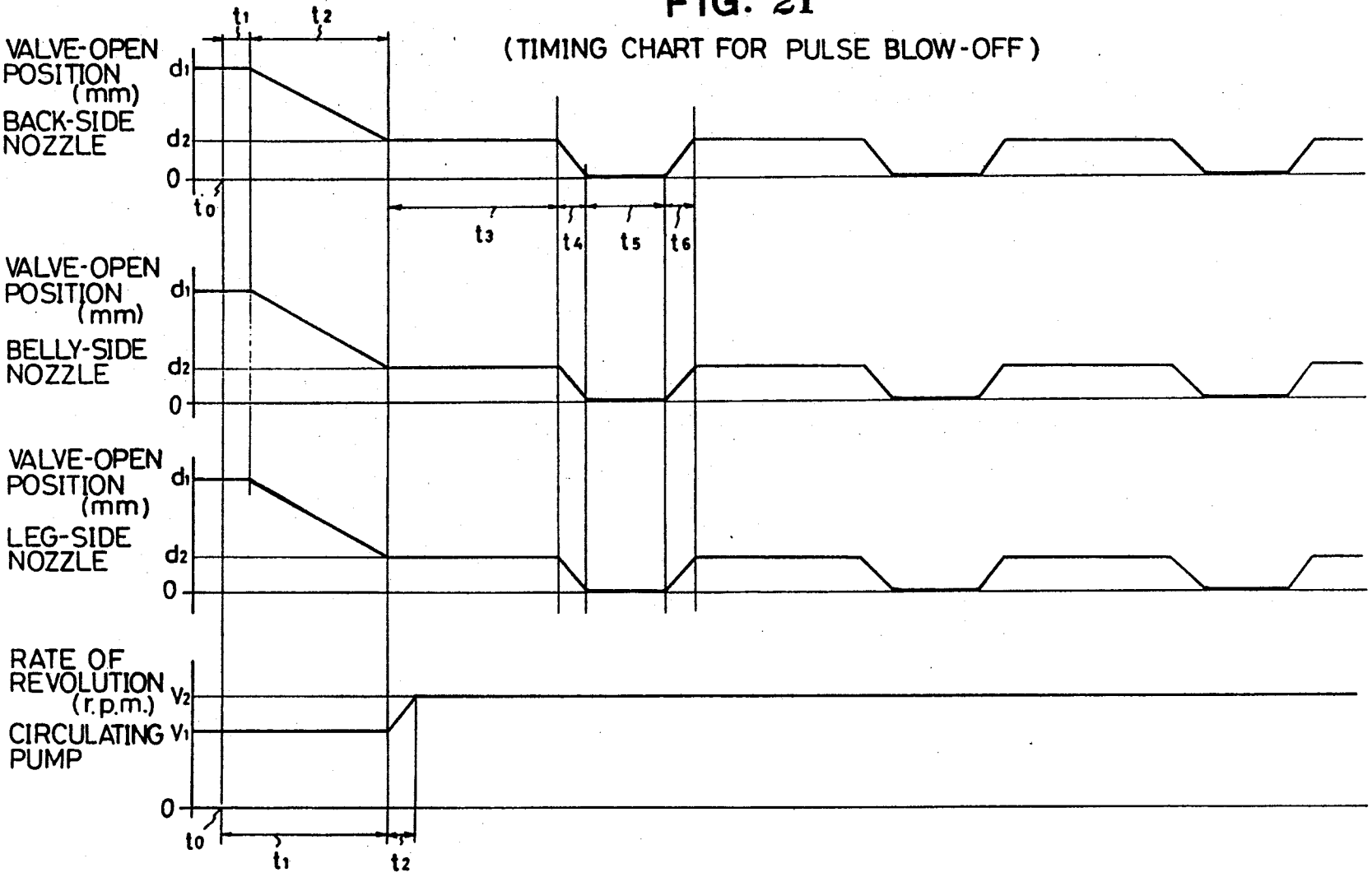
FIG. 21 is an operation timing chart of each blow-off nozzle and the circulating pump in a pulse blow-off mode.

FIG. 21 is a timing chart relating to the opening and closing operation of the blow-off volume adjusting valve element 22 in the leg-, back- and belly-side blow-off nozzles 2, 3, 4 and the operation of the circulating pump P.

More specifically, in FIG. 21, after the lapse of a certain $t_1$ (e.g. 0 sec) from the time $t_0$ when the pulse blow-off switch was operated, each blow-off volume adjusting valve element 22 is operated from its open position $d_1$ before the blow-off mode change (e.g. a valve-open position 6 mm retracted from a fully closed position) to a preset open position $d_2$ (e.g. a valve-open position 2 mm retracted from the fully closed position) at a high speed (preferably the maximum speed) for a certain time $t_2$ (e.g. 1 sec). After this open condition is maintained for a certain time $t_3$ (e.g. 1 sec), the valve element 22 is closed up to the fully closed position at a high speed (preferably the maximum speed) for a certain time $t_4$ (e.g. 1 sec), then after this fully closed condition is maintained for a certain time $t_5$ (e.g. 1 sec), the valve is opened up to the foregoing preset open position $d_2$ at a high speed (preferably the maximum speed) for a certain time $t_6$ (e.g. 1 sec). Further, after this open condition is held for a certain time $t_7$ (e.g. 1 sec), the valve is closed. These valve opening and closing operations are repeated periodically.

After the lapse of a certain time $t'_1$ (e.g. 1 sec) from the time $t_0$ when the pulse blow-off switch was operated, the rate of revolution $V_1$ before the blow-off mode change (e.g. 2400 r.p.m.) is increased gradually so as to reach a certain rate of revolution $V_2$ (e.g. 2800 r.p.m.) within a certain time $t'_2$ (e.g. 3 sec).

By changing the certain time $t_3$ for maintaining the preset valve-open condition there can be set different pulse blow-off patterns. In this embodiment, there are set three kinds of pulse blow-off patterns A, B, and C with the certain time $t_3$ set to one, two and three seconds, respectively, so that there can be selected a hot water jet stimulation time for the user according to a liking of the user.

(III-4) Wave Blow-off

The wave blow-off mode is a blow-off mode in which the rate of revolution of the circulating pump P is changed periodically to change the blow-off volume and pressure of hot water periodically. By changing the blow-off volume and pressure with a slow period there is formed a varied flow to apply a hot water jet having the effect of a wave which approaches and leaves the user repeatedly.

In the wave blow-off mode, the blow-off volume adjusting valve elements 22 in the blow-off nozzles 2, 3, 4 are fully opened or medium-opened and the circulating pump P is turned on and off, or the rate of revolution of the pump P is changed periodically within a certain range (e.g. 1600 to 3000 r.p.m.).

The change of the wave blow-off strength level can be done by dividing the aforementioned range of the rate of revolution of the circulating pump P, which rate of revolution is to be changed periodically, into several stages (e.g. five stages).

The $d_1$, $d_2$ and $d_3$ shown in FIG. 16*b* represent blow-off volume blow-off pressure characteristic curves in the wave blow-off mode.

The blow-off volume and pressure of hot water vary along the curves $d_1$, $d_2$ and $d_3$.

The $d'_1$, $d'_2$ and $d'_3$ shown in FIG. 17*b* represent blow-off nozzle characteristic curves. In the wave blow-off mode, the amount of bubbles can be varied greatly.

The wave blow-off operation described above is started by turning ON the wave blow-off switch 265 of the remote controller 30.

The hot water blow-off nozzle use pattern in the wave blow-off mode is the same as in the foregoing mild blow-off mode.

Figure 22:
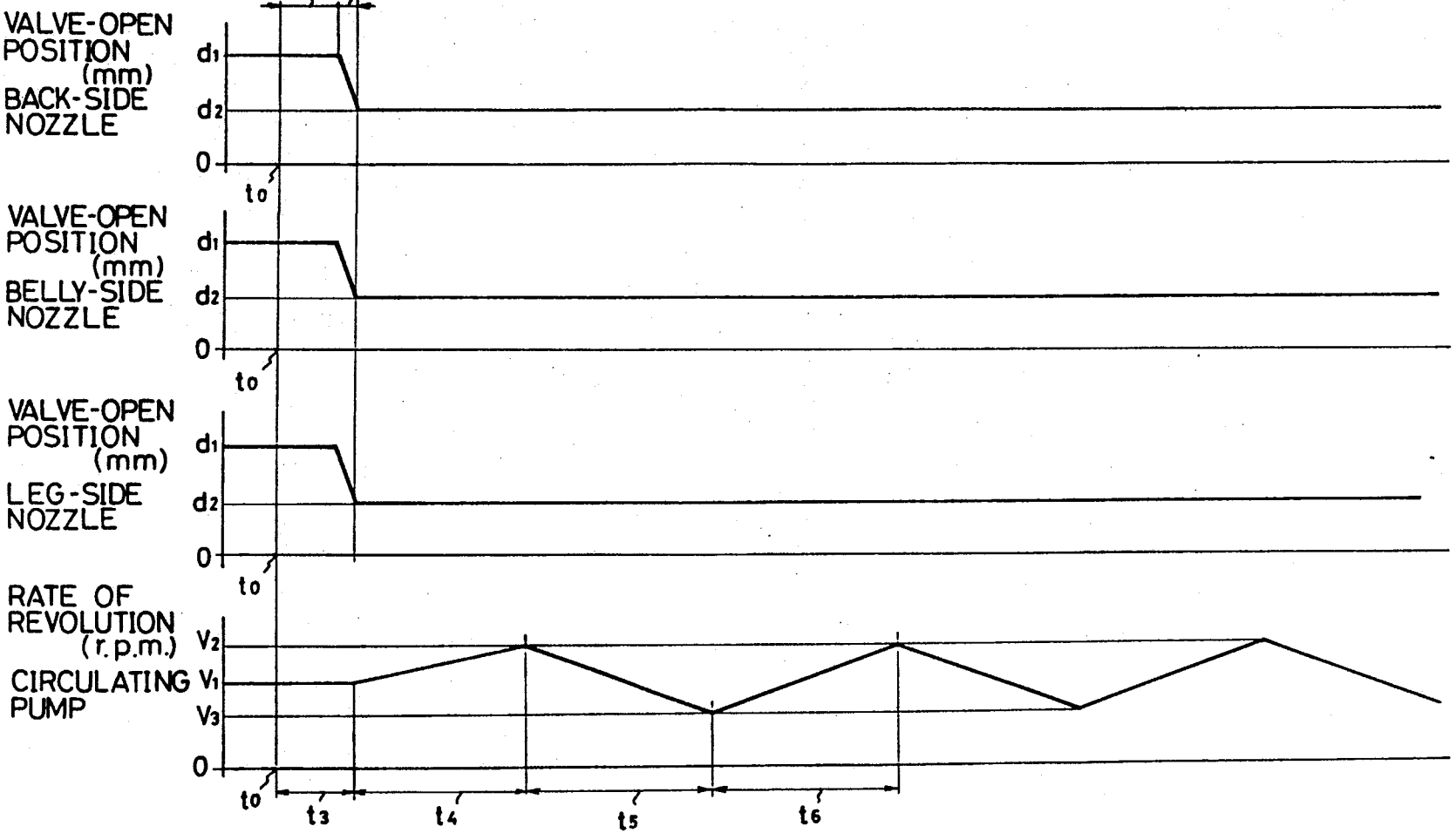
FIG. 22 is an operation timing chart of each blow-off nozzle and the circulating pump in a wave blow-off pattern A.
Figure 23:
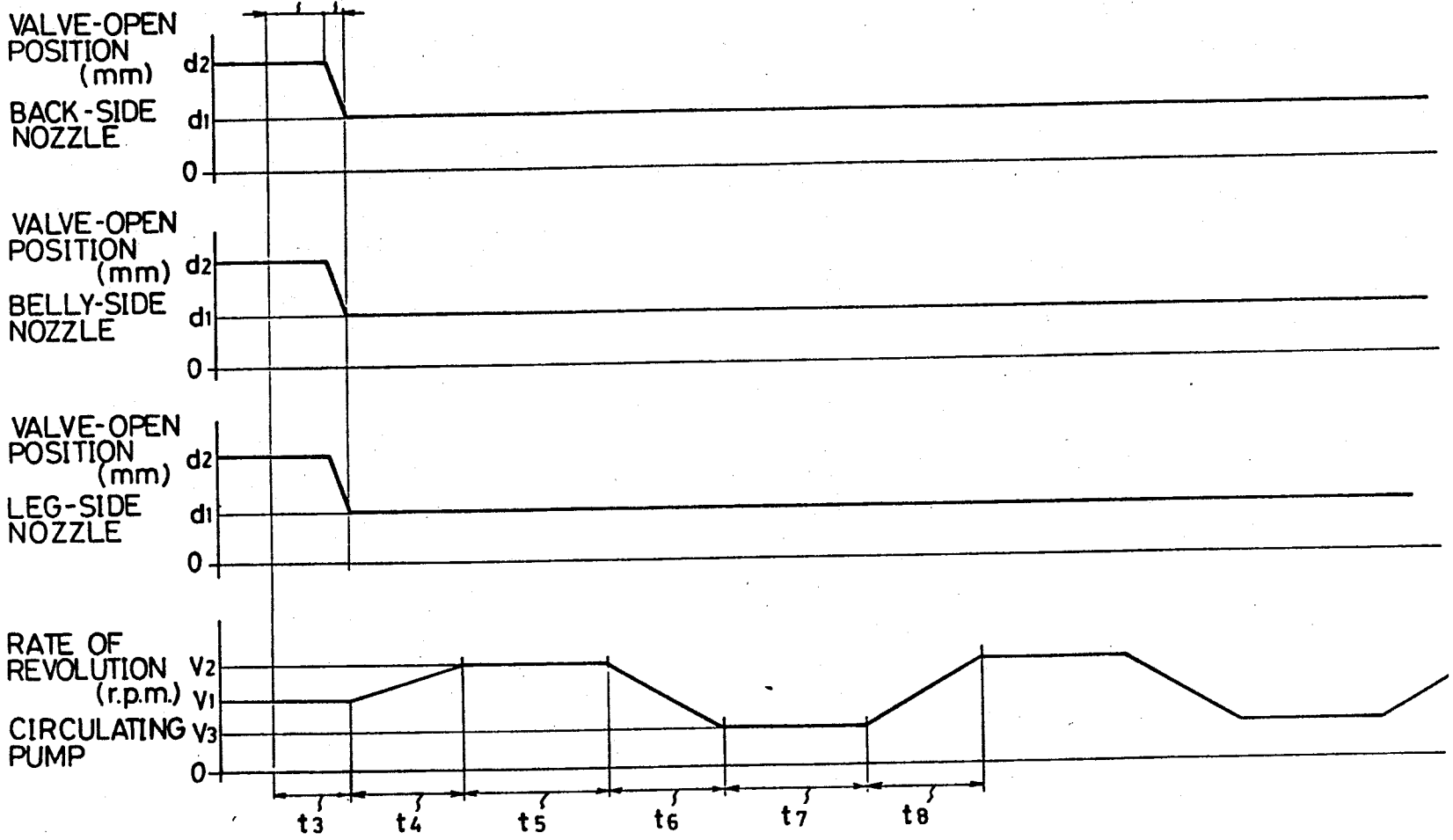
FIG. 23 is an operation timing chart of each blow-off nozzle and the circulating pump in a wave blow-off pattern B.

FIG. 22 is a timing chart relating to the opening and closing operation of the blow-off volume adjusting valve elements 22 in the leg-, back- and belly-side blow-off nozzles 2, 3, and 4 and the operation of the circulating pump P.

More specifically, in FIG. 22, after the lapse of a certain time $t_1$ (e.g. 1 sec) from the time $t_0$ when the wave blow-off switch was operated, each blow-off volume adjusting valve element 22 is operated at a high speed (preferably the maximum speed) for a certain time $t_2$ (e.g. 1 sec) from the open position $d_1$ before the blow-off mode change (e.g. a valve-open position retracted 6 mm from a fully closed position) up to a preset valve-open position $d_2$ (e.g. a valve-open position 4 mm retracted from a fully closed position).

Then, from just after the lapse of end time $t_3$ of the preset opening operation of each blow-off volume adjusting valve 22, the circulating pump P gradually increases its rate of revolution $V_1$ before the blow-off mode change (e.g. 2400 r.p.m.) so that a certain high rate of revolution $V_2$ (e.g. 3000 r.p.m.) is reached within a certain time $t_4$ (e.g. 4 sec). Thereafter, the rate of revolution is gradually decreased to a lower rate of revolution $V_3$ (e.g. 1800 r.p.m.) within a certain time $t_5$ (e.g. 4 sec), then it is again increased gradually up to the above high rate of revolution $V_2$ within a certain time $t_6$ (e.g. 4 sec). In this way the rate of revolution of the circulating pump P is varied periodically.

By changing the manner of periodic change in the rate of revolution of the circulating pump P it is possible to set different wave blow-off patterns. In this embodiment, the wave blow-off pattern described above is designated as wave blow-off pattern "A", and wave blow-off patterns which will be explained below are designated wave blow-off patterns "B" and "C". Thus, there are set three kinds of patterns According to the wave blow-off pattern B, as shown in the timing chart of FIG. 23, from just after the lapse of end time $t_3$ of the preset opening operation of each blow-off volume adjusting valve 22, the rate of revolution $V_1$ before the blow-off mode change (e.g. 2400 r.p.m.) is increased gradually up to a high rate of revolution $V_2$ (e.g. 3000 r.p.m.) within a certain time $t_4$ (e.g. 4 sec), which high rate of revolution $V_2$ is maintained for a certain time $t_5$ (e.g. 2 sec), thereafter the rate of revolution is gradually decreased to a lower rate of revolution $V_3$ (e.g. 1800 r.p.m.) within a certain time $t_6$ (e.g. 4 sec), which lower rate of revolution $V_3$ is maintained for a certain time $t_7$ (e.g. 2 sec), thereafter the rate of revolution is gradually increased up to the aforesaid higher rate of revolution $V_2$ within a certain time $t_8$ (e.g. 4 sec). In this way the rate of revolution is varied periodically.

Figure 24:
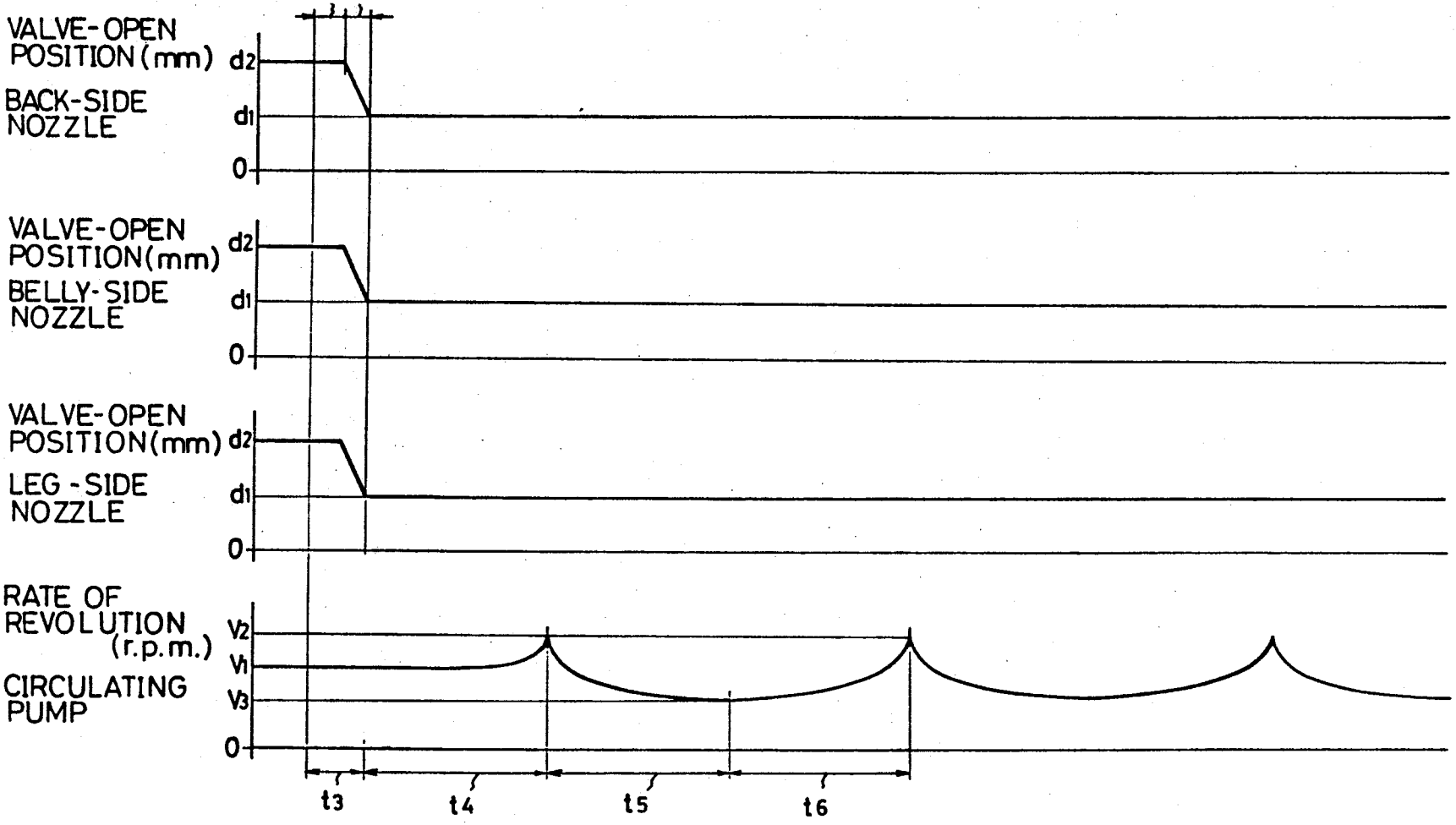
FIG. 24 is an operation timing chart of each blow-off nozzle and the circulating pump in a wave blow-off pattern C.

According to the wave blow-off pattern C, as shown in the timing chart of FIG. 24, from just after the lapse of end time $t_3$ of the preset opening operation of each blow-off volume adjusting valve 22, the rate of revolution $V_1$ before the blow-off mode change (e.g. 2400 r.p.m.) is increased gradually so as to describe a downwardly convex curve up to a certain high rate of revolution $V_2$ (e.g. 3000 r.p.m.) within a certain time $t_4$ (e.g. 3 sec), thereafter the rate of revolution is gradually decreased so as to describe a downwardly convex curve to a lower $t_5$ (e.g. 3 sec), and thereafter the rate of revolution is gradually increased so as to describe a downwardly convex curve up to the aforesaid higher rate of revolution $V_2$ within a certain time $t_6$ (e.g. 3 sec). In this way the rate of revolution is varied periodically.

In this embodiment, since the rate of revolution of the circulating pump P is controlled by the inverter E, a periodic change in the rate of revolution of the circulating pump P is performed smoothly and positively, whereby there can be generated the wave blow-offs A, B and C each having a pulsatory power in a faint hot water jet.

Particularly, in the wave blow-off pattern C, the rate of revolution of the circulating pump P varies while describing a generally catenary curve, and the rate of increase and that of decrease in the rate of revolution are high in a high rate of revolution region, while those in a low rate of revolution region are small. Therefore, it is possible to obtain a blow-off mode having clear distinction and a finger-pressure effect for the user, in which a pronounced blow-off change occurs in a relatively short time, while a minor blow-off change occurs over a relatively long time.

(III-5) Cycle Blow-off

In the cycle blow-off mode, the hot water blow-off position is changed automatically and periodically, thereby permitting the user to enjoy the change in the hot water blow-off position.

More specifically, in the cycle blow-off mode, the blow-off volume adjusting valves 22 are opened to blow-off hot water for a certain time in the order of, for example, back-side blow-off nozzles 3, 3→belly-side blow-off nozzles 4, 4→leg-side blow-off nozzles 2, 2. In this case, as the blow-off mode of hot water from the blow-off nozzles 2, 3, 4 there can be used the mild blow-off, spot blow-off and wave blow-off modes, and further there can be adopted a blow-off mode in which the mild blow-off and the spot blow-off are alternated periodically.

Figure 25:
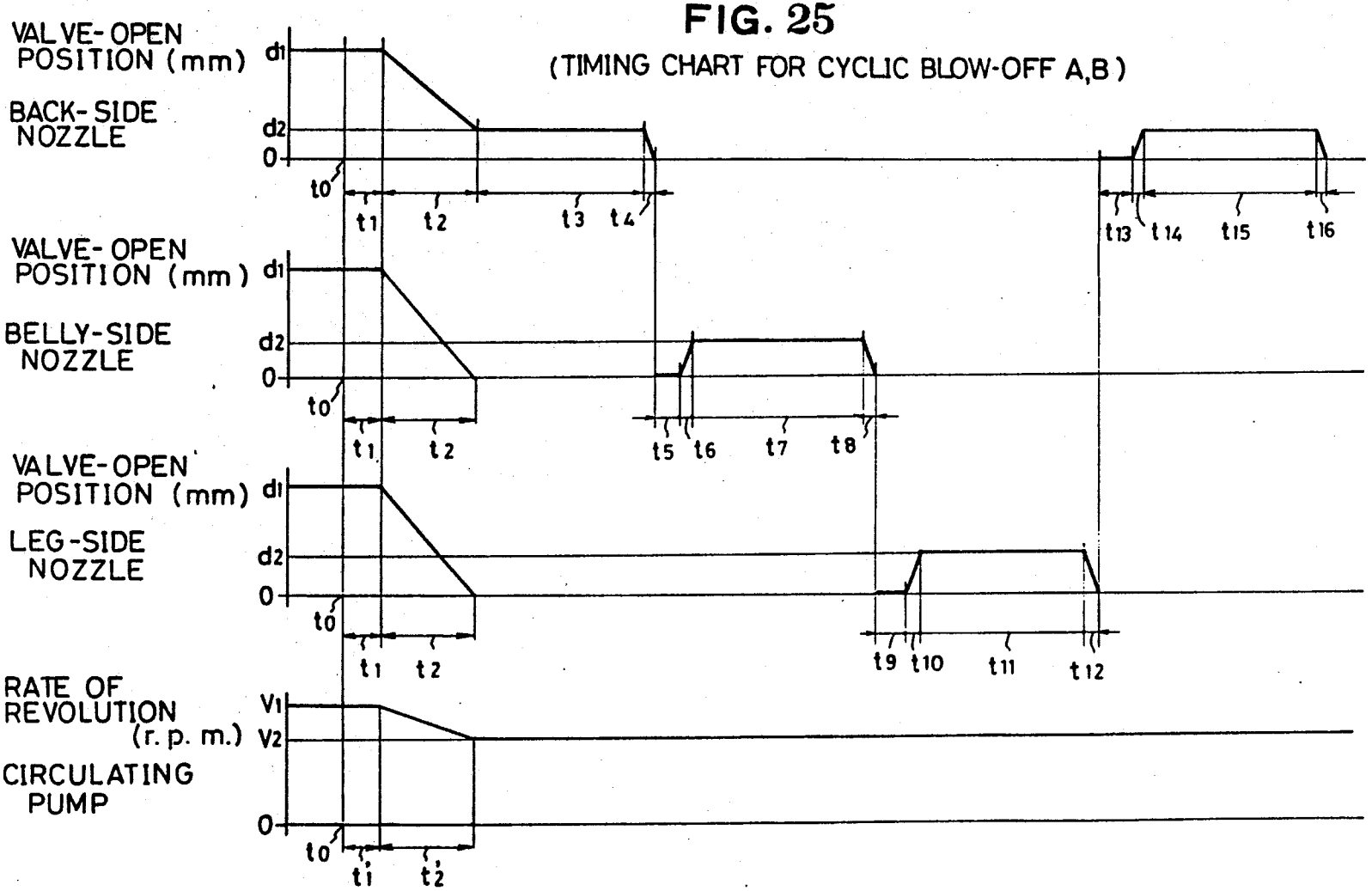
FIG. 25 is an operation timing chart of each blow-off nozzle and the circulating pump in cyclic blow-off patterns A and B.
Figure 26:
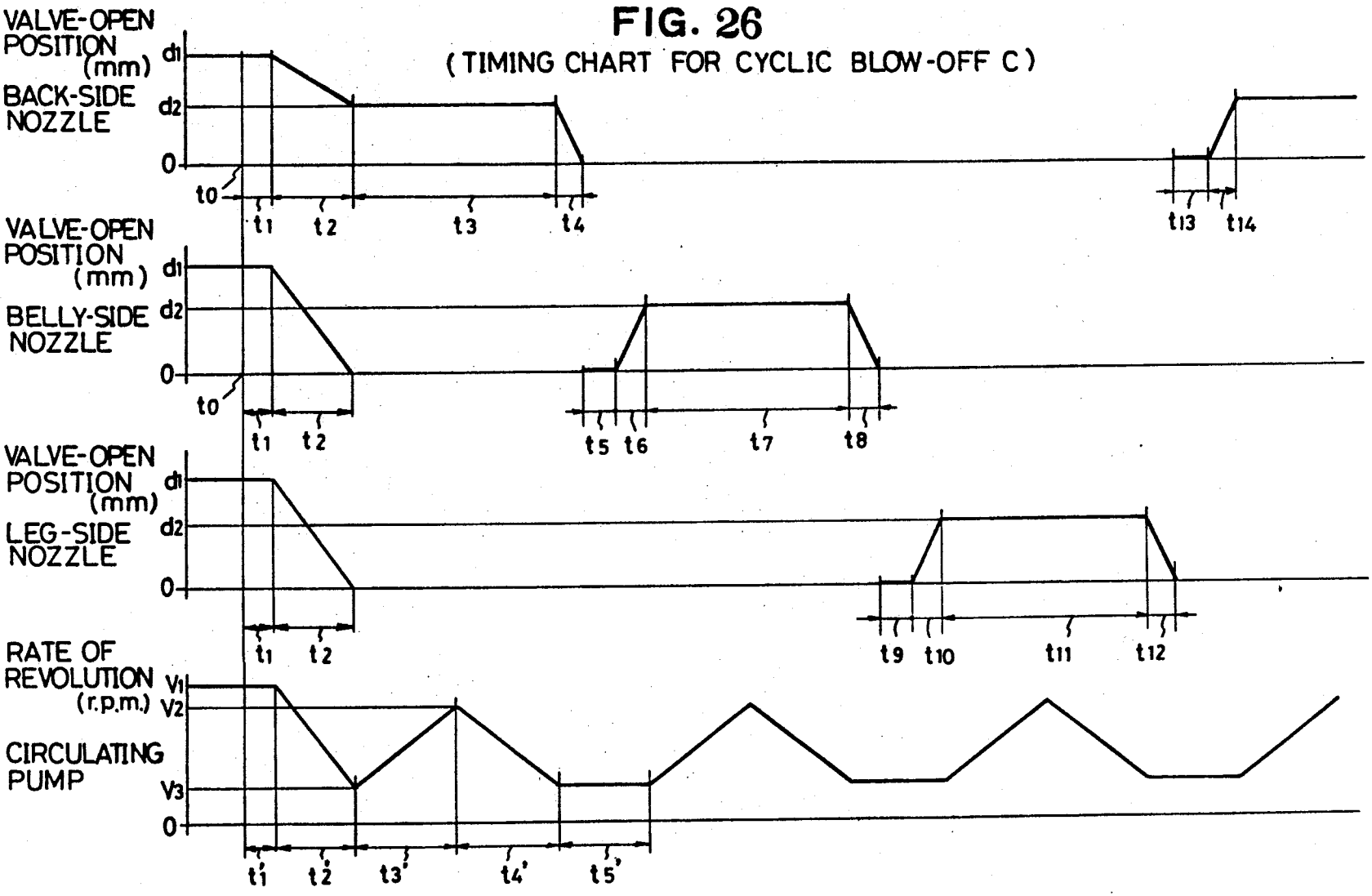
FIG. 26 is an operation timing chart of each blow-off nozzle and the circulating pump in a cyclic blow-off pattern C.

In this embodiment, there are set three kinds of cycle blow-off patterns A, B and C, which will be explained below with reference to the timing charts shown in FIG. 25 and 26.

The cycle blow-off A is performed in the spot blow-off mode. As shown in the timing chart of FIG. 25, after the lapse of a certain time $t_1$ (e.g. 0 sec) from the time $t_0$ when the cycle blow-off switch was operated, only the blow-off volume adjusting valves 22 in the back-side blow-off nozzles 3 are each operated from the open position $d_1$, before the blow-off mode change (e.g. a valve-open position 6 mm retracted from a fully closed position) up to a present open position $d_2$ (e.g. a valve-open position 1.5 mm retracted from the fully closed position) at a high speed (preferably the maximum speed) for a certain time $t_2$ (e.g. 1 sec), while the blow-off volume adjusting valves 22 in the leg- and belly-side blow-off nozzles 2, 4 are each operated up to a fully closed position at a high speed (preferably the maximum speed) for a certain time $t_2$ (e.g. 1 sec).

In this state, hot water is blown off in the spot blow-off mode from only the back-side blow-off nozzles 3, 3.

After the blow-off volume adjusting valves 22 in the back-side blow-off nozzles 3 are each held in the open position $d_2$ for a certain time $t_3$ (e.g. 2 sec), they are each operated up to the fully closed position at a high speed (preferably the maximum speed) for a certain time $t_4$ (e.g. 1 sec).

Then, after the lapse of a certain time $t_5$ (e.g. 0 sec), the blow-off volume adjusting valves 22 in the belly-side blow-off nozzles 4 which are closed are each operated up to the preset open position at a high speed (preferably the maximum speed) for a certain time $t_6$ (e.g. 1 sec), then after being held in the preset open position $d_2$ for a certain time $t_7$ (e.g. 2 sec), the valves 22 are each operated up to the fully closed position at a high speed (preferably the maximum speed) for a certain time $t_8$.

In this state, hot water is blown off in the spot blow-off mode from only the belly-side blow-off nozzles 4, 4.

Then, after the lapse of a certain time $t_9$ (e.g. 0 sec), the blow-off volume adjusting valves 22 in the leg-side blow-off nozzles 2 which are closed are each operated up to the preset open position $d_2$ at a high speed (preferably the maximum speed) for a certain time $t_{10}$ (e.g. 1 sec), then after being held in the preset open position $d_2$ for a certain time $t_{11}$ (e.g. 2 sec), the valves 22 are each operated up to the fully closed position at a high speed (preferably the maximum speed) for a certain time $t_{12}$ (e.g. 1 sec).

In this state, hot water is blown off in the spot blow-off mode from only the leg-side blow-off nozzles 2, 2.

Then, after the lapse of a certain time $t_{13}$ (e.g. 0 sec), the blow-off nozzle adjusting valves 22 in the back-side blow-off nozzles 3 which are closed are each operated up to the preset open position $d_2$ at a high speed (preferably the maximum speed) for a certain time $t_{14}$ (e.g. 1 sec), then after being held in the preset open position $d_2$ for a certain time $t_{15}$ (e.g. 2 sec), the valves 22 are each operated up to the fully closed position at a high speed (preferably the maximum speed) for a certain time $t_{16}$ (e.g. 1 sec).

In the circulating pump P, after the lapse of a certain time $t'_1$ (e.g. 0 sec) from the time $t_0$ when the cycle blow-off switch was operated, the rate of revolution $V_1$ before the blow-off mode change (e.g. 2800 r.p.m.) is decreased gradually to a certain rate of revolution $V_2$ (e.g. 2500 r.p.m.) within a certain time $t'_2$ (e.g. 1 sec). This rate of revolution $V_2$ is maintained during the blow-off operation.

The cycle blow-off B is performed in the spot blow-off mode. According to the cycle blow-off pattern B, in the timing chart of the cycle blow-off pattern A described above the certain time $t_3$, $t_7$, $t_{11}$ for maintaining the preset open position $d_2$ of the blow-off volume adjusting valves in the blow-off nozzles 2, 3, 4 is different (e.g. 4 sec). This is the only difference.

Thus, in the cycle blow-off patterns A and B, the blow-off volume adjusting valves 22 in the blow-off nozzles 2, 3, 4 are opened and closed at a certain period in the order of back belly→leg→back and the rate of revolution of the circulating pump is kept constant, so that the finger-pressure effect can be provided throughout the user's body while the spot blow-off position is changed.

The cycle blow-off pattern C is performed in the wave blow-off mode. As shown in the timing chart of FIG. 26, there is used a preset open position $d_2$ which (e.g. 4 mm) is larger than that in the cycle operations A and B, and the certain time $t_3$, $t_7$, $t_{11}$, for maintaining the preset open position $d_2$ is different (e.g. 8 sec) from that in the cycle blow-off patterns A and B.

Further, the rate of revolution of the circulating pump P is changed periodically.

More specifically, in the circulating pump P, after the lapse of a certain time $t'_1$ (e.g. 0 sec) from the time $t_0$ when the cycle blow-off switch was operated, the rate of revolution $V_1$ before the blow-off mode change (e.g. 2400 r.p.m.) is decreased gradually to a certain low rate of revolution $V_3$ (e.g. 1600 r.p.m.) within a certain time $t'_2$ (e.g. 1 sec), then the rate of revolution is gradually increased to a certain high rate of revolution $V_2$ within a certain time $t'_3$ (e.g. 4 sec), and thereafter the rate of revolution is gradually decreased to the certain low rate of revolution $V_3$ within a certain time $t'_4$ (e.g. 4 sec).

After such certain low rate of revolution $V_3$ is maintained for a certain time $t'_4$ (e.g. 1 sec), the change in the rate of revolution ($V_3 \rightarrow V_2 \rightarrow V_3$) described above is repeated.

Such changing of the rate of revolution ($V_1 \rightarrow V_2 \rightarrow V_3$) is performed only during the blow-off of hot water from the blow-off nozzles 2, 3, 4 and the timing is set to maintain the low rate of revolution $V_3$ during opening or closing operation of the blow-off volume adjusting valves 22 in the blow-off nozzles 2, 3, 4 and prevent an abrupt change in the blow-off strength, thereby preventing discomfort to the user.

This, together with the change in the blow-off position of hot water, permits the user to enjoy a hot water jet having the effect of waves which is characteristic of the wave blow-off mode.

Although in this embodiment the change of the hot water blow-off position in the cycle blow-off patterns A, B and C is performed in the order of back→belly→leg→back, this order is not a limitation. There may be adopted another order (e.g. back→leg→belly→back). It is also possible to change the hot water blow-off position irregularly.

(III-6) Program Blow-off

The program blow-off mode is a blow-off mode in which the change of blow-off is diversified by suitably combining or changing with time the selection of blow-off mode, that of blow-off strength and that of blow-off position in accordance with a preset program. This blow-off mode permits the user to enjoy a combined blow-off mode order having unexpectedness instead of the monotony of a fixed order.

In this embodiment, moreover, a plurality of different contents of programs are provided in consideration of the age and gender of users. Selection can be made from among program blow-off A which is a standard blow-off operation having the most general menu, program blow-off B which is a strong blow-off operation having a blow-off menu stronger than the general menu, and program, blow-off C which is a mild blow-off operation having a blow-off menu milder than the general menu.

TABLE 1

| Program | Blow-off Key Word | Blow-off Contents | Program Blow-off Specification: Item | Rank: 1 (50% probability) | 2 (30% probability) | 3 (20% probability) |
|---|---|---|---|---|---|---|
| Program Blow-off A | Standard Blow-off | Blow-off program having the most general menu 4-minute blow-off | Blow-off mode | Mild blow-off Spot blow-off Pulse blow-off Wave blow-off A Cycle blow-off A | Pulse blow-off A Wave blow-off C Cycle blow-off C | Pulse blow-off C Wave blow-off B Cycle blow-off B |
| | | | Strength level | 3 | 2 | 4 |
| | | | Blow-off position | (back-belly-leg) | (back) (belly) (leg) | (back-belly) (belly-leg) (back-leg) |
| Program Blow-off B | Strong Blow-off | Blow-off program having the strongest menu 5-minute blow-off | Blow-off mode | Spot blow-off Pulse blow-off B Wave blow-off A | Wave blow-off B Cycle blow-off A | Mild blow-off Pulse blow-off A Cycle blow-off B |
| | | | Strength level | 4 | 5 | 3 |
| | | | Blow-off position | (back-belly-leg) | (back) (belly) (leg) | (back-belly) (belly-leg) (back-leg) |
| Program Blow-off C | Mild Blow-off | Blow-off program having the mildest menu 3-minute blow-off | Blow-off mode | Wave blow-off C Mild blow-off Cycle blow-off C | Wave blow-off C Pulse blow-off C Cycle blow-off B | Wave blow-off B Pulse blow-off B |
| | | | Strength level | 2 | 1 | 3 |
| | | | Blow-off position | (back-belly-leg) | (back) (belly) (leg) | (back-belly) (belly-leg) (back-leg) |

In Table 1, the ranks 1, 2 and 3 represent three stages of occurrence probabilities of blow-off modes in three divided groups of the foregoing plural blow-off modes. The occurrence probability of the blow-off modes belonging to rank 1 is 50%, that of the blow-off modes belonging to rank 2 is 30%, and that belonging to rank 3 is 20%.

The blow-off strength level is set in five stages, which are weak 1, medium weak 2, medium 3, medium strong 4 and strong 5.

In the program blow-off A, the blow-off strength level is set to 2–4 in order to perform a standard blow-off operation; in the program blow-off B, the blow-off strength level is set to 3–5 in order to perform a hard blow-off operation; and in the program blow-off C, the blow-off strength level is set to 1–3 in order to perform a light blow-off operation.

As to the hot water blow-off positions, there are the case where hot water is blown off from the leg-, back- and belly-side blow-off nozzle sets 2, 3, 4 at a time, the case where hot water is blown off from any two of those sets, and the case where hot water is blown off from any one of those sets. Such simultaneous three-set blow-off is indicated as (leg-back-belly); such simultaneous two-set blow-off is indicated as (leg-back) (back-belly) (leg-belly) and such one set blow-off is indicated as (leg) (back) (belly).

The blow-off modes, blow-off strength levels, and hot water blow-off positions are each changed over from one to another after the lapse of a certain time (e.g. 30 sec) to give the pleasure of change to the user continuously, thereby preventing the user from becoming weary.

As to the blow-off modes, consideration is made to prevent continuous appearance of the same mode, thereby ensuring the pleasure of change being given to the user.

In each of the program blow-off patterns A, B, and C it is possible to set the blow-off time constant. In this embodiment, the program blow-offs A, B, and C are set at 4, 5, and 3 minutes, respectively.

If several kinds of menus are set for each of the program blow-offs A, B, and C and any one program blow-off is selected, the selection of menus can be made irregularly from the selected program blow-off.

Thus, in the program blow-offs A, B, and C, the change of blow-off mode, blow-off strength and blow-off nozzle sets is done irregularly in consideration of age and gender, so the user can fully enjoy the unexpectedness of the change and of the order of the change and is thereby prevented from becoming weary while taking a bath.

(IV) DESCRIPTION OF THE OPERATION OF THE WHIRLPOOL BATH

(IV-1) Description of Operation Procedure based on Flowcharts

The operation of the whirlpool bath A described above will be explained below with reference to the flow charts of FIGS. 27 to 32.

Figure 27:
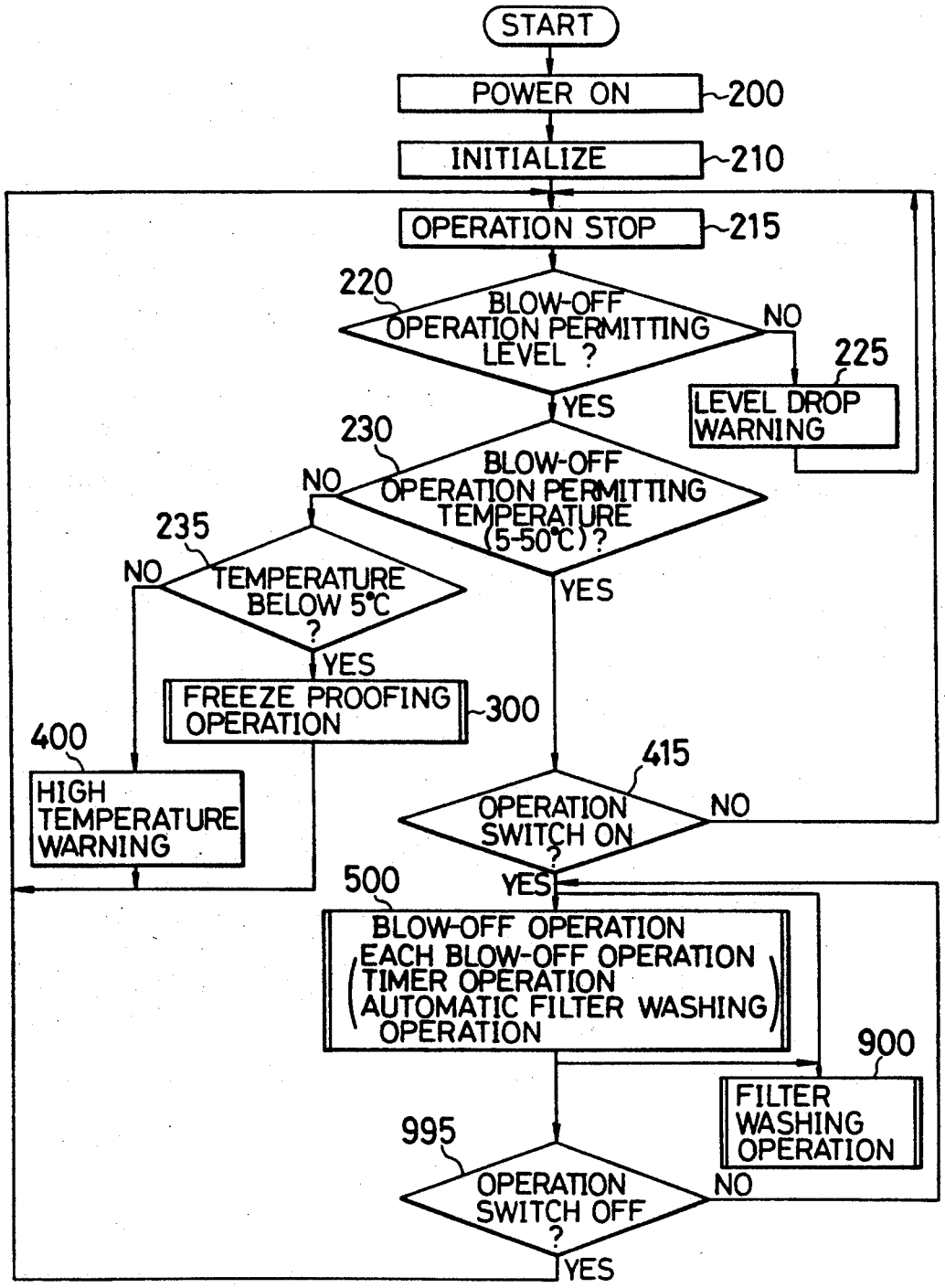
FIGS. 27 to 32 are operational flow charts of the whirlpool bath.

First reference is here made to the main routine shown in FIG. 27.

The plug of the controller C, etc. is inserted into the power source for the supply of electric power thereto (200).

The nozzle valve actuating motors M1 in all of the leg-, back- and belly-side blow-off nozzles 2, 3, 4 are initialized (210).

Subsequently, the whirlpool bath A turns OFF (215). In this OFF condition, the various actuators for the circulating pump P connected to the whirlpool bath A and the blow-off nozzles 2, 3, 4 are turned OFF.

At this time, in the nozzles 2, 3, 4, the nozzle valve actuating motors M1 are in an initialized condition, that is, the valves are in an open condition retracted 6 mm from their fully closed positions, thereby permitting smooth supply and discharge of hot water during the supplying and draining of hot water.

In this OFF condition, moreover, the controller C is receptive to input, and also in this condition there can be made control by the controller C for the hot water supply operation and the freeze proofing operation in accordance with the results of detection provided from the pressure sensor 48 and the hot water temperature sensor T.

Next, the pressure sensor 48, which also serves as a level sensor, detects whether the hot water level in the bathtub body 1 has reached a blow-off operation permitting level (e.g. a level higher than the level of the uppermost edge of the suction port 1*m* provided in the bathtub body 1) (220).

In the present invention, in order to ensure the blow-off operation, the level of the uppermost edge of the suction port 1*m* is the lowest level permitting the circulation of hot water in the hot water circulation path D, and this level is used as one condition for the start of the blow-off operation. This blow-off operation starting condition will be described in detail later.

When the hot water level has not reached the blow-off operation permitting level (220N), warning of a low level is issued (225) and the operation is stopped (215). In this case, the warning of a low level is effected by flashing the indication "L" on the clock display portion 115 of the operating panel over a period of 15 seconds and at the same time sounding a buzzer (not shown). In a bathtub provided with an automatic hot water supplying apparatus, it is possible to perform automatically a hot water replenishing operation.

When the hot water level satisfies the blow-off operation permitting level (220Y), the hot water temperature sensor T detects whether the hot water temperature in the bathtub body 1 is within a blow-off operation permitting range (e.g. 5°~50° C.) (230).

In this embodiment, the blow-off operation permitting hot water temperature range is determined in consideration of the protection of the user and of pipes made of a synthetic resin and freeze proofing of the hot water in the circulating pump P, and the temperature range is used as one condition for the start of the blow-off operation. This blow-off operation starting condition will be described in detail later.

As a result, in the case of a lower temperature than the lower limit (e.g. 5° C.) of the blow-off operation permitting temperature range (235Y), the freeze proofing operation is started (300).

Figure 32:
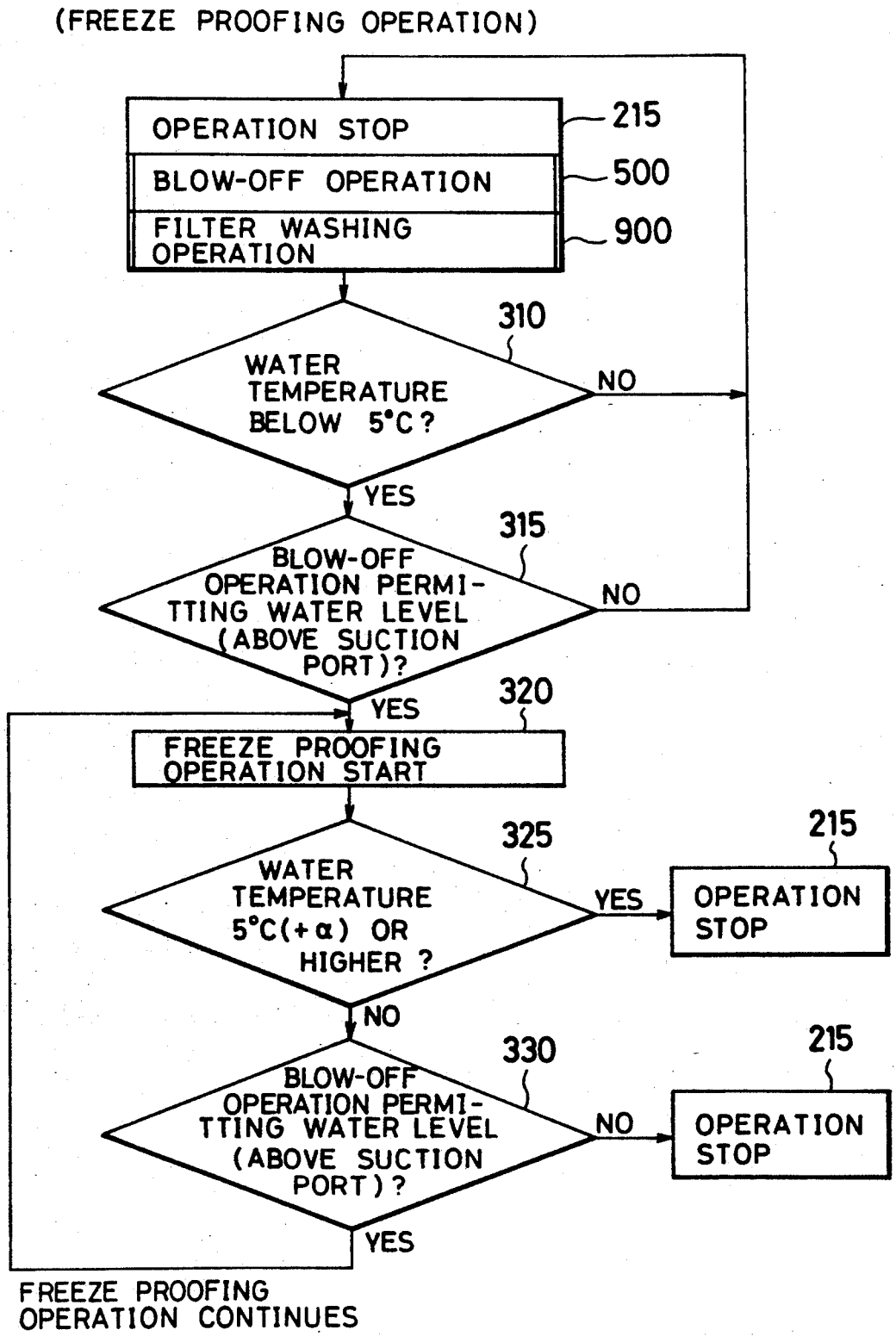

Such freeze proofing operation will be described later with reference to the subroutine shown in FIG. 32.

In the case of a higher temperature than the upper limit (e.g. 50° C.) of the blow-off operation permitting temperature range (235N), there issues warning of a high temperature (400) and the operation is stopped (215). In this case, the warning of a high temperature is effected by flashing the indication "H" which indicates a high water temperature on the clock display portion 115 of the operating panel 6 over a period of 15 seconds and at the same time sounding a buzzer.

In the case of a blow-off operation permitting hot water temperature (230Y), the blow-off operation can be started (500) by turning ON the operation switch 100 or 260 (415Y).

The "blow-off operation" (500) is a generic term for the blow-off operations in the various blow-off modes, a timer operation in which blow-off operation is performed within the time preset by the user, and an automatic filter washing operation in which the filter 4 is washed automatically in parallel with the blow-off operation. Each blow-off operation, timer operation and automatic filter washing operation will be described later with reference to the subroutines shown in FIGS. 28, 29, and 30.

Upon turning OFF of the operation switch 100 or 260 (995Y), the operation is stopped (215). As long as the operation switch 100 or 260 is not turned OFF, the blow-off operation is continued.

Further, by turning ON the operation switch 100 or 260 (415) it becomes possible to effect the filter washing operation just before or after the blow-off operation (500), and the filter washing operation can be started by turning ON the filter washing switch 117 (900). This filter washing operation will be described later with reference to the subroutine shown in FIG. 31.

Figures 28, 28A:
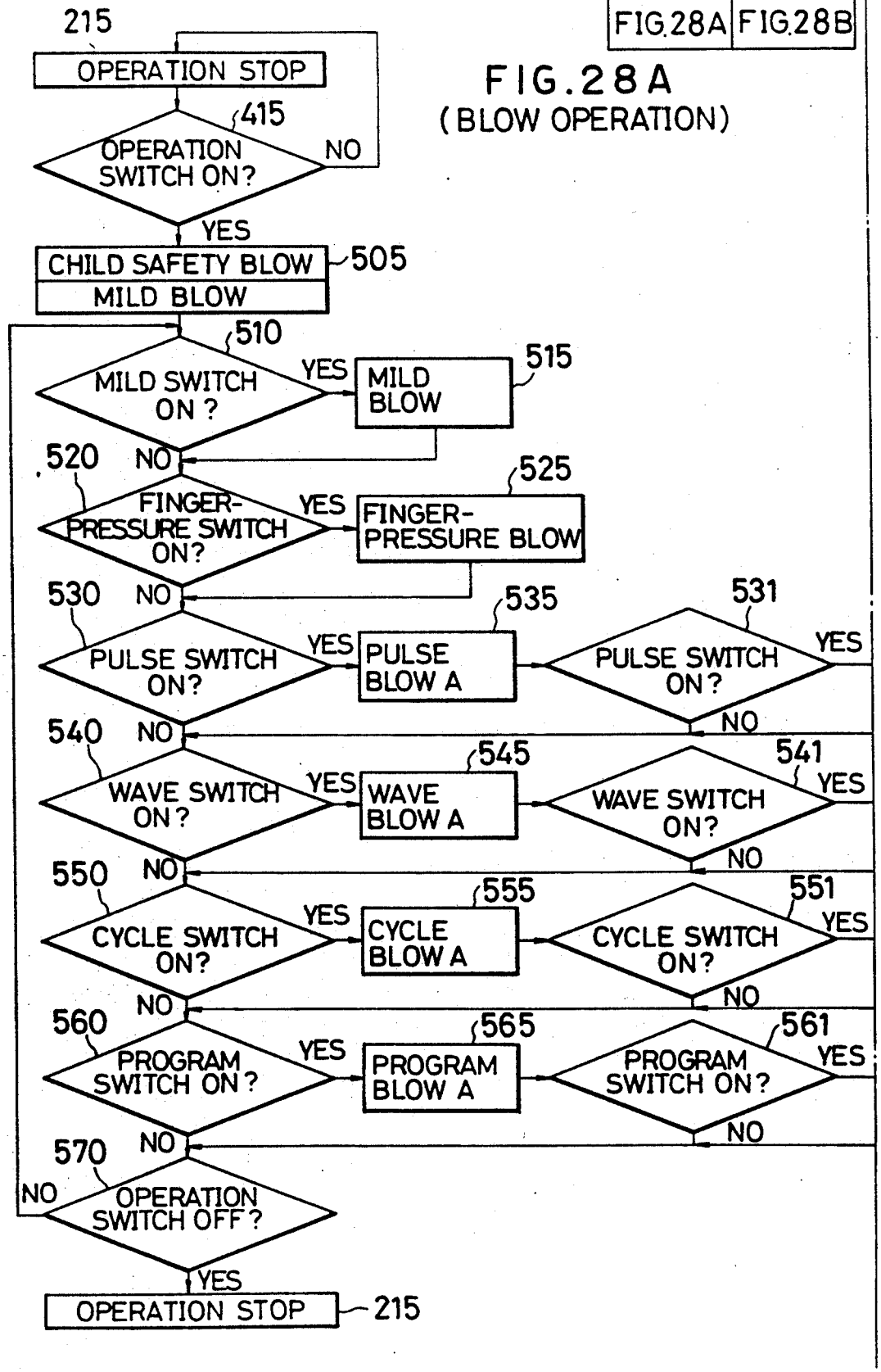
Figure 28B:
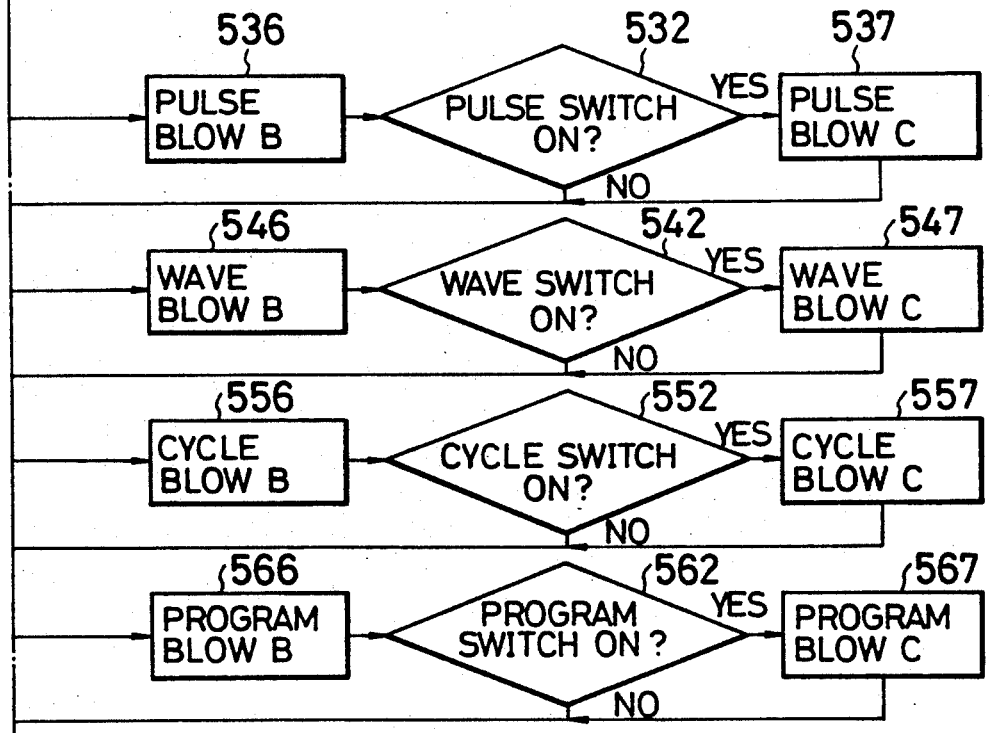

The above blow-off operation will be described below with reference to the subroutine shown in FIG. 28.

BLOW-OFF OPERATION

The blow-off operation is programmed so that the initial blow-off is a child safety blow-off or a mild blow-off (505) and the strength level is set to "Medium" (510), whereby the occurrence of accidents is prevented such as the legs of a child being carried away by the hot water jet at the time of beginning of the operation and the child falling down.

In this state of child safety blow-off, a desired blow-off operation can be selected by turning ON a blow-off mode switch.

More specifically, other than the mild blow-off operation, the spot blow-off operation can be started (525) by turning ON the spot blow-off switch 102 or 262 (520).

The pulse blow-off operations A, B, and C can be performed (535)(536)(537) by turning ON the pulse blow-off switch 103 or 263 (530)(531)(532).

The wave blow-off operations A, B, and C can be performed (545)(546)(547) by turning ON the wave blow-off switch 104 or 265 (540)(541)(542).

The cycle blow-off operations A, B, and C can be performed (555)(556)(557) by turning ON the cycle blow-off switch 105 or 266 (550)(551)(552).

Further, by turning ON the program switch 106 or 267 (560)(561)(562) there can be performed each program blow-off operation (565)(566)(567).

For returning to the mild blow-off (515) from another blow-off mode, the mild blow-off switch 101 or 261 is again turned ON (510).

All the blow-off operations can be stopped (OFF condition) by turning OFF (570Y) the operation switch 100 or 260.

In this embodiment, moreover, in order to meet the user's desires as far as possible, there can be performed the operation for changing the hot water blow-off position in the cases of mild blow-off operation, spot blow-off operation, pulse blow-off operation and wave blow-off operation.

Further, the operation for changing the strength level of hot water to be blown off can be performed in the cases of the mild blow-off, spot blow-off, pulse blow-off, wave blow-off and cycle blow-off operations.

Such operations for changing the hot water blow-off position and strength level will be described later.

Figure 29:
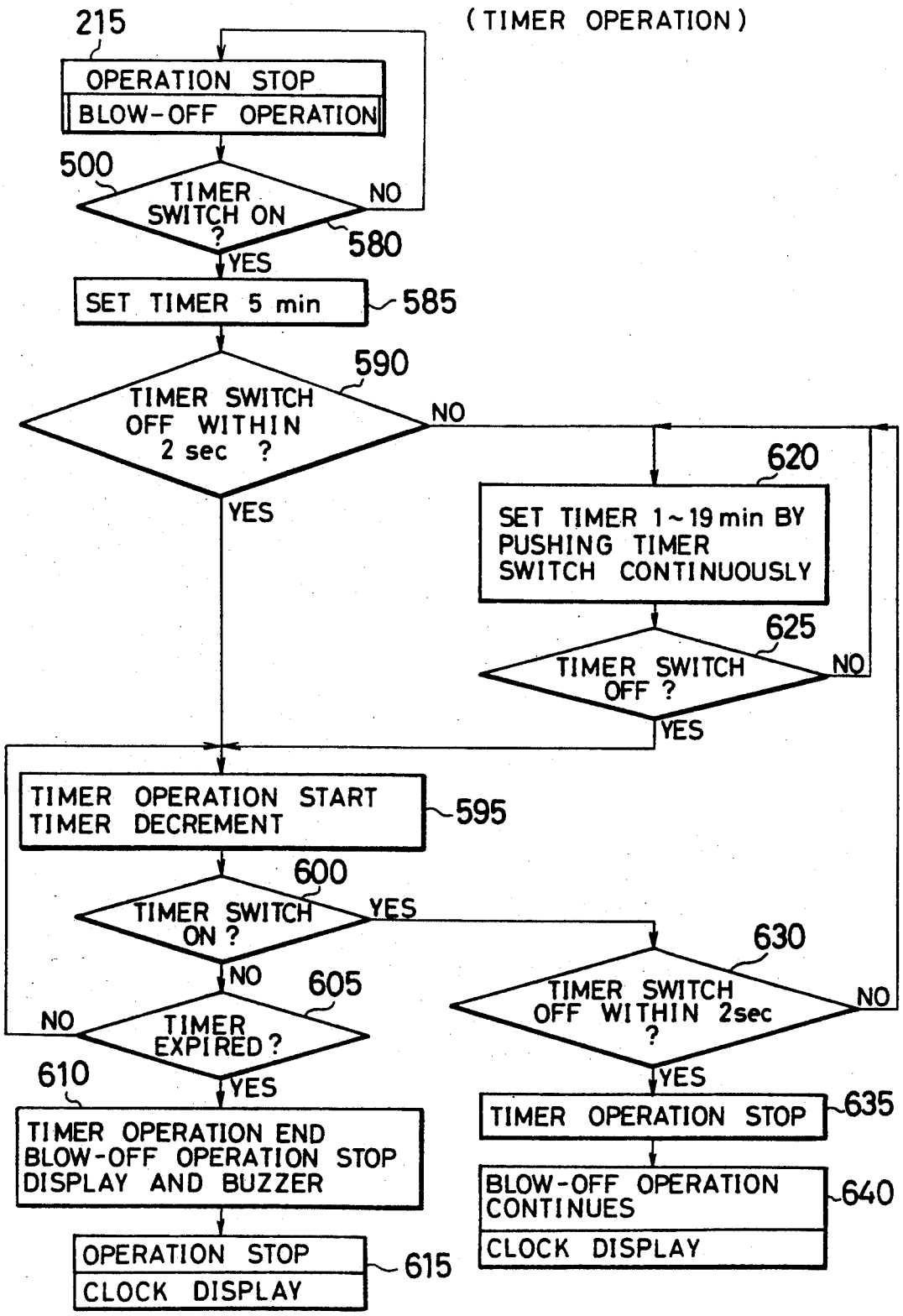

Next, the timer operation will be described below with reference to the subroutine shown in FIG. 29.

TIMER OPERATION

The timer operation permits the user to set a desired blow-off operation time and makes it possible to prevent the user from having a rush of blood to the head. The timer operation will be described below.

The timer operation is started as follows. When the timer switch 114 is pushed ON (580Y) after pushing ON the operation switch 100 on the operating panel 6, the clock display of the clock display portion 115 which makes a digital display using a light emitting diode changes to a timer display, for example, "5" which indicates 5 minutes set as a minimum blow-off operation time, and thus it is possible to set "5 minutes" for the timer (585). If the timer switch 114 is turned OFF within a certain time (e.g. 2 sec) (590Y), the timer display becomes "5:00" after the lapse of 2 seconds and the timer operation is started.

The numerical value of the timer display decreases every second (595).

When the timer operation time has elapsed and the timer display has become "0:00" (605), the user not having turned ON the timer switch 114 during the timer operation (600N), the timer display is turned on and off every 0.5 second for the period of 5 seconds and the buzzer is allowed to sound. Thereafter, upon termination of the timer operation (610), the operation is stopped and a return is made to the timer display (615).

Where it is desired to set the time for the timer to any other time than the above 5 minutes, by pushing the timer switch 114 continuously for 2 seconds or more (590N) the above indication "5" is increased every 0.5 second in the unit of one minute, and since the numerical value returns to "1" after reaching a preset maximum value (e.g. "19"), it is possible to set a desired blow-off operation time in the range of, for example, 1 minute to 19 minutes (620).

If the timer switch 114 is turned OFF when a desired value (e.g. "9") has appeared (625Y), then in 2 seconds thereafter a desired timer time (e.g. "9:00") is indicated and the numerical value of this timer display decreases every second (595).

If the timer switch 114 is turned ON (600) and then OFF within 2 seconds (630Y) during the timer operation, the timer operation is stopped at that time point (635) and the display returns from the timer display to the clock display. In this case, the blow-off operation is continued (640).

If the timer switch 114 is pushed ON continuously for 2 seconds or more (630N), the timer display becomes a timer setting display corresponding to the minute indicated at that time point plus one minute, and by continuing the depression of the timer switch 114 the timer operation time can be increased every 0.5 second in the unit of one minute (620).

If the timer switch 114 is turned OFF when a desired numerical value has appeared (625Y), then in 2 seconds thereafter the desired time for the timer is indicated and then the value indicated decreases every second (595).

The timer operation takes priority over the blow-off operation and can be performed (including operation stopping) regardless of the blow-off mode.

In all the operation timings relating to the timer operation, such as during timer operation and during timer setting, the timer time is indicated by lighting of a light emitting diode on the clock display portion 115 of the operating panel 6. The clock display portion 115 continues to light when clock indication is not made.

Therefore, the timer setting operation can be done in a simple manner.

When there is no operation switch input for a certain time (e.g. 30 minutes) in the state of blow-off operation, the blow-off operation is stopped.

Thus, by stopping the blow-off operation after the lapse of a certain time it is intended to prevent the continuance of blow-off operation over a long time caused by the user forgetting to stop the blow-off operation and thereby attain power saving and protection of the circulating pump and pipes.

Also when the blow-off operation is stopped by the timer as set forth above, this condition is announced by the sounding of a buzzer for 5 seconds just after the stopping of the operation.

Figure 30:
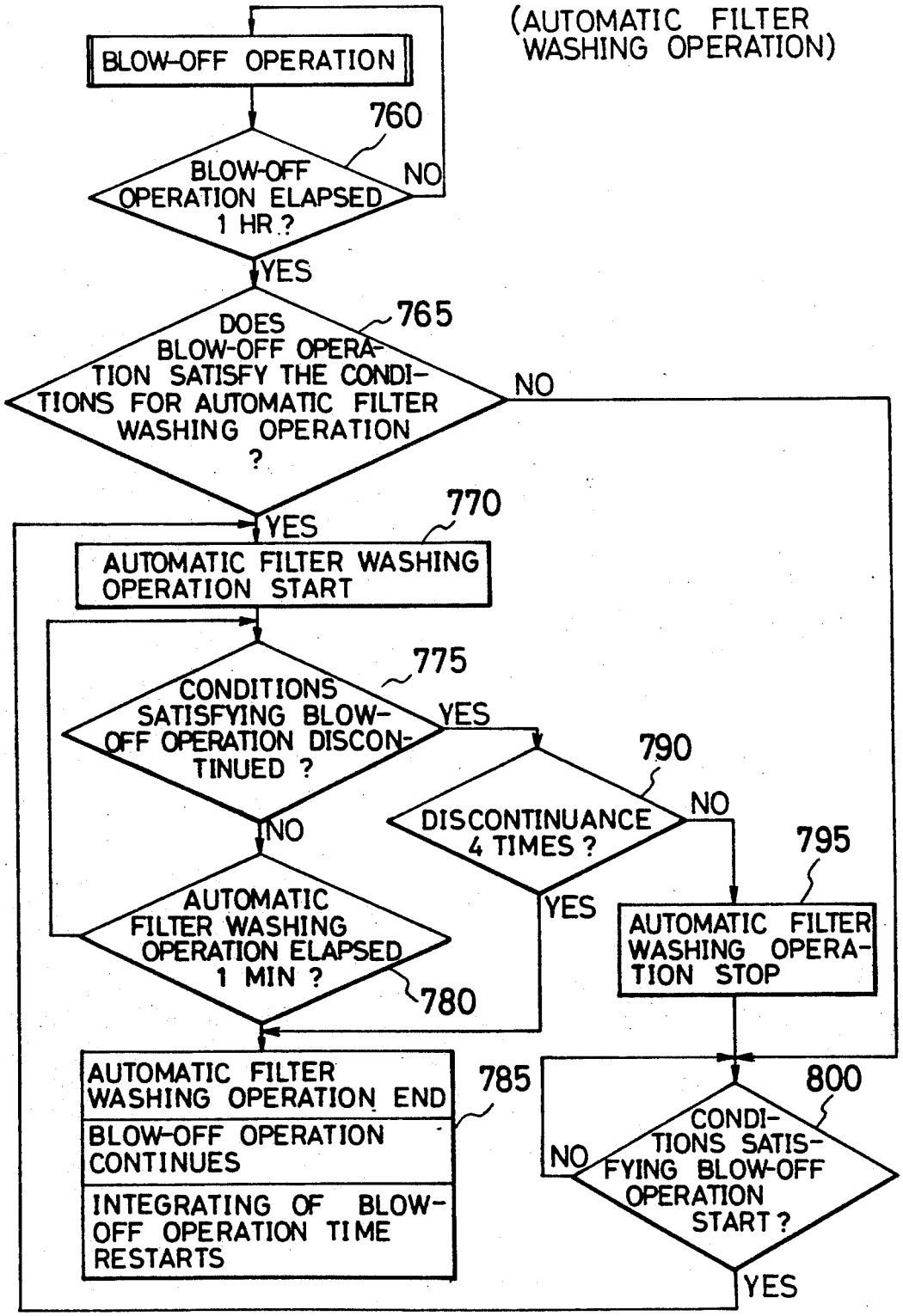

Next, the automatic filter washing operation will be described below with reference to the subroutine shown in FIG. 30.

AUTOMATIC FILTER WASHING OPERATION

In the automatic filter washing operation, the washing of the filter 43 is performed automatically in parallel with blow-off operation. The automatic filter washing operation is started (770) in the case of a blow-off operation (765Y) in which a certain (e.g. 1 hour) integrated time (from the start-up of the circulating pump P) of the blow-off operation has elapsed (760Y), provided that the automatic filter washing conditions are satisfied.

The automatic filter washing conditions as referred to herein mean that the blow-off operation permitting hot water level and temperature are satisfied, that the blow-off mode is any of mild blow-off, spot blow-off, wave blow-off and cycle blow-off modes, and that the strength level is any of strong, medium strong and medium.

The automatic filter washing operation terminates upon lapse of a certain time (e.g. 1 min) of the same operation, while the blow-off operation continues and the integrating of time of the blow-off operation restarts (785).

When the automatic filter washing conditions are no longer satisfied (discontinued) due to the change of the blow-off mode or of the strength level during the automatic filter washing operation (775Y) and when the number of times of retrying after discontinuance is smaller than a certain number of times (e.g. 4) (790N), the automatic filter washing operation is discontinued (795), and thereafter when a blow-off operation satisfying the automatic filter washing conditions is started (800Y), the automatic filter washing operation is started (770).

On the other hand, when the number of times of discontinuance in the automatic filter washing operation has reached a certain number of times, the automatic filter washing operation terminates (785) This is for preventing evacuation of the bathtub body 1 caused by retrying indefinitely.

In the case of a blow-off operation not satisfying the automatic filter washing conditions despite a certain (e.g. 1 hour) integrated time of the blow-off operation having elapsed (765N), the automatic filter washing operation is started upon starting of a blow-off operation which satisfies the automatic filter washing conditions (800Y).

Figure 31:
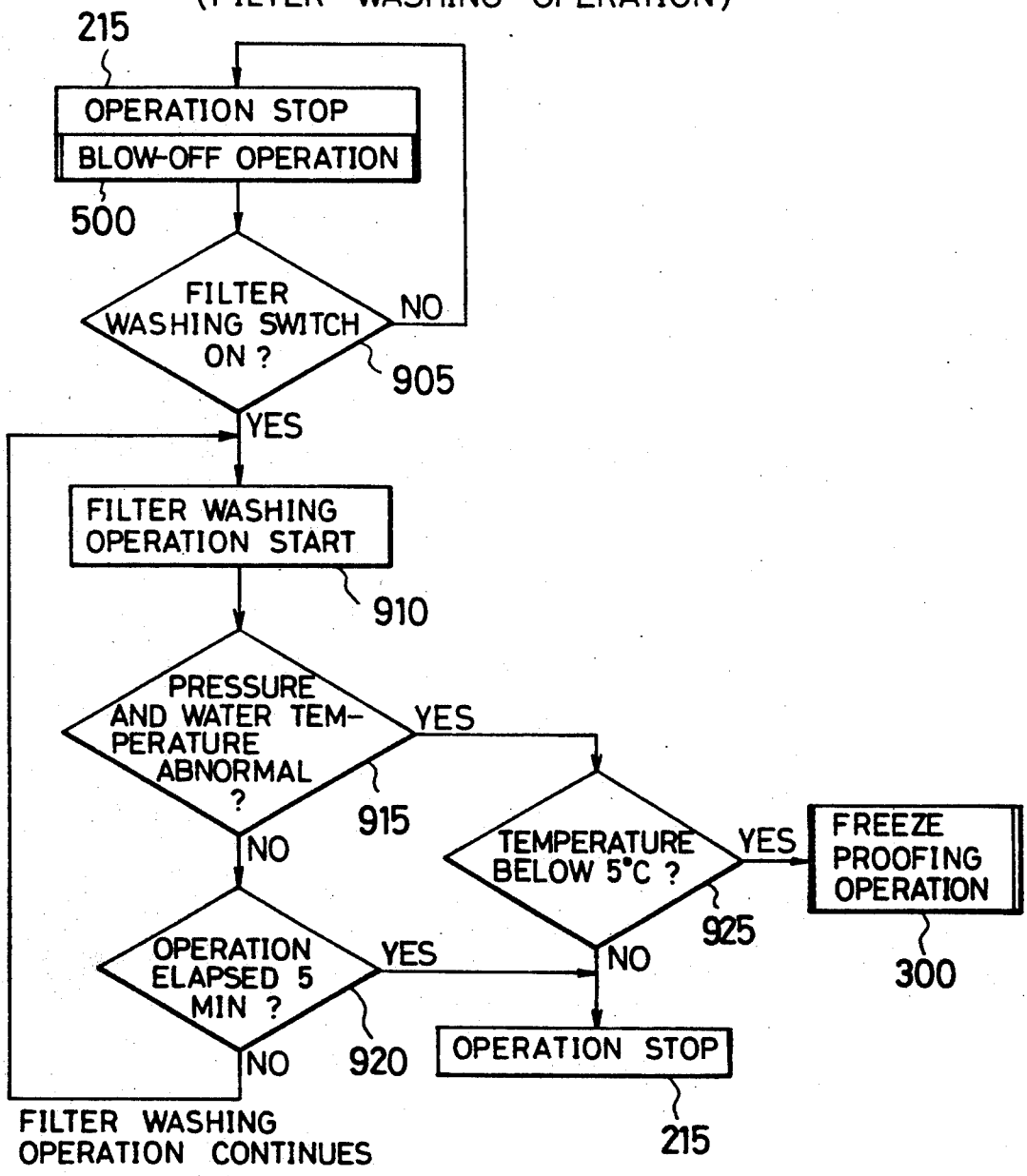

Next, the filter washing operation will be described below with reference to the subroutine shown in FIG. 31.

FILTER WASHING OPERATION

The filter washing operation can be performed in precedence over the blow-off operation by turning ON the filter washing switch 117 before or after or during the blow-off operation provided the operation switch 100 or 260 has been turned ON.

When the filter washing switch 117 is turned ON (905Y), the filter washing operation starts (910), and if there is no abnormal condition in the discharge pressure of the circulating pump P detected by the pressure sensor 48 and in the hot water temperature in the bathtub body 1 detected by the hot water temperature sensor T, that is, if the pressure and hot water temperature are blow-off operation permitting pressure and temperature (915N), the filter washing operation is continued for a certain time (e.g. 5 min) and after the lapse of the certain time (920Y) the operation stops (215).

In the filter washing operation, the rate of revolution of the circulating pump P is set to, for example, 3000 r.p.m., and the blow-off nozzle adjusting valves 22 in the leg- and back-side blow-off nozzles 2, 3 are slightly opened, for example, 0.5 mm backward from their fully closed positions, with only the blow-off volume adjusting valves 22 in the back-side blow-off nozzles 4 being fully closed.

If the pressure and water temperature are not normal (915V), there is made detection as to whether the water temperature is lower than the lower limit (e.g. 5° C.) of the blow-off operation permitting temperature range, and if the answer is affirmative (925Y), the freeze proofing operation (300) is started, while if the answer is negative, that is, if the hot water temperature is higher than the upper limit (e.g. 50° C.) of the aforementioned temperature range (925N), the operation stops (215).

Next, the freeze proofing operation will be described below with reference to the subroutine shown in FIG. 32.

FREEZE PROOFING OPERATION

The freeze proofing operation is performed to prevent freezing of the water in the circulating pump P and in the hot water circulation path D. It is performed in precedence over the blow-off operation, and when the water temperature becomes lower than the lower limit (e.g. 5° C.) of the blow-off operation permitting temperature range during the blow-off operation, automatically the blow-off operation is stopped and the freeze proofing operation is started.

First, the hot water temperature in the hot water circulation path D is detected by the hot water temperature sensor T, and if the detected temperature is lower than the lower limit (e.g. 5° C.) of the blow-off operation permitting temperature range (310Y), the water level in the bathtub body 1 is detected by the pressure sensor 48 which also serves as a level sensor. If the detected level is a blow-off operation permitting level (e.g. a level higher than the uppermost edge of the suction port 1*m*) (315Y), the freeze proofing operation is started (320).

In the freeze proofing operation, the circulating pump P is rotated at a low speed (e.g. 1000 r.p.m.) by inverter control to circulate water through the hot water circulation path D.

In this case, if the water temperature is lower than the lower limit (e.g. 5° C.) of the blow-off operation permitting temperature range plus the temperature $\alpha$ (e.g. 2°-3° C.) corresponding to the hysteresis in the hot water temperature sensor T (325N) and if the water level in the bathtub body 1 is the blow-off operation permitting level (330Y), the freeze proofing operation is continued. During the freeze proofing operation, the indication "C" indicating a low water temperature flashes on and off every second on the clock display portion 115 of the operating panel 6.

If by additional supply of hot water the water temperature rises to the lower limit of the blow-off operation permitting temperature range or higher or to the temperature which is the aforementioned lower limit temperature plus the temperature $\alpha$ corresponding to the hysteresis in the hot water temperature sensor T or higher (325Y), the operation stops (215).

Main operations in the operation procedure of the whirlpool bath described above will be further explained below.

(IV-2) Description of Conditions for Starting Blow-off Operation

The blow-off operation in the foregoing operation procedure is started only when preset water level and temperature conditions in the bathtub body 1 are satisfied.

Figure 33:
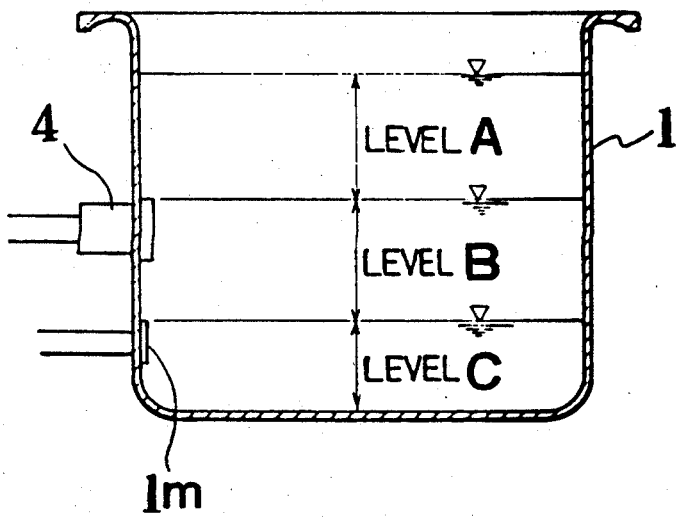
FIG. 33 is an explanatory view of reference positions for water level detection.

More specifically, as shown in FIG. 33, the water level condition is determined on the basis of the suction port 1*m* and the belly-side blow-off nozzles 4 both provided in the bathtub body 1. A water level higher than the uppermost edge of the opening of each belly-side blow-off nozzle 4 is designated water level A; a water level between the uppermost edge of the opening of each belly-side blow-off nozzle 4 and the uppermost edge of the suction port 1*m* is designated water level B; and a water level lower than the uppermost edge of the suction port 1*m* is designated water level C. When the water level is A or B, the blow-off operation is started, while when the water level is C, the blow-off operation is not started.

Further, when the water level is changed from A or B to C during the blow-off operation, the blow-off operation is stopped.

In this case, even if the water level is returned to B or A from C by additional supply of hot water for example, the blow-off operation is held OFF, and by again turning ON the operation switch the OFF state initiated by the level drop can be cancelled, thereby attaining sureness and safety of operation.

In this connection, in the clock display portion 115 of the operating panel 6, the indication "L" indicating a level drop is turned on and off for 15 seconds alternately every second by means of a light emitting diode, and at the same time warning is given by sounding of a buzzer.

Figure 34:
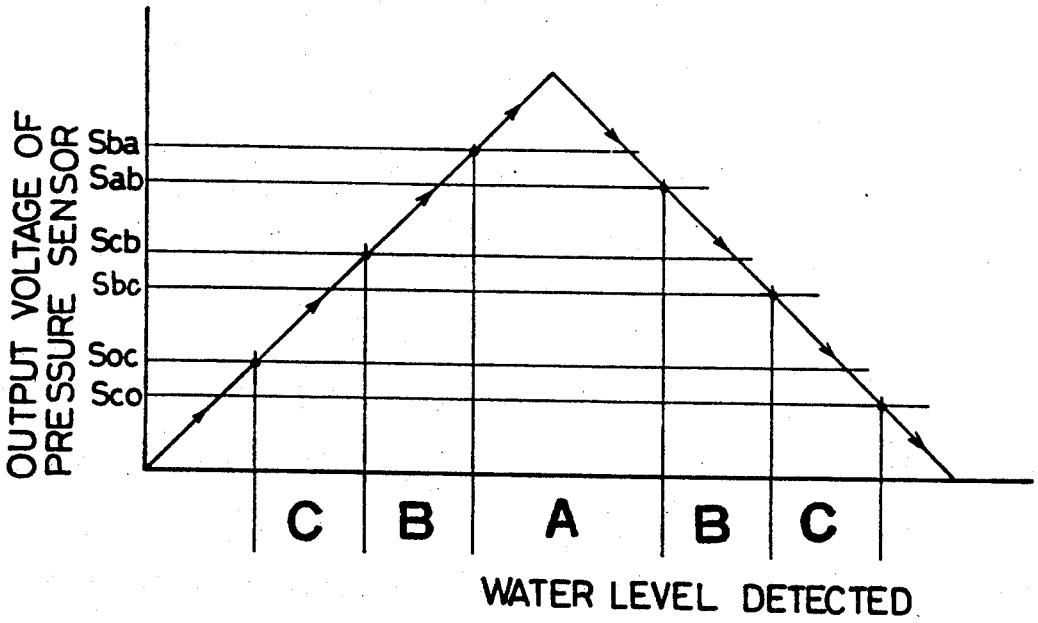
FIG. 34 is an explanatory view of a level detecting method.

Detection of the water levels A, B, and C is performed in such a manner as shown in FIG. 34. In consideration of rippling of the hot water surface when the user enters or leaves the bathtub, the output voltage of the pressure sensor 48 which serves as a level sensor is provided with hysteresis to prevent hunting, whereby the controlling operation of the controller C can be done smoothly through the pressure sensor 48.

In FIG. 34, Soc represents a threshold value from a water level lower than the level C to the level C; Scb represents a threshold value from the level C to the level B; Sba represents a threshold value from the level B to the level A; Sab represents a threshold value from the level A to the level B; Sbc represents a threshold value from the level B to the level C; and Sco represents a threshold value from the level C to a lower water level.

Hysteresis is provided between the threshold values Soc and Sco, between the threshold values Scb and Sbc, and between the threshold values Sba and Sab.

The water temperature uppermost limit is determined taking into account the protection of the user and of pipes made of a synthetic resin, e.g. 50° C., and the lower limit is determined taking into account the prevention of freezing of the water in the circulation pump P, e.g. 5° C. The water temperature higher than 50° C. is designated the water temperature A'; the water temperature in the range of 5° C. to 50° C. is designated the water temperature B'; and the water temperature lower than 5° C. is designated the water temperature C'. The blow-off operation is performed at the water temperature B' and not performed at the water temperature A' or C'.

When the water temperature changes from B' to A' or C' during the blow-off operation, the operation is stopped.

In this case, even if the water temperature is returned to B' from A' by additional supply of water for example, the blow-off operation is kept OFF, and only by again turning ON the operation switch the OFF state caused by the rise of the temperature can be cancelled to ensure sureness and safety of operation.

In this case, the indication "H" indicating a high water temperature is turned on and off alternately every second for 15 seconds by means of a light emitting diode on the clock display portion 115 of the operating panel 6, and at the same time a buzzer will sound to give warning.

Figure 35:
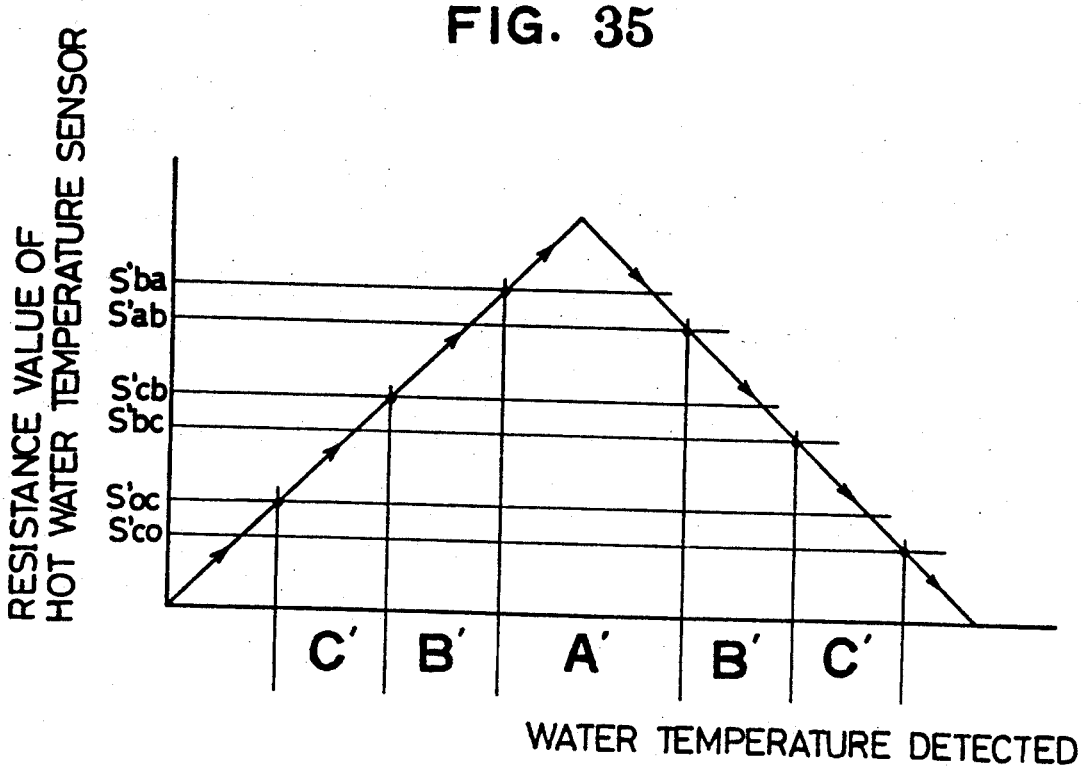
FIG. 35 is an explanatory view of a water temperature detecting method.

The water temperatures A', B', and C' are detected in such a manner as shown in FIG. 35. In consideration of rippling of the hot water surface when the user enters or leaves the bathtub, the resistance value of the hot water temperature sensor T is provided with hysteresis to prevent hunting, whereby the controlling operation of the controller C can be done smoothly.

In FIG. 35, S'oc represents a threshold value from a temperature lower than the water temperature C' to the temperature C'; S'cb represents a threshold value from the temperature C' to B'; S'ba represents a threshold value from the temperature B' to A'; S'ab represents a threshold value from the temperature A' to B'; S'bc represents a threshold value from the temperature B' to C'; and S'co represents a threshold value from the temperature C' to a lower temperature.

Hysteresis is provided between the threshold values S'oc and S'co, between S'cb and S'bc, and between S'ba and S'ab.

(IV-3) Description of State Transition of Blow-off Modes

The state transition of blow-off modes in the operation procedure described above is as shown in Table 2.

In Table 2 an operation stop condition and blow-off modes are enumerated in the vertical direction and state numbers are enumerated in the corresponding right-hand positions, while in the lateral direction there are enumerated operating switches (operation switch, mild blow-off switch, spot blow-off switch, pulse blow-off switch, wave blow-off switch, cycle blow-off switch, program blow-off switch) as well as display portions (mild blow-off, spot blow-off, pulse blow-off, wave blow-off, cycle blow-off, program blow-off, selection patterns A, B, C) which are indicated by light emitting diodes on the operating panel 6.

Table 2 shows the transition from a blow-off mode before turning ON of each operating switch to a blow-off mode after turning ON thereof.

In the cases of pulse blow-off, wave blow-off, cycle blow-off and program blow-off each having the selection patterns A, B, and C as sub modes, between blow-off modes of the same kind, newly added sub modes are sure to shift in a preset order, for example, in the order from high to low frequency of use (A→B→C→A in this embodiment).

Between blow-off modes of different kinds, a shift is made surely to a preset sub mode, for example, a sub mode of a high frequency of use (the sub mode A in this embodiment).

Description will now be made more concretely with reference to Table 2. Upon turning ON of the operation switch 100, a shift is made from operation stop (state No. "0") to mild blow-off (state No. "1").

In this state, if the pulse blow-off switch 263 or 103 is turned ON, a shift is made from mild blow-off to pulse blow-off A (state No. "3A").

If in this state the spot blow-off switch 262 or 102 is turned ON, a shift is made from pulse blow-off A to spot blow-off (state No. "2").

If in the state of pulse blow-off A the pulse blow-off switch 263 or 103 is turned ON for transition to a blow-off mode of the same kind, a shift is made to pulse blow-off B (state No. "3B").

Further if the wave blow-off switch 265 or 104 is turned ON for transition from the state of pulse blow-off A to a blow-off mode of a different kind, a shift is made to wave blow-off A (state No. "4A"), while if the cycle blow-off switch 266 or 105 is turned ON, a shift is made to cycle blow-off A (state No. "5A"), or if the program blow-off switch 267 or 106 is turned ON, a shift is made to program blow-off A (state No. "6A").

Thus, since the blow-off mode is set to the mild blow-off at the beginning of operation, even when the user is a child or an old person, it is possible to prevent the user from having his legs carried away by the hot water jet and falling down and also prevent discomfort to the user due to an excessive blow-off strength.

Moreover, since the sub blow-off modes are sure to shift in a preset order, it is easy for the user to understand a sub mode transition pattern and operate the controls.

The designation "ON" in Table 2 indicates lighting of the display portion of the blow-off mode being adopted. For example, in the case of pulse blow-off A, the letter "A" lights in both the pulse blow-off display portion 13 and the selection pattern display portion (142).

In the case of program blow-off patterns A, B, and C, the program ("random") blow-off display portion (indication lamp) 106*a* and one of the indication lamps 121, 122, 123 of the selection pattern display portion light up, while the mild blow-off, spot blow-off, pulse blow-off and wave blow-off display portions (indication lamps) 101*a*, 102*a*, 103*a*, 104*a* go on and off. In Table 2, the mark "-" represents non-change and the mark "." represents an OFF condition.

In the state transition of blow-off modes described above, the blow-off strength level does not change even if the blow-off mode is changed.

Thus, it is possible to prevent discomfort to the user from a change in blow-off strength level at the time of change of the blow-off mode. It is also possible to change the strength level to a medium level with change in the blow-off mode.

Further, the hot water blow-off position is not changed even if the blow-off mode is changed.

Thus, it is possible to prevent discomfort to the user from a change of blow-off position at the time of change of the blow-off mode.

As to the hot water blow-off position, it is also possible to open all the blow-off nozzles 2, 3, 4 with change in the blow-off mode, allowing the user to feel the blow-off mode after change all over his body, and thereafter make a change to desired blow-off positions matching the blow-off mode.

four-hole operation (955)(956)(957) to the six-hold operation (950).

It is also possible to change from the four-hole operation (955)(956)(957) into a two-hole operation (967)(968) (969) in which additional two blow-off nozzles are OFF, by pushing OFF an ON-state switch out of the pattern switches for the leg-, back- and belly-side blow-off nozzles (960)–(965).

Further, it is possible to make a return from the two-hole operation (967)(968)(969) to the four-hole operation (955)(956)(957) by pushing ON an OFF-state switch out of the pattern switches for the leg-, back- and belly-side blow-off nozzles (960)–(965).

TABLE 2

| | | State Transition of Blow-off Modes | | | | | | | | | | | | | | | |
|---|---|---|---|---|---|---|---|---|---|---|---|---|---|---|---|---|---|
| | | Operation Switch | | | | | | | Operating Panel, LED Display | | | | | | | | |
| State | State No. | Operation | Mild | Spot | Pulse | Wave | Cycle | Program | Mild | Spot | Pulse | Wave | Cycle | Program | A | B | C |
| Operation Stop | 0 | 1 | — | — | — | — | — | — | • | • | • | • | • | • | • | • | • |
| Mild Blow-off | 1 | 0 | — | 2 | 3A | 4A | 5A | 6A | ON | • | • | • | • | • | • | • | • |
| Spot Blow-off | 2 | 0 | 1 | — | 3A | 4A | 5A | 6A | • | ON | • | • | • | • | • | • | • |
| Pulse Blow-off A | 3A | 0 | 1 | 2 | 3B | 4A | 5A | 6A | • | • | ON | • | • | • | ON | • | • |
| Pulse Blow-off B | 3B | 0 | 1 | 2 | 3C | 4A | 5A | 6A | • | • | ON | • | • | • | • | ON | • |
| Pulse Blow-off C | 3C | 0 | 1 | 2 | 3A | 4A | 5A | 6A | • | • | ON | • | • | • | • | • | ON |
| Wave Blow-off A | 4A | 0 | 1 | 2 | 3A | 4B | 5A | 6A | • | • | • | ON | • | • | ON | • | • |
| Wave Blow-off B | 4B | 0 | 1 | 2 | 3A | 4C | 5A | 6A | • | • | • | ON | • | • | • | ON | • |
| Wave Blow-off C | 4C | 0 | 1 | 2 | 3A | 4A | 5A | 6A | • | • | • | ON | • | • | • | • | ON |
| Cycle Blow-off A | 5A | 0 | 1 | 2 | 3A | 4A | 5B | 6A | • | • | • | • | ON | • | ON | • | • |
| Cycle Blow-off B | 5B | 0 | 1 | 2 | 3A | 4A | 5C | 6A | • | • | • | • | ON | • | • | ON | • |
| Cycle Blow-off C | 5C | 0 | 1 | 2 | 3A | 4A | 5A | 6A | • | • | • | • | ON | • | • | • | ON |
| Program Blow-off A | 6A | 0 | 1 | 2 | 3A | 4A | 5A | 6B | ON/OFF | ON/OFF | ON/OFF | ON/OFF | • | ON | ON | • | • |
| Program Blow-off B | 6B | 0 | 1 | 2 | 3A | 4A | 5A | 6C | ON/OFF | ON/OFF | ON/OFF | ON/OFF | • | ON | • | ON | • |
| Program Blow-off C | 6C | 0 | 1 | 2 | 3A | 4A | 5A | 6A | ON/OFF | ON/OFF | ON/OFF | ON/OFF | • | ON | • | • | ON |

(IV-4) Description of State Transition of Hot Water Blow-off Positions

Figure 36:
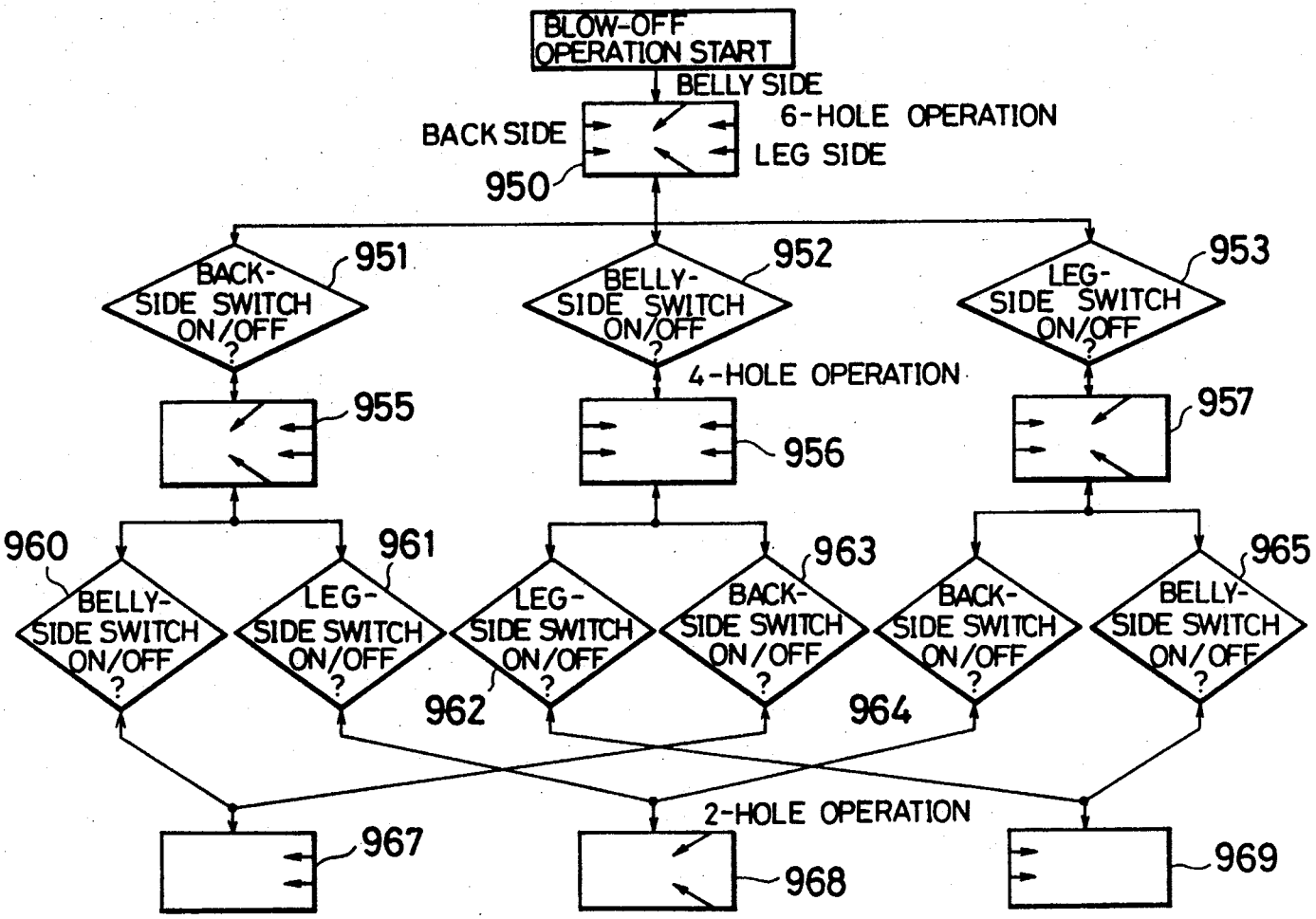
FIG. 36 is an explanatory view of a hot water blow-off position changing operation.

The hot water blow-off position changing operation in the operation procedure based on flowcharts of (IV-1) will be described below with reference to the explanatory view of FIG. 36.

In this embodiment, the hot water blow-off position can be changed so as to apply hot water jets to the user's whole body or a part of the body according to the user's liking.

More specifically, a six-hole operation is initialized (950) in which hot water is blown off from the six, leg-, back- and belly-side blow-off nozzles 2,2,3,3,4,4 simultaneously.

From the six-hole operation (950) in which all of the ON-OFF type pattern switches for the leg-, back- and belly-side blow-off nozzles are ON, a change can be made into a four-hole operation (955)(956)(957) in which two blow-off nozzles are OFF, by pushing OFF any switch (951)(952)(953).

By pushing ON the pattern switch which has been pushed OFF, it is possible to make a return from the Table 3 shows the state transition of hot water blow-off positions described above, in which operation stopping and blow-off positions (back, belly, leg, back-belly, belly-leg, back-leg, back-belly-leg) are enumerated in the vertical direction and state numbers are enumerated in the corresponding right-hand positions, while in the lateral direction there are enumerated operating switches (operation switch as well as back-, belly- and leg-side switches) and pilot lamps (back-, belly- and leg-side pilot lamps) which are turned ON by light emitting diodes on the operating panel 6.

An explanation will now be made concretely with reference to Table 3. If the operation switch 100 is turned ON, a change is made from operation stop (state No. "0") to a six-hole operation (950) (state No. "111") in which hot water is blown off from the six, leg-, back- and belly-side blow-off nozzles 2,2,3,3,4,4 simultaneously, and if in this state the back-side nozzle pattern switch 274 or 111 is pushed OFF, a shift is made to a four-hole operation (955) of the leg- and belly-side blow-off nozzles 2,2,4,4 and the state number becomes "011".

In the above four-hole operation (state No. "011"), both leg-side pilot lamp 112*a* and belly-side pilot lamp 113*a* go on.

Thus, the six-hole operation is initialized at the start of operation, and by turning ON and OFF the leg-, back- and belly-side blow-off nozzle use pattern switches there can be made an easy change from the six-hole operation to the four- or two-hole operation, or from the two-hole operation to the four- or six-hole operation. In Table 3, the mark "-" represents non-change and the mark "." represents an OFF condition.

In the state transition of hot water blow-off positions described above, the strength level does not change as long as the blow-off operation does not stop even if the hot water blow-off positions are changed.

Thus, since it is possible to maintain the strength level in the blow-off positions before change, it is not necessary to perform a strength level changing operation, that is, it is possible to prevent discomfort to the user at the time of change of the blow-off positions.

The strength level is set so that when the hot water blow-off strength increasing switch 268 or 107 is pushed and then released, a shift is made in a direction in which the strength is enhanced one stage, while when the hot water blow-off strength decreasing switch 269 or 108 is pushed and then released, a shift is made in a direction in which the strength is weakened one stage.

For example, if the operation switch 100 is turned ON, a shift is made from operation stop (stage No. "0") to the strength level "medium" (state No. "3"), and if in this state the hot water blow-off strength increasing switch 268 or 107 is pushed and then released, a shift is made from "medium" to the strength level "medium strong" (state No. "4"), then if the same switch 268 or 107 is again pushed and then released, a shift is made to the strength level "strong" (state No. "5").

Further, if in the strength level "medium" the hot water blow-off strength decreasing switch 269 or 108 is pushed and then released, a shift is made to the strength level "medium weak" (state No. "2"), and if the same switch 269 or 108 is again pushed and then released, a shift is made to the strength level "weak" (state No. "1").

TABLE 3

State Transition of Hot Water Blow-off Position

| | | Operating Switch | | | | Operating Panel | | |
|---|---|---|---|---|---|---|---|---|
| State | State No. | Operation | Back-side | Belly-side | Leg-side | Back-side | Belly-side | Leg-Side |
| Operation Stop | 0 | 111 | — | — | — | • | • | • |
| Back | 100 | 0 | — | 110 | 101 | ON | • | • |
| Belly | 010 | 0 | 110 | — | 011 | • | ON | • |
| Leg | 001 | 0 | 101 | 011 | — | • | • | ON |
| Back-Belly | 110 | 0 | 010 | 100 | 111 | ON | ON | • |
| Belly-Leg | 011 | 0 | 111 | 001 | 010 | • | ON | ON |
| Back-Leg | 101 | 0 | 001 | 111 | 100 | ON | • | ON |
| Back-Belly-Leg | 111 | 0 | 011 | 101 | 110 | ON | ON | ON |

(IV-5) Description of State Transition of Strength Level in Blow-Off Operation The strength level in the operation procedure based on flowcharts of (IV-1) is set to five stages of "strong," "medium strong," "medium," "medium weak" and "weak" for each blow-off mode, and different strengths are set in consideration of the contents of the blow-off modes; that is, different blow-off modes lead to different blow-off strengths even at the same strength level indication "medium".

The state transition of such strength level is as shown in Table 4.

In Table 4, operation stopping and five-stages of strength levels (strong, medium strong, medium, medium weak, weak) as well as program blow-off patterns A, B, C are enumerated in the vertical direction, and state numbers are enumerated in the corresponding right-hand positions, while in the lateral direction there are enumerated operating switches (operation switch as well as hot water blow-off strength increasing and decreasing switches, the latter two switches being designated "strong" and "weak" as shown in FIG. 9*b* and FIG. 14) and strength level indicating lamps (level strong, medium strong, medium, medium weak and weak indicating lamps) using light emitting diodes.

In the program blow-off patterns A, B, and C, since the strength level is programmed beforehand, it cannot be changed even upon operation of the hot water blow-off strength increasing and decreasing switches 268, 269 or 107, 108.

In Table 4, the designation "ON" indicates lighting of the strength level indicating lamp in operation.

The designation "ON/OFF" indicates that the strength level indicating lamp goes ON and OFF when the program blow-off pattern A, B or C, incapable of having its programmed strength level changed, is in operation. Further, "-" indicates non-change and "." indicates an OFF condition.

Thus, since the strength level is set to "medium" at the start of blow-off operation, there is no fear of a too strong hot water jet causing discomfort to the user, and also when the user is a child or an old person, it is possible to prevent the user from being carried away by the hot water jet and falling down.

Further, for both increase and decrease the strength level is changed step by step, so it is possible to prevent a sudden change in the user's body feeling and also possible to prevent the pipes from being damaged by water hammer due to sudden rise of the water pressure in the pipes.

TABLE 4

| State | State No. | Operation | Operating Switch "Strong" (for increasing strength) | Operating Switch "Weak" (for decreasing strength) | Strength Level: Operating Panel, LED Display: Strong | Medium Strong | Medium | Medium Weak | Weak |
|---|---|---|---|---|---|---|---|---|---|
| Operation Stop | 0 | 3 | — | — | • | • | • | • | • |
| Strong | 5 | 0 | — | 4 | ON | • | • | • | • |
| Medium Strong | 4 | 0 | 5 | 3 | • | ON | • | • | • |
| Medium | 3 | 0 | 4 | 2 | • | • | ON | • | • |
| Medium Weak | 2 | 0 | 3 | 1 | • | • | • | ON | • |
| Weak | 1 | 0 | 2 | — | • | • | • | • | ON |
| Program A | 6A | 0 | — | — | ON/OFF | ON/OFF | ON/OFF | ON/OFF | ON/OFF |
| Program B | 6B | 0 | — | — | ON/OFF | ON/OFF | ON/OFF | ON/OFF | ON/OFF |
| Program C | 6C | 0 | — | — | ON/OFF | ON/OFF | ON/OFF | ON/OFF | ON/OFF |

(IV-6) Description of Priority of Main Operations

The priority of main operations in the operation procedure based on flowcharts (IV-1) is as shown in Table 5.

TABLE 5

| | |
|---|---|
| High | Stop at high water temperature |
| | Stop at low water level |
| | Freeze proofing operation |
| | Stop of blow-off operation timer |
| | Filter washing operation |
| | Timer operation |
| | Blow-off operation |
| | Automatic filter washing operation |
| Low | Operation stop |

Thus stopping at a high water temperature is given the top priority to ensure safety, and also as to the other operations the order of priority is provided so as to protect the user and the constituent elements of the apparatus and to permit optimum control to effect an efficient operation.

(IV-7) Control Timing between Opening/Closing of Blow-off Volume Adjusting Valves and Change of the Rate of Revolution of Circulating Pump The following Tables 6 and 7 show the control timing between opening and closing operations of the leg-, back- and belly-side blow-off nozzles 2, 3, 4 and the change of the rate of revolution of the circulating pump P.

TABLE 6

| Blow-off Mode before Change | Blow-off Mode after Change | Change in the Rate of Revolution of the Circulating Pump | Control Timing |
|---|---|---|---|
| Mild Blow - Off | Spot Blow-off<br>Pulse Blow-off<br>Wave Blow-off | 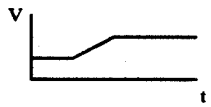 | First open or close Blow-off Nozzles |
| Spot Blow-off<br>Pulse Blow-off<br>Wave Blow-off | Mild Blow-off | 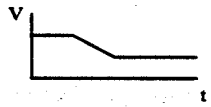 | First change the rate of revolution of the circulating pump |
| Spot Blow-off<br>Pulse Blow-off<br>Wave Blow-off | Cycle Blow-off | 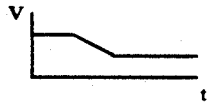 | First change the rate of revolution of the circulating pump |
| Cycle Blow-off | Spot Blow-off<br>Pulse Blow-off<br>Wave Blow-off | 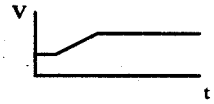 | First open or close Blow-off Nozzles |

TABLE 7

| Number of Jets before Change | Number of Jets after Change | Control Timing |
|---|---|---|
| 6 | 4 | First decrease the rate of revolution of the circulating pump |
| 4 | 2 | First decrease the rate of revolution of the circulating pump |
| 4 | 6 | First open blow-off nozzles |
| 2 | 4 | First open blow-off nozzles |

In the case where it is necessary to increase the rate of revolution of the circulating pump P at the time of changing the blow-off mode as shown in Table 6, the opening or closing operation of the blow-off nozzles 2, 3, 4 is performed prior to changing the rate of revolution of the pump P, while when it is necessary to decrease the rate of revolution of the circulating pump P, the change of the rate of revolution of the pump P is performed prior to the opening or closing operation of the blow-off nozzles 2, 3, 4.

When the number of hot water jets operating is to be decreased, at the time of changing the number of jets operating, as shown in Table 7, the rate of revolution of the circulating pump P is decreased prior to the closing operation of the blow-off nozzles 2, 3, 4, while when the number of hot water jets operating is to be increased, the opening operation of the nozzles 2, 3, 4 is performed prior to changing the rate of revolution of the pump P.

Thus, at the time of changing the blow-off mode and the number of hot water jets operating, the control timing for the opening or closing operation of the blow-off nozzles 2, 3, 4 and that for the change of the rate of revolution of the circulating pump P are made different, whereby not only is it possible to prevent discomfort to the user due to a change of the blow strength but also an abrupt change in the discharge pressure of the circulating pump P can be prevented, thereby preventing the damage of pipes caused by water hammer.

We claim:

1. A blow-off nozzle structure for a whirlpool bath in a bath body capable of automatically varying a blow-off volume of water into said bathtub body comprising:

a) a tubular nozzle casing defining a blow-off flow forming passage therein, said passage forming a blow-off opening at a front end thereof and a hot water inlet opening at a rear end thereof, b) a valve seat formed in a mid-portion of said blow-off flow forming passage, c) a valve element capable of being extended to or retracted from said valve seat so as to adjust the degree of opening of said valve seat, d) an air mixing portion defined in said blow-off flow forming passage and disposed at a position in front of said valve seat, said air mixing portion communicated with an air intake portion which has one end opened to an air source including the atmosphere, e) a power-operated linear motor within said nozzle structure and capable of moving said valve element toward or away from said valve seat in response to a controller, whereby air-mixed water is blown off from said blow-off opening of said tubular nozzle casing and the volume of said blow-off air-mixed hot water is regulated by the degree of opening of said valve seat without manual manipulation of said tubular nozzle.

2. A blow-off nozzle structure capable of automatically varying the blow-off volume of water according to claim 1, wherein said tubular nozzle casing is adapted to be connected to a nozzle mounting opening.

3. A blow-off nozzle structure capable of automatically varying the blow-off volume of water according to claim 2, wherein said nozzle casing forms an outer male-threaded portion and a flange portion in the front end thereof which are disposed outside of said bathtub body and a threaded sleeve which has an inner female-threaded portion and an outer flange portion is disposed inside of said bathtub body and said threaded sleeve has said inner female-threaded portion engaged with said outer male-threaded portion of said nozzle casing so as to biasingly clamp said wall of said bathtub body with said two flange portions.

4. A blow-off nozzle structure capable of automatically varying the blow-off volume of water according to claim 2, wherein an axis of said hot water inlet opening is angularily shifted in a circumferential direction relative to an axis of said air intake portion.

5. A blow-off nozzle structure capable of automatically varying the blow-off volume of water according to claim 2, wherein said valve element is fixedly mounted on a distal end of a reciprocating rod of said power-operated motor and a cylindrical water-proof cover is provided between said valve element and a motor casing of said power-operated motor.

6. A blow-off nozzle structure capable of automatically varying the blow-off volume of water according to claim 2, wherein said motor comprises a power-operated stepping motor.

7. A blow-off nozzle structure capable of automatically varying the blow-off volume of water according to claim 6, wherein said power-operated stepping motor comprises;

a) a cylindrical coil attached to an inner surface of said motor casing, b) a cylindrical magnet concentrically disposed in said cylindrical coil such that said magnet is rotated upon energizing of said cylindrical coil, c) a rotor nut concentrically and fixedly mounted on the inner surface of said cylindrical magnet, said rotor nut provided with a ball-receiving spiral groove on the inner surface thereof, d) a reciprocating rod axially reciprocably disposed in said rotor nut, said reciprocating rod provided with a ball-receiving spiral groove on the outer surface thereof, e) a plurality of rolling balls accommodated in a spiral space defined between said two spiral grooves, and f) a key provided on said motor casing for preventing the rotation of said reciprocating rod while allowing the axial movement of said reciprocating rod, whereby, upon integral rotation of said cylindrical magnet and said rotor nut, said reciprocating rod is finely advanced or retracted.

8. A blow-off nozzle structure capable of automatically varying the blow-off volume of water according to claim 2, wherein a vortex-generating element is disposed in said blow-off forming passage upstream of said air mixing portion.

9. A blow-off nozzle structure capable of automatically varying the blow-off volume of water according to claim 2, wherein said blow-off nozzle structure is made of a pair of leg-side blow-off nozzles and a pair of back-side blow-off nozzles which are mounted on both end walls of said bathtub body.

10. A blow-off nozzle structure capable of automatically varying the blow-off volume of water according to claim 9, wherein said blow-off nozzle structure is further provided with a pair of belly-side blow-off nozzles which are mounted on both side walls of said bathtub body.

11. A blow-off nozzle structure capable of automatically varying the blow-off volume of water according to claim 10, wherein operation of said plurality of blow-off nozzles is controlled by a control unit to effect a cycle blow in which blow-off positions of said blow-off nozzles are changed at a certain cycle by opening or closing each said blow-off nozzle at the certain cycle.

12. A blow-off nozzle structure capable of automatically varying the blow-off volume of water according to claim 9, wherein operation of said plurality of blow-off nozzles is controlled by a control unit to effect a cycle blow in which blow-off positions of said blow-off nozzles are changed at a certain cycle by opening or closing each said blow-off nozzle at the certain cycle.

13. A blow-off nozzle structure capable of automatically varying the blow-off volume of water according to claim 2, wherein an electrically-conductive sleeve which is earthed to ground is provided at said blow-off opening of said tubular nozzle casing, thus preventing the leakage of electricity from said power-operated motor.

14. A blow-off nozzle structure capable of automatically varying the blow-off volume of water according to claim 2, wherein a motor portion of said power-operated motor is encased by an electrically-conductive cover which is earthed to ground.

15. A blow-off nozzle structure capable of automatically varying the blow-off volume of water according to claim 1, wherein said power-operated motor is controlled by a control unit along with a circulating pump mounted on a hot water circulating passage which has both ends thereof connected to a hot water suction opening and said blow-off nozzle respectively, thus providing blow-off of said hot water in various modes which are different in the blow-off volume and pressure.

16. A blow-off nozzle structure capable of automatically varying the blow-off volume of water comprising;

a) a tubular nozzle casing defining a blow-off flow forming passage therein, said passage forming a blow-off opening at a front end thereof and a hot water inlet opening at a rear end thereof, b) a valve seat formed in a mid-portion of said blow-off flow forming passage, c) a valve element capable of being extended to or retracted from said valve seat so as to adjust the degree of opening of said valve seat, d) an air mixing portion defined in said blow-off flow forming passage and disposed at a position in front of said valve seat, said air mixing portion communicated with an air intake portion which has one end opened to an air source including the atmosphere, e) an automatic valve element reciprocating means comprising a power-operated linear motor operatively connected to said valve element and capable of moving said valve element toward or away from said valve seat upon receiving control signals from a control unit, whereby air-mixed water is blown off from said blow-off opening of said tubular nozzle casing and the volume of said blow-off air-mixed hot water is regulated by the degree of opening of said valve seat.

17. A blow-off nozzle structure capable of automatically varying the blow-off volume of water according to claim 16, wherein said nozzle casing forms an outer male-threaded portion and a flange portion in the front end thereof which are disposed outside of said bathtub body and a threaded sleeve which has an inner female-threaded portion and an outer flange portion is disposed inside of said bathtub body and said threaded sleeve has said inner female-threaded portion engaged with said outer male-threaded portion of said nozzle casing so as to biasingly clamp said wall of said bathtub body with said two flange portions.

18. A blow-off nozzle structure capable of automatically varying the blow-off volume of water according to claim 16, wherein an axis of said hot water inlet opening is angularily shifted in a circumferential direction relative to an axis of said air intake portion.

19. A blow-off nozzle structure capable of automatically varying the blow-off volume of water according to claim 16, wherein said valve element is fixedly mounted on a distal end of a reciprocating rod of said power-operated motor and a cylindrical water-proof cover is provided between said valve element and a motor casing of said power-operated motor.

20. A blow-off nozzle structure capable of automatically varying the blow-off volume of water according to claim 16, wherein said motor comprises a power-operated stepping motor.

21. A blow-off nozzle structure capable of automatically varying the blow-off volume of water according to claim 20, wherein said power-operated stepping motor comprises;

a) a cylindrical coil attached to an inner surface of said casing;

b) a cylindrical magnet concentrically disposed in said cylindrical coil such that said magnet is rotated upon energizing of said cylindrical coil, c) a rotor nut concentrically and fixedly mounted on the inner surface of said cylindrical magnet, said rotor nut provided with a ball-receiving spiral groove on the inner surface thereof, d) a reciprocating rod axially reciprocably disposed in said rotor nut, said reciprocating rod provided with a ball-receiving spiral groove on the outer surface thereof, e) a plurality of rolling balls accommodated in a spiral space defined between said two spiral grooves, and f) a key provided on said motor casing for preventing the rotation of said reciprocating rod while allowing the axial movement of said reciprocating rod, whereby, upon integral rotation of said cylindrical magnet and said rotor nut, said reciprocating rod is finely advanced or retracted.

22. A blow-off nozzle structure capable of automatically varying the blow-off volume of water according to claim 16, wherein a vortex-generating element is disposed in said blow-off forming passage upstream of said air mixing portion.

23. A blow-off nozzle structure capable of automatically varying the blow-off volume of water according to claim 16, wherein said blow-off nozzle structure is made of a pair of leg-side blow-off nozzles and a pair of back-side blow-off nozzles which are mounted on both end walls of said bathtub body.

24. A blow-off nozzle structure capable of automatically varying the blow-off volume of water according to claim 23, wherein said blow-off nozzle structure is further provided with a pair of belly-side blow-off nozzles which are mounted on both side walls of said bathtub body.

25. A blow-off nozzle structure capable of automatically varying the blow-off volume of water according to claim 24, wherein operation of said plurality of blow-off nozzles is controlled by a control unit to effect a cycle blow in which blow-off positions of said blow-off nozzles are changed at a certain cycle by opening or closing each said blow-off nozzle at the certain cycle.

26. A blow-off nozzle structure capable of automatically varying the blow-off volume of water according to claim 23, wherein operation of said plurality of blow-off nozzles is controlled by a control unit to effect a cycle blow in which blow-off positions of said blow-off nozzles are changed at a certain cycle by opening or closing each said blow-off nozzle at the certain cycle.

27. A blow-off nozzle structure capable of automatically varying the blow-off volume of water according to claim 24, wherein an electrically-conductive sleeve which is earthed to ground is provided at said blow-off opening of said tubular nozzle casing, thus preventing the leakage of electricity from said power-operated motor.

28. A blow-off nozzle structure capable of automatically varying the blow-off volume of water according to claim 16, wherein a motor portion of said power-operated motor is encased by an electrically-conductive cover which is earthed to ground.

29. A blow-off nozzle structure capable of automatically varying the blow-off volume of water according to claim 16, wherein said power-operated motor is controlled by a control unit along with a circulating pump mounted on a hot water circulating passage which has both ends thereof connected to a hot water suction opening and said blow-off nozzle respectively, thus providing blow-off of said hot water in various modes which are different in the blow-off volume and pressure.

* * * * *